United States Patent [19]

Sakanoue et al.

[11] Patent Number: 4,960,688

[45] Date of Patent: Oct. 2, 1990

[54] SILVER HALIDE COLOR PHOTOGRAPHIC MATERIAL

[75] Inventors: Kei Sakanoue; Yoshio Ishii; Tsumoru Hirano, all of Kanagawa, Japan

[73] Assignee: Fuji Photo Film Co., Ltd., Kanagawa, Japan

[21] Appl. No.: 161,865

[22] Filed: Feb. 29, 1988

[30] Foreign Application Priority Data

| | | | |
|---|---|---|---|
| Feb. 27, 1987 | [JP] | Japan | 62-44790 |
| Feb. 27, 1987 | [JP] | Japan | 62-44791 |
| Feb. 27, 1987 | [JP] | Japan | 62-44792 |
| Dec. 14, 1987 | [JP] | Japan | 62-315766 |

[51] Int. Cl.[5] ..... G03C 1/30; G03C 7/327

[52] U.S. Cl. ..... 430/548; 430/621; 430/623; 430/624; 430/625; 430/552; 430/553; 430/554; 430/555; 430/556; 430/557; 430/558

[58] Field of Search ..... 430/548, 381, 621, 623, 430/624, 625, 552, 553, 554, 555, 556, 557, 558

[56] References Cited

U.S. PATENT DOCUMENTS

| | | | |
|---|---|---|---|
| 3,671,256 | 6/1972 | Minsk et al. | 430/625 |
| 4,145,221 | 3/1979 | Chuang et al. | 96/95 |
| 4,193,795 | 3/1980 | Campbell et al. | 430/548 |
| 4,215,195 | 7/1980 | Ponticello et al. | 430/496 |
| 4,340,664 | 7/1982 | Monbaliu et al. | 430/548 |
| 4,600,687 | 7/1986 | Nakamura et al. | 430/529 |
| 4,722,885 | 2/1988 | Yokoyama et al. | 430/548 |

FOREIGN PATENT DOCUMENTS

| | | | |
|---|---|---|---|
| 656456 | 3/1965 | Belgium . | |
| 0136924 | 4/1985 | European Pat. Off. | 430/548 |
| 2001727 | 7/1970 | Fed. Rep. of Germany . | |
| 2089450 | 1/1972 | France . | |
| 58-28744 | 2/1983 | Japan . | |
| 0196758 | 10/1985 | Japan | 430/548 |
| 0218646 | 11/1985 | Japan | 430/548 |
| 2031851 | 2/1987 | Japan | 430/548 |
| 3091659 | 4/1988 | Japan | 430/548 |
| 3092950 | 4/1988 | Japan | 430/548 |
| 2046626 | 11/1980 | United Kingdom . | |
| 2064800 | 6/1981 | United Kingdom . | |

OTHER PUBLICATIONS

Patent Abstracts of Japan, vol. 7, No. 105 (P-195) [1250], May 7, 1983.

Patent Abstracts of Japan, vol. 7, No. 60 (P-182) [1205], Mar. 12, 1983.

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

A silver halide color photographic material is described comprising a support having thereon at least one silver halide emulsion layer, wherein the silver halide color photographic material contains a water-soluble polymer comprising at least one repeating unit represented by formula (I)

(I)

wherein A represents a vinyl repeating unit having a color coupler moiety which is capable of forming a dye upon coupling with an oxidation product of an aromatic primary amine developing agent;

and at least one repeating unit selected from the group consisting of formulae (II-A), (II-B), (II-C), (II-D), (II-E), and (II-F):

(II-A)

(II-B)

(II-C)

(II-D)

(II-E)

(Abstract continued on next page.)

-continued
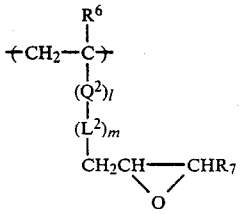
(II-F)
(Symbols in these formulae are the same as defined in claim 1)
The water-soluble polymer is a photographic polymeric coupler incorporating a crosslinkable group with gelatin and the silver halide color photographic material containing the water-soluble coupler is excellent in layer strength and image sharpness.
21 Claims, No Drawings

SILVER HALIDE COLOR PHOTOGRAPHIC MATERIAL

FIELD OF THE INVENTION

The present invention relates to a silver halide color photographic material containing a novel photographic polymeric coupler incorporating a crosslinkable group with gelatin.

BACKGROUND OF THE INVENTION

Recently, with color photographic light-sensitive materials for photography, the attainment of high image quality has been particularly sought, and image quality capable of being appreciated even in the case of enlargement from a small format, for example, 110 size, has been desired. However, it has been strongly desired to achieve further make improvement in graininess and sharpness.

With respect to sharpness, a method for enhancement of the edge effect using DIR compounds, etc., is known, as represented by Japanese Patent Application (OPI) Nos. 36249/84 (U.S. Pat. 4,500,634) and 145135/79 (U.S. Pat. 4,248,962) (the term "OPI" as used herein refers to an "unexamined published application"), and a method for minimizing light scattering by reducing the thickness of layer coated. As described in Japanese Patent Application (OPI) No. 36249/84, greater effects can be achieved by the combination of these means.

In order to carry out the reduction of the layer thickness, there are known, for example, (1) a method of rendering a ballast group of a coupler small, (2) a method of decreasing the amount of an organic solvent having a high boiling point which is used as a solvent for a coupler, and (3) a method of polymerizing a coupler in order to provide color forming groups in high density, etc. However, the method (1) has a problem of diffusion-resistivity of the coupler. In method (2), it is difficult to excessively reduce the amount of organic solvent because of deposition of the couplers and an adverse affect on color forming property. Thus, remarkable reduction of the layer thickness can not be expected. Further, in the case of method (3) wherein polymerized couplers are used in the form of a latex or emulsified dispersion, when an amount of gelatin used is reduced in order to remarkably reduce the thickness of layer, strength of the layer lowers and it causes a defect in that the film is apt to be injured before exposure, and during and after processing.

Hydrophilic polymeric couplers are also known. For instance, polymeric couplers in which reactive couplers are bonded to a pre-synthesized polymer (for example, a homopolymer of acrylic acid, a homopolymer of p-aminostyrene, etc.) or a natural high molecular compound (for example, gelatin, etc.) are described, for example, in U.S. Pat. Nos. 2,698,797, 2,852,381, 2,852,383 and 2,870,712, Japanese Patent Publication Nos. 16932/60 and 3661/69, etc., and polymeric couplers obtained by copolymerization of a coupler synthesized in the form of an unsaturated ethylenic monomer with other polymerizable monomer are described, for example, in British Patents Nos. 880,206, 955,197, 967,503, 967,504, 995,363 and 1,104,658.

However, since the above described hydrophilic polymeric couplers have insufficient diffusion resistivity, color mixing between layers tends to occur and the couplers are discharged into a processing solution during processing. Due to such problems, they have not been practically utilized.

In order to solve such problems, there have been provided water-soluble polymer couplers having a group capable of crosslinking with gelatin through a hardener (for example, a hydrophilic polymeric coupler having a phenolic hydroxy group or an active methylene group) as described, for example, in U.S. Patents 4,207,109 and 4,215,195, Japanese Patent Application (OPI) Nos. 205735/82, 27139/83, and 28744/83, etc. However, since these polymers effect crosslinkage with gelatin through a hardener, the crosslinking rate is small and the efficiency of crosslinking of the coupler and gelatin is low due to reactions involving crosslinking couplers per se or gelatin per se through the hardeners. Accordingly, they are still insufficient in view of diffusion resistivity.

SUMMARY OF THE INVENTION

Therefore, an object of the present invention is to provide a silver halide color photographic material containing a water-soluble polymeric coupler which has excellent diffusion resistivity, provides a sufficiently high dye image density, and has a rapid rate of crosslinking reaction with gelatin.

Another object of the present invention is to provide a silver halide color photographic material which is excellent in layer strength and image sharpness.

Other objects of the present invention will be apparent from the following detailed description and examples.

These objects of the present invention are accomplished by a silver halide color photographic material comprising a support having thereon at least one silver halide emulsion layer, wherein the silver halide color photographic material contains a water-soluble polymer comprising at least one repeating unit represented by formula (I):

$$\text{(A)} \qquad \text{(I)}$$

wherein A represents a vinyl monomer repeating unit having a color coupler moiety which is capable of forming a dye upon coupling with an oxidation product of an aromatic primary amine developing agent;

and at least one repeating unit selected from the group consisting of units represented by following formulae (II-A), (II-B), (II-C), (II-D), (II-E), and (II-F);

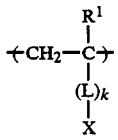

(II-A)

wherein $R^1$ represents a hydrogen atom, a lower alkyl group having from 1 to 6 carbon atoms or a chlorine atom; L represents a divalent group having from 1 to 20 carbon atoms, k represents 0 or 1; and X represents an active ester group;

(II-B)

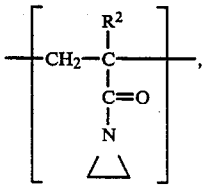

(II-C)

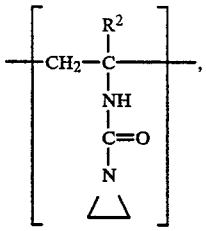

(II-D)

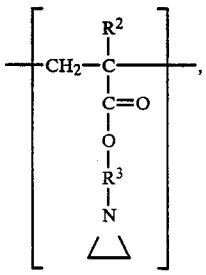

wherein $R^2$ represents a hydrogen atom, a chlorine atom or a lower alkyl group, and $R^3$ represents an alkylene group;

(II-E)

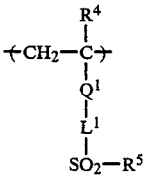

wherein $R^4$ represents a hydrogen atom or a lower alkyl group having from 1 to 6 carbon atoms; $Q^1$ represents $$-CO_2-,\ -\overset{R_1}{\overset{|}{C}}ON-$$

or an arylene group having from 6 to 10 carbon atoms; $L^1$ represents a divalent group having from 3 to 15 carbon atoms and containing at least one bond selected from $$-CO_2-\ \text{and}\ -\overset{R_1}{\overset{|}{C}}ON-$$

or a divaleng group having from 1 to 12 carbon atoms and containing at least one bond selected from $$-O-,\ -\overset{R_1}{\overset{|}{N}}-,\ -CO-,\ -SO-,\ -SO_2-,$$

-continued $$-SO_3-,\ -SO_2\overset{R_1}{\overset{|}{N}}-,\ -\overset{R_1}{\overset{|}{N}}CO\overset{R_1}{\overset{|}{N}}-\ \text{and}\ -\overset{R_1}{\overset{|}{N}}CO_2-;$$

$R^1$ represents a hydrogen atom or a lower alkyl group having from 1 to 6 carbon atoms; $R^5$ represents $-CH=CH_2$ or $-CH_2CH_2X_1$; and $X_1$ represents a group capable of being substituted with a nucleophilic group or of being released by a base in the form of $HX_1$;

(II-F)

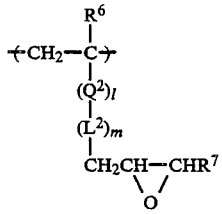

wherein $R^6$ represents a hydrogen atom, a chlorine atom or an alkyl group; $Q^2$ represents $$-CO_2,\ -\overset{R_2}{\overset{|}{C}}ON-$$

or an arylene group having from 6 to 10 carbon atoms; $L^2$ represents a divalent group having from 3 to 15 carbon atoms and containing at least one bond selected from $$-CO_2-\ \text{and}\ -\overset{R_2}{\overset{|}{C}}ON-$$

or a divalent group having form 1 to 12 carbon atoms and containing at least one bond selected from $$-O-,\ -\overset{R_2}{\overset{|}{N}}-,\ -CO-,\ -SO-,\ -SO_2-,\ -SO_3-,$$

$$-SO_2\overset{R_2}{\overset{|}{N}}-,\ -\overset{R_2}{\overset{|}{N}}CO\overset{R_2}{\overset{|}{N}}-\ \text{and}\ -\overset{R_2}{\overset{|}{N}}CO_2-;$$

$R_1$ represents a hydrogen atom or a lower alkyl group having from 1 to 6 carbon atoms; $R^7$ represents a hydrogen atom or an alkyl group; l and m each represetns 0 or 1, and l and m are not 0 at the same time.

DETAILED DESCRIPTION OF THE INVENTION

The water-soluble polymer coupler incorporating a hardener as a comonomer according to the present invention is particularly excellent in diffusion resistivity and a novel coupler which has not been previously disclosed.

The polymeric coupler in accordance with the present invention is described in greater detail below.

Preferred examples of the repeating unit represented by formula (I) which is capable of forming a dye upon coupling with an oxidation product of an aromatic primary amine developing agent are those represented by formula (III):

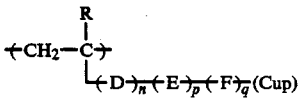

(III)

wherein R represents a hydrogen atom, an alkyl group having from 1 to 4 carbon atoms or a chlorine atom; D represents —COO—, —$CONR_3$— or a substituted or unsubstituted phenyl group; E represents a substituted or unsubstituted alkylene group preferably having from 1 to 10 carbon atoms, a substituted or unsubstituted phenylene group or a substituted or unsubstituted aralkylene group preferably having from 7 to 20 carbon atoms; F represents —$COR_3$—, —$NR_3CONR_3$—, —$R_3COO$—, —$NR_3CO$—, —$OCONR_3$—, -$NR_3$—, —COO—, —OCO—, —CO—, —O—, —$SO_2$—, —$NR_3SO_2$— or —$SO_2NR_3$—; $R_3$ represents a hydrogen atom, a substituted or unsubstituted alkyl group or a substituted or unsubstituted aryl group, and when two or more $R^3$ groups are present in the same molecule, they may be the same or different; n, p and q each represents 0 or 1, provided that all of n, p and q are not 0 at the same time; and Cup represents a cyan, magenta or yellow dye forming coupler moiety capable of forming a dye upon coupling with an oxidation product of an aromatic primary amine developing agent.

Suitable examples of the substituents for D, E, or $R^3$ include an alkyl group preferably having from 1 to 5 carbon atoms (for example, a methyl group, an ethyl group, etc.), an alkoxy group preferably having from 1 to 5 carbon atoms (for example, a methoxy group, an ethoxy group, etc.), an aryloxy group preferably having from 6 to 10 carbon atoms (for example, a phenyloxy group, etc.), an alkoxycarbonyl group preferably having from 2 to 10 carbon atoms (for example, a methoxycarbonyl group, etc.), an acylamino group preferably having from 1 to 10 carbon atoms (for example, an acetylamino group, benzoylamino group, etc.), a carbamoyl group, an alkylcarbamoyl group preferably having from 1 to 5 carbon atoms (for example, a methylcarbamoyl group, an ethylcarbamoyl group, etc.), a dialkylcarbamoyl group preferably having from 3 to 6 carbon atoms (for example, a dimethylcarbamoyl group, etc.), an arylcarbamoyl group preferably having from 7 to 10 carbon atoms (for example, a phenylcarbamoyl group, etc.), an alkylsulfonyl group preferably having from 1 to 5 carbon atoms (for example, a methylsulfonyl group, etc.), an arylsulfonyl group preferably having from 6 to 10 carbon atoms (for example, a phenylsulfonyl group, etc.), an alkylsulfonamido group preferably having from 1 to 5 carbon atoms (for example, a methanesulfonamido group, etc.), an arylsulfonamido group preferably having from 6 to 10 carbon atoms (for example, a phenylsulfonamido group, etc.), a sulfamoyl group, an alkylsulfamoyl group preferably having from 1 to 5 carbon atoms (for example, an ethylsulfamoyl group, etc.), a dialkylsulfamoyl group preferably having from 2 to 6 carbon atoms (for example, a dimethylsulfamoyl group, etc.), an alkylthio group preferably having from 1 to 5 carbon atoms (for example, a methylthio group, etc.), an arylthio group preferably having from 6 to 10 carbon atoms (for example, a phenylthio group, etc.), a cyano group, a nitro group, a halogen atom (for example, a fluorine atom, a chlorine atom, a bromine atom, etc.), and the like. When two or more substituents are present, they may be the same or different.

Among the color coupler moieties represented by Cup, as a cyan color forming coupler moiety, a moiety derived from a phenol type compound represented by formula (IV) or (V) described below or a naphthol type compound represented by the general formula (VI) or (VII) described below is preferred. In the compound represented by formula (IV), (V), (VI) or (VII), a moiety which is formed by eliminating a hydrogen atom other than that of the OH group at the p-position with respect to the coupling position and that at the coupling position of the compound is connected to F in formula (III) described above.

Formulae (IV) through (VII) are represented by

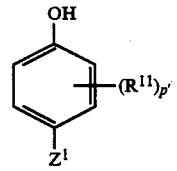

(IV)

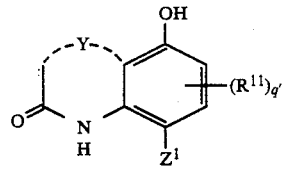

(V)

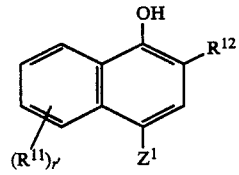

(VI)

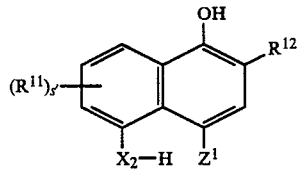

(VII)

wherein $R^{11}$ represents an atom or group capable of substitution on the phenol ring or the naphthol ring.

Suitable examples of the substituents represented by $R^{11}$ include a halogen atom, a hydroxy group, an nitro group, a carboxy group, a sulfo group, a cyano group, an aliphatic hydrocarbon group, an aromatic hydrocarbon group, a heterocyclic group preferably a 5 to 7-membered group having at least one N,S. and 0 atom, a carbonamido group, a sulfonamido group, a carbamoyl group, a sulfamoyl group, an aliphatic or armatic acyloxy group, an aliphatic or aromatic acyl group, an aliphatic oxy group, an aliphatic thio group, an aliphatic sulfonyl group, an aromatic oxy group, an aromatic thio group, an aromatic sulfonyl group, a sulfamoylamino group, an amino group, an imido group, and substituted groups of these groups. The group represented by $R^{11}$ preferably contains up to 30 carbon atoms.

$R^{12}$ represents —$CONR^{13}R^{14}$, —$NHCOR^{13}$, —$NHCOOR^{15}$, —$NHSO_2R_{15}$, —$NHCONR_{13}R_{14}$ Or —$NHSO_2NR_{13}R_{14}$, Wherein $R_{13}$ and $R_{14}$ each represents a hydrogen atom, an aliphatic group having from 1 to 30 carbon atoms (for example, a methyl group, an ethyl group, a butyl group, a methoxyethyl group, a n-decyl group, a n-dodecyl group, a n-hexadecyl group, a trifluoromethyl group, a heptafluoropropyl group, a dodecyloxypropyl group, a 2,4-di-tert-amylphenoxypropyl group, a 2,4-di-tert-amylphenoxybutyl group, etc.), an aromatic group having from 6 to 30 carbon atoms (for example, a phenyl group, a tolyl group, a 2-tetradecyloxyphenyl group, a pentafluorophenyl group, a 2-chloro-5-dodecyloxycarbonylphenyl group, etc.), or a heterocyclic group having from 2 to 30 carbon atoms (for example, a 2-pyridyl group, a 4-pyridyl group, a 2-furyl group, a 2-thienyl group, etc.); $R^{15}$ represents an aliphatic group having from 1 to 30 carbon atoms (for example, a methyl group, an ethyl group, a butyl group, a dodecyl group, a hexadecyl group, etc.), an aromatic group having from 6 to 30 carbon atoms (for example, a phenyl group, a tolyl group, a 4-chlorophenyl group, a naphthyl group, etc.), or a heterocyclic group (for example, a pyridyl group, a quinolyl group, a 2-furyl group, etc.). $R^{13}$ and $R^{14}$ may be connected to each other to form a heterocyclic ring (for example, a morpholine ring, a piperidine ring, a pyrrolidine ring, etc.).

p' represents an integer from 0 to 4; q' represents an integer from 0 to 2; and r' and s' each represents an integer from 0 to 4.

$X_2$ represents an oxygen atom, a sulfur atom or $$R^{16}\overset{|}{N}-,$$

wherein $R^{16}$ represents a hydrogen atom or a monovalent group. Suitable examples of the monovalent group represented by $R^{16}$ include an aliphatic group having from 1 to 30 carbon atoms (for example, a methyl group, an ethyl group, a butyl group, a methoxyethyl group, a benzyl group, etc.), an aromatic group having from 6 to 30 carbon atoms (for example, a phenyl group, a tolyl group, etc.), a heterocyclic group having from 2 to 30 carbon atoms (for example, a 2-pyridyl group, a 2-pyrimidyl group, etc.), a carbonamido group having from 1 to 30 carbon atoms (for example, a formamido group, an acetamido group, an N-methylacetamido group, a benzamido group, etc.), a sulfonamido group having from 1 to 30 carbon atoms (for example, a methanesulfonamido group, a toluenesulfonamido group, a 4-chlorobenzenesulfonamido group, etc.), an imido group having from 4 to 30 carbon atoms (for example, a succinimido group, etc.), $-OR^{17}$, $-SR^{17}$, $-COR^{17}$, $-CONR^{17}R^{18}$, $-COCOR^{17}$, $-COCONR^{17}R^{18}$, $-COOR^{19}$, $-COCOOR^{19}$, $-SO^2R^{19}$, $-SO^2OR^{19}$, $-SO^2NR^{17}R^{18}$ or $NR^{17}R^{18}$, etc., wherein $R^{17}$ and $R^{18}$, which may be the same or different, each represents a hydrogen atom, an aliphatic group having from 1 to 30 carbon atoms (for example, a methyl group, an ethyl group, a butyl group, a dodecyl group, a methoxyethyl group, a trifluoromethyl group, a heptafluoropropyl group, etc.), an aromatic group having from 6 to 30 carbon atoms (for example, a phenyl group, a tolyl group, a 4-chlorophenyl group, a pentafluorophenyl group, a 4-cyanophenyl group, a 4-hydroxyphenyl group, etc.), a heterocyclic group having from 2 to 30 carbon atoms (for example, a 4-pyridyl group, a 3-pyridyl group, a 2-furyl group, etc.), or $R^{17}$ and $R^{18}$ may be connected to each other to form a heterocyclic ring (for example, a morpholino group, a pyrrolidino group, etc.); $R^{19}$ represents a substituent selected from the Substituents defined for $R^{17}$ and $R^{18}$ except a hydrogen atom.

$Z^1$ represents a hydrogen atom or a group capable of being released (including an atom capable of being released) upon a coupling reaction with an oxidation product of an aromatic primary amine developing agent. Suitable examples of the group capable of being released include a halogen atom (for example, a fluorine atom, a chlorine atom, a bromine atom, an iodine atom), an aliphatic oxy group having from 1 to 30 carbon atoms (for example, a methoxy group, an ethoxy group, a 2-hydroxyethoxy group, a carboxymethyloxy group, a 3-carboxypropyloxy group, a 2-methoxyethoxycarbamoylmethyloxy group, a 2-methanesulfonylethoxy group, a 2-carboxymethylthioethoxy group, a triazolylmethyloxy group, etc.), an aromatic oxy group having from 6 to 30 carbon atoms (for example, a phenoxy group, a 4-hydroxyphenoxy group, a 2-acetamidophenoxy group, a 2,4-dibenzenesulfonamidophenoxy group, a 4-phenylazophenoxy group, etc.), a heterocyclic oxy group having from 2 to 30 carbon atoms (for example, a 4-pyridyloxy group, a 1-phenyl-5-tetrazolyloxy group, etc.), an aliphatic thio group having from 1 to 30 carbon atoms (for example, a dodecylthio group, etc.), an aromatic thio group having from 6 to 30 carbon atoms (for example, a 4-dodecylphenylthio group, etc.), a heterocyclic thio group having from 2 to 30 carbon atoms (for example, a 4-pyridylthio group, a 1-phenyltetrazol-5-ylthio group, etc.), an acyloxy group having from 2 to 30 carbon atoms (for example, an acetoxy group, benzoyloxy group, a lauroyloxy group, etc.), a carbonamido group having from 1 to 30 carbon atoms (for example, a dichloroacetylamido group, a trifluoroacetamido group, a heptafluorobutanamido group, a pentafluorobenzamido group, etc.), a sulfonamido group having from 1 to 30 carbon atoms (for example, a methanesulfonamido group, a toluenesulfonamido group, etc.), an aromatic azo group having from 6 to 30 carbon atoms (for example, a phenylazo group, a 4-chlorophenylazo group, a 4-methoxyphenylazo group, a 4-pivaloylaminophenylazo group, etc.), an aliphatic oxycarbonyloxy group having from 1 to 30 carbon atoms (for example, an ethoxycarbonyloxy group, a dodecyloxycarbonyloxy group, etc.), an aromatic oxycarbonyloxy group having from 6 to 30 carbon atoms (for example, a phenoxycarbonyloxy group, etc.), a carbamoyloxy group having from 1 to 30 carbon atoms (for example, a methylcarbamoyloxy group, a dodecylcarbamoyloxy group, a phenylcarbamoyloxy group, etc.), or a heterocyclic group having from 1 to 30 carbon atoms and connected to the coupling active position of the coupler through a nitrogen atom thereof (for example a succinimido group, a phthalimido group, a hydantoinyl group, a pyrazolyl group, a 2-benzotriazolyl group, etc.), etc.

Now, preferred examples of substituents which can be used in the present invention are described below.

$R^{11}$ is preferably a halogen atom (for example, a fluorine atom, a chlorine atom, a bromine atom), an aliphatic hydrocarbon group (for example, a methyl group, an ethyl group, an isopropyl group, etc.), a carbonamido group (for example, an acetamido group, a benzamido group, etc.), a sulfonamido group (for example, a methanesulfonamido group, a toluenesulfonamido group, etc.), etc.

$R^{12}$ is preferably $-CONR^{13}R^{14}$ (for example, a carbamoyl group, an ethylcarbamoyl group, a morpholinocarbonyl group, a dodecylcarbamoyl group, a hexadecylcarbamoyl group, a decyloxypropyl group, a dodecyloxypropyl group, a 2,4-di-tert-amylphenoxypropyl group, a 2,4-di-tert-amylphenoxybutyl group, etc.

$X_2$ is preferably $$R^{16}\overset{|}{N}-,$$

wherein $R^{16}$ preferably represents —$COR^{17}$ (for example, a formyl group, an acetyl group, a trifluoroacetyl group, a chloroacetyl group, a benzoyl group, a pentafluorobenzoyl group, a p-chlorobenzoyl group, etc.), —$COOR^{19}$ (for example, a methoxycarbonyl group, an ethoxycarbonyl group, a butoxycarbonyl group, a decyloxycarbonyl group, a methoxyethoxycarbonyl group, a phenoxycarbonyl group, etc.), —$SO_2R^{19}$ (for example, a methanesulfonyl group, an ethanesulfonyl group, a butanesulfonyl group, a hexadecanesulfonyl group, a benzenesulfonyl group, a toluenesulfonyl group, a p-chlorobenzenesulfonyl group, etc.), —$CONR^{17}R^{18}$ (for example, an N,N-dimethylcarbamoyl group, an N,N-diethylcarbamoyl group, an N,N-dibutylcarbamoyl group, a morpholinocarbonyl group, a piperidinocarbonyl group, a 4-cyanophenylcarbamoyl group, a 3,4-dichlorophenylcarbamoyl group, a 4-methanesulfonylphenylcarbamoyl group, etc.), or —$SO_2NR_{17}R_{18}$ (for example, an N,N-dimethylsulfamoyl group, an N,N-diethylsulfamoyl group, an N,N-dipropylsulfamoyl group, etc.).

Of the groups represented by $R^{16}$, —$COR^{17}$, —$COOR^{19}$ and $SO_2R^{19}$ are particularly preferred.

$Z^1$ is preferably a hydrogen atom, a halogen atom, an aliphatic oxy group, an aromatic oxy group, a heterocyclic thio group or an aromatic azo group.

As a magenta color forming coupler moiety, a coupler moiety derived from a coupler represented by the general formula (VII), (VIII), (IX), (X), (XI), (XII), or (XIII) described below is preferred. In the compound represented by these formulae, the coupler moiety is connected to F in formula (III) described above at any of Sub, $Z^2$ and $R^{20}$ to $R^{32}$.

(VII)

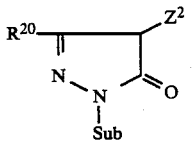

(VIII)

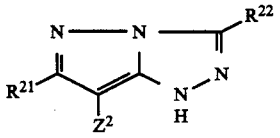

(IX)

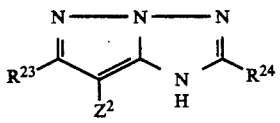

(X)

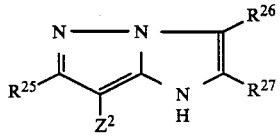

-continued (XI)

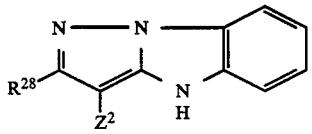

(XII)

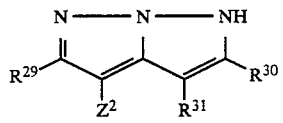

(XIII)

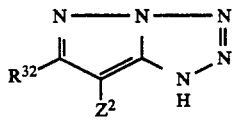

wherein Sub represents a substituent which is known as a susbtituent at the 1-position of a 2-pyrazolin-5-one coupler, including, for example, an alkyl group, a substituted alkyl group (for example, a haloalkyl group such as a fluoroalkyl group, a cyanoalkyl group, a benzylalkyl group, etc.), an aryl group, a substituted aryl group, a heterocyclic group (for example, a triazolyl group, a thiazolyl group, a benzothiazolyl group, a furyl group, a pyridyl group, a quinaldinyl group, a benzoazolyl group, a pyrimidinyl group, an oxazolyl group, an imidazolyl group, etc.) or a substituted heterocyclic group.

Suitable examples of the substituents for the aryl group include an alkyl group (for example, a methyl group, an ethyl group, etc.), an alkoxy group (for example, a methoxy group, an ethoxy group, etc.), an aryloxy group (for example, a phenoxy group, etc.), an alkoxycarbonyl group (for example, a methoxycarbonyl group, etc.), an acylamino group (for example, an acetylamino group, etc.), a carbamoyl group, an alkylcarbamoyl group (for example, a methylcarbamoyl group, an ethylcarbamoyl group, etc.), a dialkylcarbamoyl group (for example, a dimethylcarbamoyl group, etc.), an arylcarbamoyl group (for example, a phenylcarbamoyl group, etc.), an alkylsulfonyl group (for example, a methysulfonyl group, etc.), an arylsulfonyl group (for example, a phenylsulfonyl group, etc.), an alkylsulfonamido group (for example, a methanesulfonamido group, etc.), an arylsulfonamido group (for example, a phenylsulfonamido group, etc.), a sulfamoyl group, an alkylsulfamoyl group (for example, an ethylsulfamoyl group, etc.), a dialkylsulfamoyl group (for example, a dimethylsulfamoyl group, etc.), an alkylthio group (for example, a methylthio group, etc.), an arylthio group (for example, a phenylthio group, etc.), a cyano group, a nitro group, a halogen atom (for example, a fluorine atom, a chlorine atom, a bromine atom, etc.), and the like. When two or more substituents are present they may be the same or different. Particularly preferred substituents include a halogen atom, an alkyl group, an alkoxy group, an alkoxycarbonyl group and a cyano group.

$R^{20}$ represents an unsubstituted or substituted anilino group, an unsubstituted or substituted acylamino group (for example, an alkylcarbonamido group, a phenylcarbonamido group, an alkoxycarbonamido group, a phenyloxycarbonamido group, etc.), or an unsubstituted or substituted ureido group (for example, an alkylureido group, a phenylureido group, etc.) and examples of the substituents for these groups include a halogen atom (for example, a fluorine atom, a chlorine atom, a bromine atom, etc.), a straight chain or branched chain alkyl group (for example, a methyl group, a tert-butyl group, an octyl group, a tetradecyl group, etc.), an alkoxy group (for example, a methoxy group, an ethoxy group, a 2-ethylhexyloxy group, a tetradecyloxy group, etc.), an acylamino group (for example, an acetamido group, a benzamido group, a butanamido group, a octanamido group, a tetradecanamido group, an α-(2,4-di-tert-amylphenoxy) acetamido group, an α-(2,4-di-tert-amylphenoxy) butylamido group, an α-(3-pentadecylphenoxy) hexanamido group, an α-(4-hydroxy-3-tert-butylphenoxy) tetradecanamido group, a 2-oxopyrrolidin-1-yl group, a 2-oxo-5-tetradecylpyrrolidin-l-yl group, an N-methyl-tetradecanamido group, etc.), a sulfonamido group (for example, a methanesulfonamido group, a benzenesulfonamido group, an ethylsulfonamido group, a p-toluenesulfonamido group, an octanesulfonamido group, a p-dodecylbenzenesulfonamido group, an N-methyltetradecanesulfonamido group, etc.), a sulfamoyl group (for example, a sulfamoyl group, an N-methylsulfamoyl group, an N-ethylsulfamoyl group, an N,N-dimethylsulfamoyl group, an N,N-dihexylsulfamoyl group, an N-hexadecylsulfamoyl group, an N-[3-(dodecyloxy)propyl]-sulfamoyl group, an N-[4-(2,4-di-tert-amylphenoxy)butyl]-sulfamoyl group, an N-methyl-N-tetradecylsulfamoyl group, etc.), a carbamoyl group (for example, an N-methylcarbamoyl group, an N-butylcarbamoyl group, an N-octadecylcarbamoyl group, an N-[4-(2,4-di-tert-amylphenoxy)butyl]carbamoyl group, an N-methyl-N-tetradecylcarbamoyl group, etc.), a diacylamino group (for example, an N-succinimido group, an N-phthalimido group, a 2,5-dioxo-1-oxazolidinyl group, a 3-dodecyl-2,5-dioxo-l-hydantoinyl group, a 3-(N-acetyl-N-dodecylamino)succinimido group, etc.), an alkoxycarbonyl group (for example, a methoxycarbonyl group, a tetradecyloxycarbonyl group, a benzyloxycarbonyl group, etc.), an alkoxysulfonyl group (for example, a methoxysulfonyl group, a butoxysulfonyl group, an ocytloxysulfonyl group, a tetradecyloxysulfonyl group, etc.), an aryloxysulfonyl group (for example, a phenoxysulfonyl group, a p-methylphenoxysulfonyl group, a 2,4-di tert-amylphenoxysulfonyl group, etc.), an alkanesulfonyl group (for example, a methanesulfonyl group, an ethanesulfonyl group, an octanesulfonyl group, a 2-ethylhexylsulfonyl group, a hexadecanesulfonyl group, etc.), an arylsulfonyl group (for example, a benzenesulfonyl group, a 4-nonylbenzenesulfonyl group, etc.), an alkylthio group (for example, a methylthio group, an ethylthio group, a hexylthio group, a benzylthio group, a tetradecylthio group, a 2-(2,4-di-tert-amylphenoxy)ethylthio group, etc.), an arylthio group (for example, a phenylthio group, a p-tolylthio group, etc.), an alkyloxycarbonylamino group (for example, a methoxycarbonylamino group, an ethyloxycarbonylamino group, a benzyloxycarbonylamino group, a hexadecyloxycarbonylamino group, etc.), an alkylureido group (for example, an N-methylureido group, an N,N-dimethylureido group, an N-methyl-N-dodecylureido group, an N-hexadecylureido group, an N,N-dioctadecylureido group, etc.), an acyl group (for example, an acetyl group, a benzoyl group, an octadecanoyl group, a p-dodecanamidobenzoyl group, etc.), a nitro group, a carboxy group, a sulfo group, a hydroxy group or a trichloromethyl group, etc. In the above-described substituents, the alkyl moieties thereof preferably have from 1 to 36 carbon atoms, and the aryl moieties thereof preferably have from 6 to 38 carbon atoms.

$R^{21}$, $R^{22}$, $R^{23}$, $R^{24}$, $R^{25}$, $R^{26}$, $R^{27}$, $R^{28}$, $R^{29}$, $R^{30}$, $R^{31}$ and $R^{32}$ each represents a hydrogen atom, a hydroxy group, an unsubstituted or substituted alkyl group (preferably having from 1 to 20 carbon atoms, and including, for example, a methyl group, a propyl group, a tert-butyl group, a trifluoromethyl group, a tridecyl group, etc.), a substituted or unsubstituted aryl group (preferably having from 6 to 20 carbon atoms, and including, for example, a phenyl group, a 4-tert-butylphenyl group, a 2,4-di-tert-amylphenyl group, a 4-methoxyphenyl group, etc.), a substituted or unsubstituted alkoxy group (preferably having from 1 to 20 carbon atoms, and including, for example, a methoxy group, an ethoxy group, a butoxy group, etc.), a substituted or unsubstituted aryloxy group (preferably having from 6 to 20 carbon atoms, and including for example, a phenoxy group, a naphthoxy group, etc.), a substituted or unsubstituted heterocyclic group (for example, a 2-furyl group, a 2-thienyl group, a 2-pyrimidinyl group, a 2-benzothiazolyl group, etc.), a substituted or unsubstituted alkylamino group (preferably having from 1 to 20 carbon atoms, and including, for example, a methylamino group, a diethylamino group, a tert-butylamino group, etc.), a substituted or unsubstituted acylamino group (preferably having from 2 to 20 carbon atoms, and including, for example, an acetylamino group, a propylamido group, a benzamido group, etc.), a substituted or unsubstituted anilino group (for example, a phenylamino group, a 2-chloroanilino group, etc.), a substituted or unsubstituted alkoxycarbonyl group (preferably having from 2 to 20 carbon atoms, and including, for example, a methoxycarbonyl group, a butoxycarbonyl group, 2-ethylhexyloxycarbonyl group, etc.), a substituted or unsubstituted alkylcarbonyl group (preferably having from 2 to 20 carbon atoms, and including, for example, an acetyl group, a butylcarbonyl group, a cyclohexylcarbonyl group, etc.), a substituted or unsubstituted arylcarbonyl group (preferably having from 7 to 20 carbon atoms, and including, for example, a benzoyl group, a 4-tert-butylbenzoyl group, etc.), a substituted or unsubstituted alkylthio group (preferably having from 1 to 20 carbon atoms, and including, for example, a methylthio group, an octylthio group, a 2-phenoxyethylthio group, etc.), a substituted or unsubstituted arylthio group (preferably having from 6 to 20 carbon atoms, and including, for example, a phenylthio group, a 2-butoxy-5-tert-octylphenylthio group, etc.), a substituted or unsubstituted carbamoyl group (preferably having from 1 to 20 carbon atoms, and including, for example, an N-ethylcarbamoyl group, an N,N-dibutylcarbamoyl group, an N-methyl-N-butylcarbamoyl group, etc.), a substituted or unsubstituted sulfamoyl group (preferably having up to 20 carbon atoms, and including, for example, an N-ethylsulfamoyl group, an N,N-diethylsulfamoyl group, an N,N-dipropylsulfamoyl group, etc.), or a substituted or unsubstituted sulfonamido group (preferably having from 1 to 20 carbon atoms, and including, for example, a methanesulfonamido group, a benzenesulfonamido group, a p-toluenesulfonamido group, etc.).

$Z^2$ represents a hydrogen atom or a group capable of being released upon a coupling reaction with an oxidation product of an aromatic primary amine developing agent. Suitable examples of the group capable of being released include a halogen atom (for example, a chlorine atom, a bromine atom, etc.), a coupling releasing group connected through an oxygen atom (for example, an acetoxy group, a propanoyloxy group, a benzoyloxy group, an ethoxyoxaloyloxy group, a pyruvinyloxy group, a cinnamoyloxy group, a phenoxy group, a 4-cyanophenoxy group, a 4-methanesulfonamidophenoxy group, an α-naphthoxy group, a 4-cyanophenoxy group, a 4-methanesulfonamidophenoxy group, a α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.), a coupling releasing group connected through a nitrogen atom (for example, those as described in Japanese Patent Application (OPI) No. 99437/84, more specifically , a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3oxazolidinyl group, 1-benzyl-5-ethoxy-3-hydantoinyl group, a 2-oxo-l,2-dihydro-1-pyridinyl group, an imidazolyl group, a pyrazolyl group, a 3,5-diethyl-l,2,4-triazol-1-yl group, a 5- or 6-bromobenzotriazol-l-yl group, a 5-methyl-1,2,3,4-tetrazol-l-yl group, a benzimidazolyl group, etc.) or a coupling releasing group connected through a sulfur atom (for example, a phenylthio group, a 2-methoxy-5-octylphenylthio group, a 4-methanesulfonylphenylthio group, a 4-octanesulfonamidophenylthio group, a benzylthio group, a 2-cyanoethylthio group, a 5-phenyl-2,3,4,5-tetrazolylthio group, a 2-benzothiazolyl group, etc.). Of these coupling releasing groups, a halogen atom, a phenoxy group and a coupling releasing group connected through a nitrogen atom are preferred. A halogen atom, a phenoxy group, a pyrazolyl group, an imidazolyl group and triazolyl group are particularly preferred.

As a yellow -dye- forming coupler moiety, an acylacetanilide type moiety, particularly a pivaloyl acetanilide type moiety represented by formula (XIV) described below and a benzoyl acetanilide type moiety represented by formula (XV) or (XVI) described below are preferred.

Formulae (XIV), (XV), and (XVI) are represented by (XIV-a)

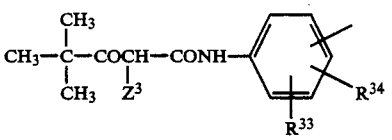

(XIV-b)

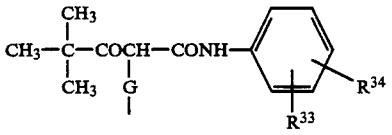

(XV)

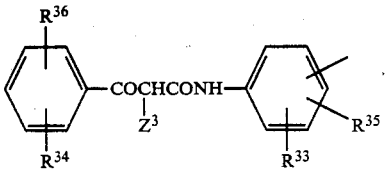

-continued (XVI-a)

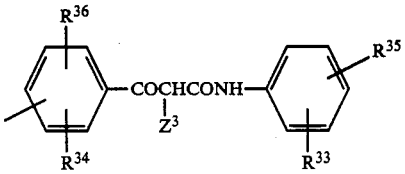

(XVI-b)

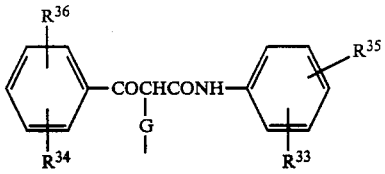

wherein $R^{33}$, $R^{34}$, $R^{35}$ and R36 each represents a hydrogen atom or a substituent which is known as a substituent for a yellow -dye- forming coupler moiety, including, for example, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, a sulfo group, a nitro group, a cyano group, a thiocyano group, etc. These substituents may be the same or different.

The free bonds in the above-described formulae are connected to the polymer chain through a linking group included in D, E, or F.

$Z^3$ represents a hydrogen atom or a group represented by formula (XVII), (XVIII), XIX), or (XX):

(XVII)

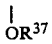

wherein $R^{37}$ represents an unsubstituted or substituted aryl group or heterocyclic group;

(XVIII)

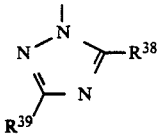

(XIX)

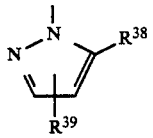

wherein $R^{38}$ and $R^{39}$ (which may be the same or different) each represents a hydrogen atom, a halogen atom, a carboxylic acid ester group, an amino group, an alkyl group, an alkylthio group, an alkoxy group, an alkylsulfonyl group, an alkylsulfinyl group, a carboxylic acid group, a sulfonic acid group, or an unsubstituted or substituted phenyl or heterocyclic group;

(XX)

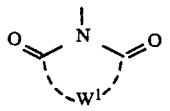

wherein $W^1$ represents non-metallic atoms forming a 4-membered or 5-membered ring together with

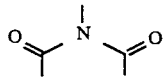

formula (XX).

Of the groups represented by formula (XX), preferred are those represented by formulae (XXI) to (XXI)

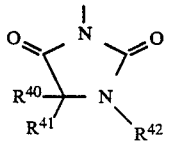

(XXII)

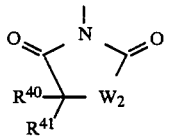

(XXIII)

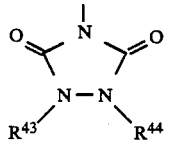

wherein $R^{40}$ and $R^{41}$ each represents a hydrogen atom, an alkyl group, an aryl group, an alkoxy group, an aryloxy group, or a hydroxyl group; $R^{42}$, $R^{43}$, and $R^{44}$ each represents a hydrogen atom, an alkyl group, an aryl group, an aralkyl group, or an acyl group; and $W_2$ represents an oxygen atom or a sulfur atom.

G is a group capable of being released upon a coupling reaction with an oxidation product of a color developing agent and is represented by the following general formula (XXXIV) or (XXV):

(XXIV)

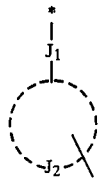

(XXV)

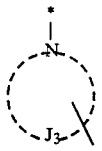

wherein * denotes a position at which the group is connected to the active position of the coupler; $J_1$ represents an oxygen atom or a sulfur atom; $J_2$ represents a non-metallic atomic group necessary to form an aryl ring or a heterocyclic ring; and $J_3$ represents a non-metallic atomic group necessary to form a 5-membered or 6-membered heterocyclic ring together with the nitrogen atom. The above-described ring may be further condensed with an aryl ring or a heterocyclic ring.

Suitable examples of G represented by the general formula (XXIV) include a divalent group derived from, for example, an aryloxy group, an oxazolyloxy group, a chroman-4-oxy group, a tetrazolyloxy group, an arylthio group, etc.

Suitable examples of G represented by the general formula (XXV) include a divalent group derived from, for example, an urazole group, a hydantoin group, a tetrazolone group, a triazole group, a diazole group, a succinic acid imido group, a saccharine group, a pyridone group, a pyridazone group, an oxazolidinedione group, a thiazolidinedione group, etc. A divalent group derived from an aryloxy group, an urazole group, a hydantoin group, a tetrazolone group or a pyrazole group are preferred.

G represented by the general formula (XXIV) or (XXV) may further have a substituent. Suitable examples of the substituents include an alkyl group, an aryl group, an aralkyl group, a halogen atom, an alkoxy group, a hydroxy group, a nitro group, an amino group, a carboxylic acid ester group, a carboxylic acid group and a sulfonic acid group, etc.

Representative examples of the monomeric coupler which provides the repeating unit (coupler unit) represented by formula (I) used in the present invention are set forth below, but the present invention is not to be construed as being limited thereto.

MC-1

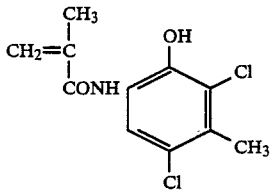

MC-2

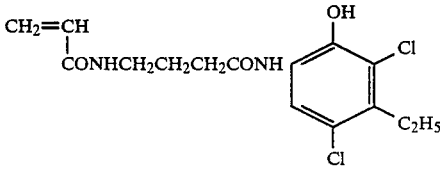

-continued
MC-3
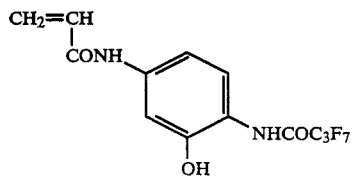
MC-4
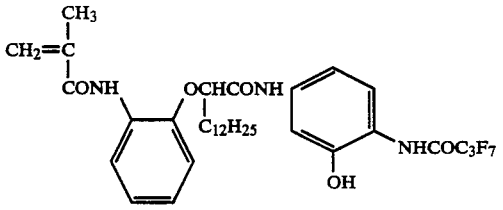
MC-5
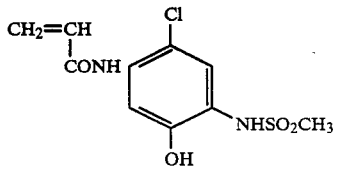
MC-6
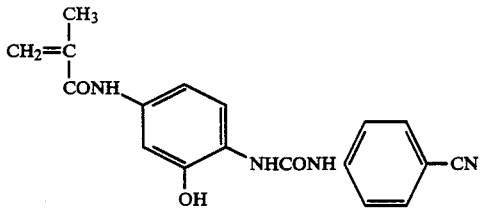
MC-7
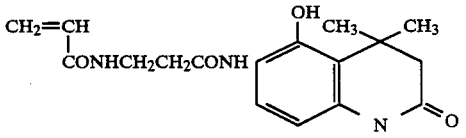
MC-8
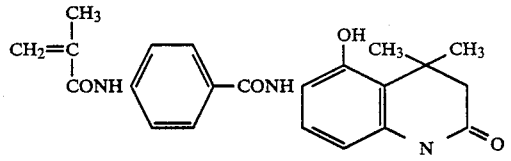
MC-9
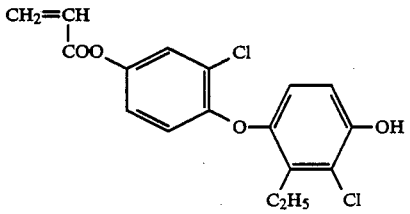
MC-10
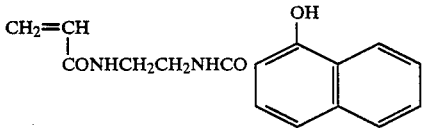

-continued
MC-11
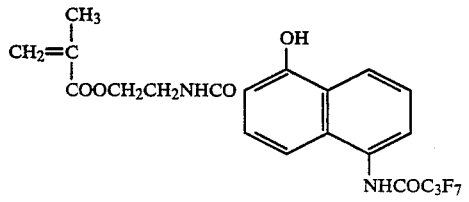
MC-12
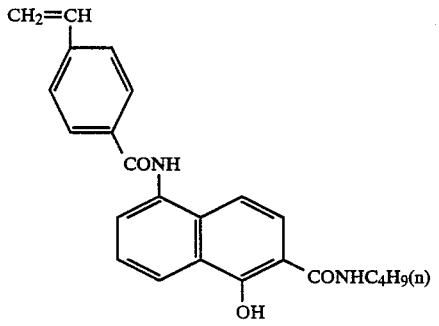
MC-13
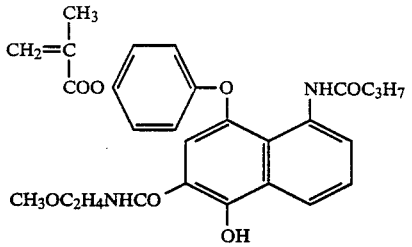
MC-14
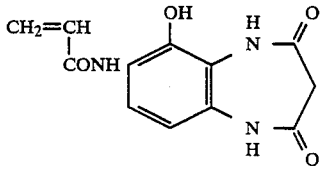
MC-15
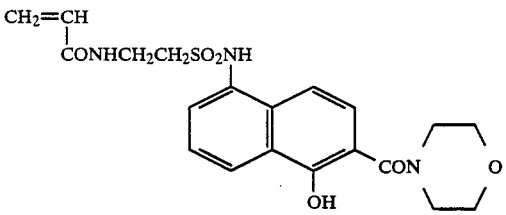
MC-16
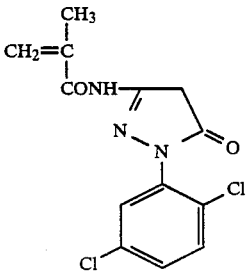

-continued
MC-17
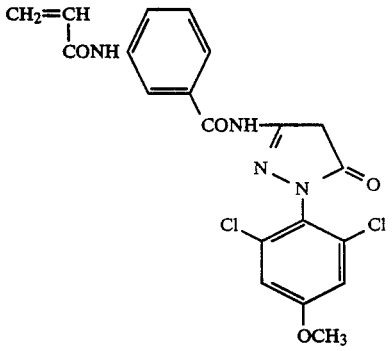
MC-18
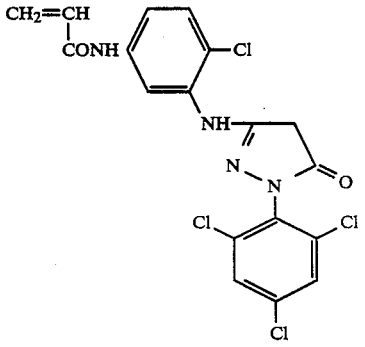
MC-19
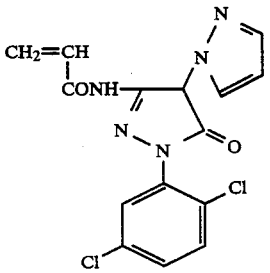
MC-20
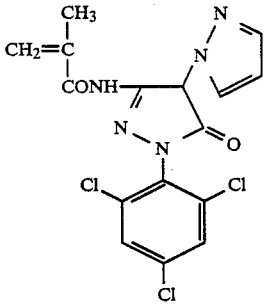
MC-21
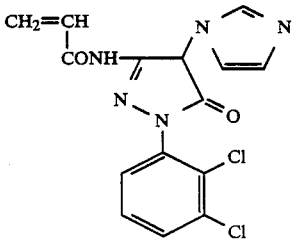

-continued
MC-22
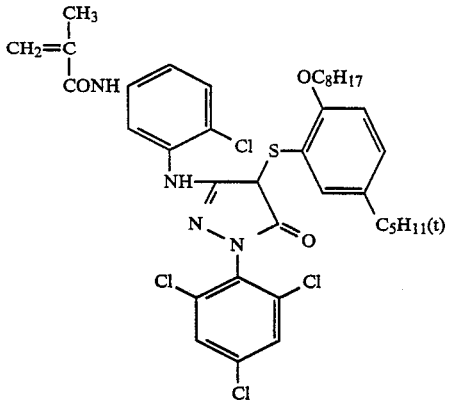
MC-23
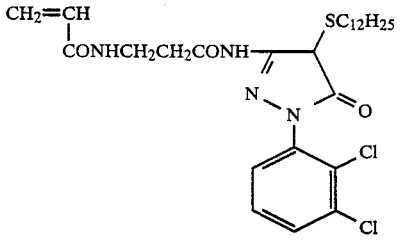
MC-24
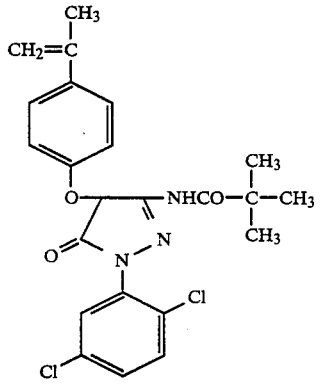
MC-25
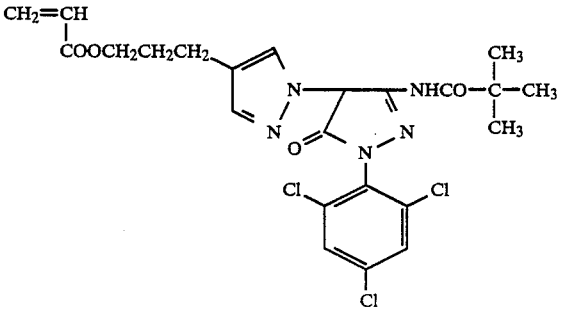

-continued
MC-26
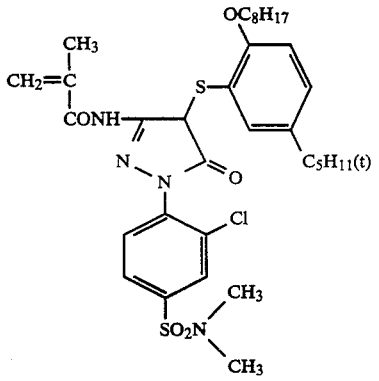
MC-27
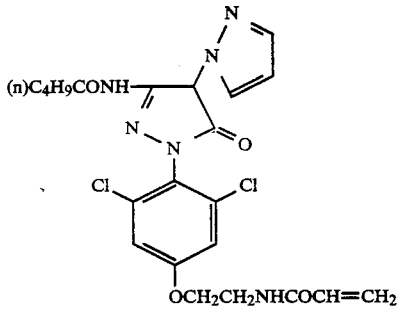
MC-28
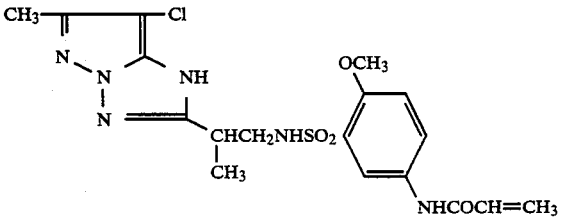
MC-29
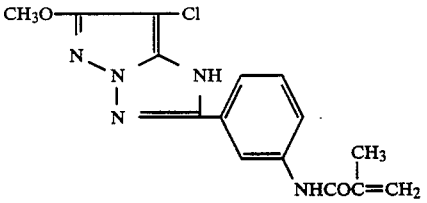
MC-30
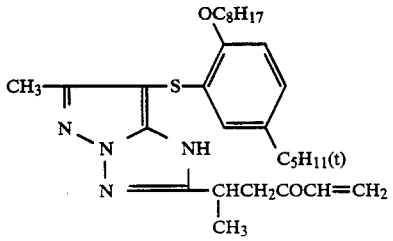

-continued
MC-31
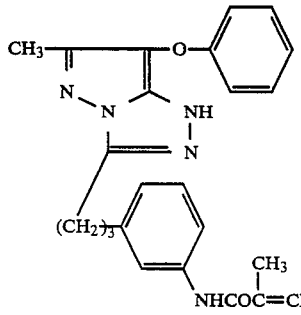
MC-32
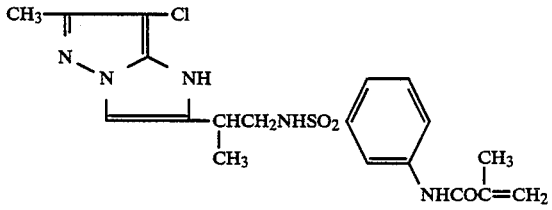
MC-33
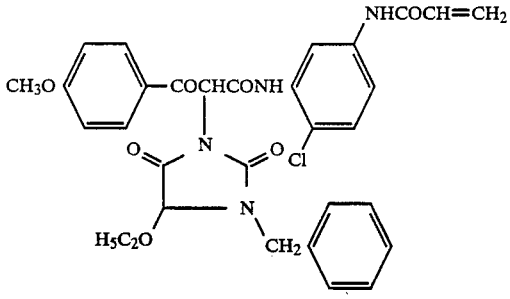
MC-34
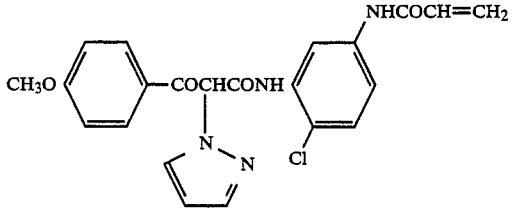
MC-35
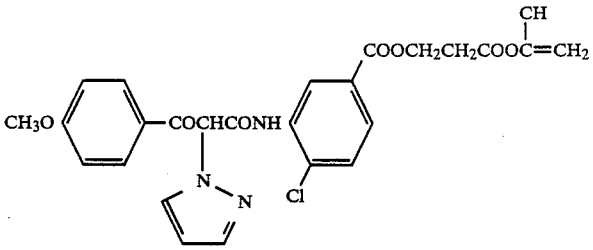
MC-36
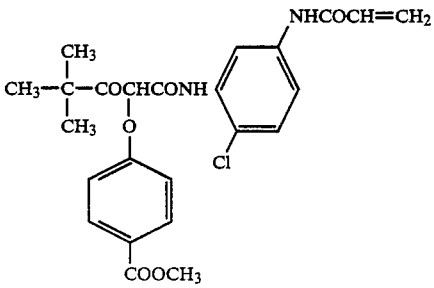

-continued
MC-37
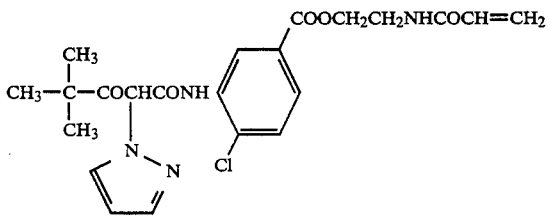
MC-38
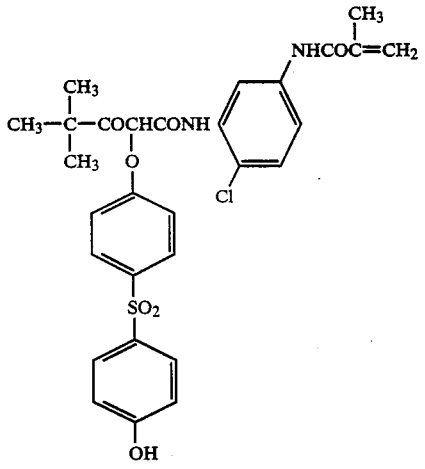
MC-39
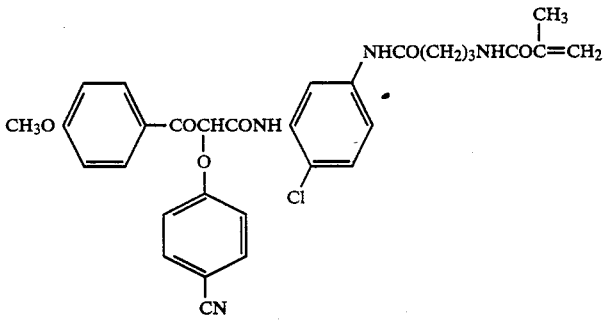
MC-40
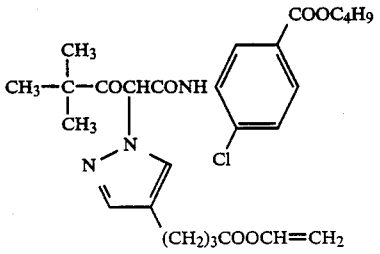

-continued
MC-41
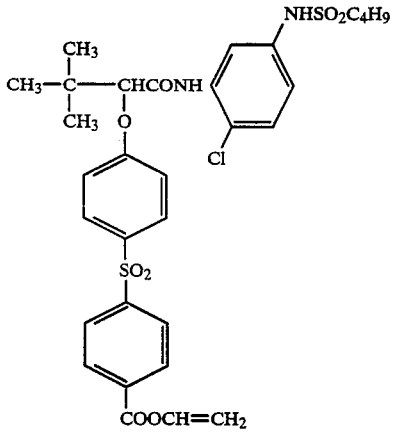
MC-42
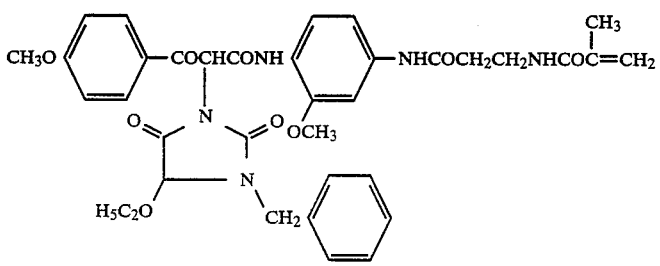
MC-43
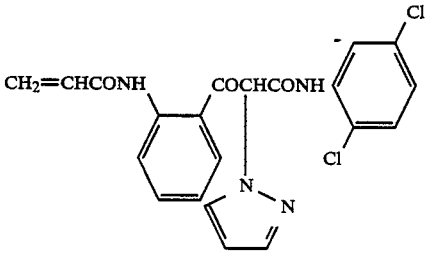
MC-44
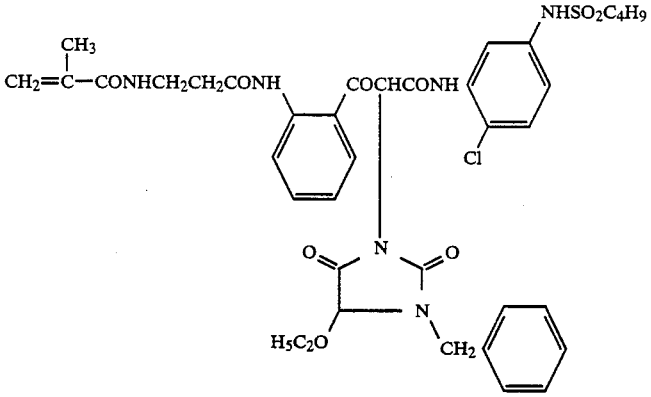
MC-45
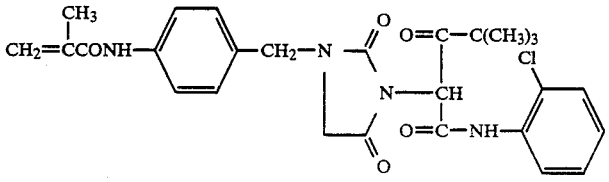

-continued
MC-46
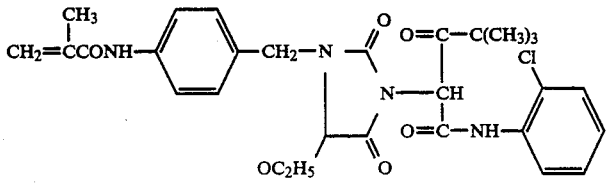
MC-47
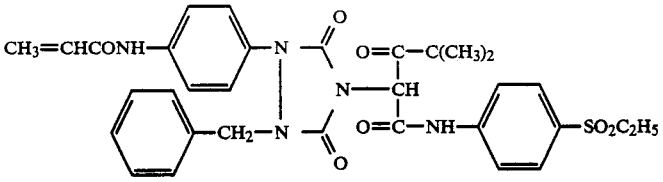
MC-48
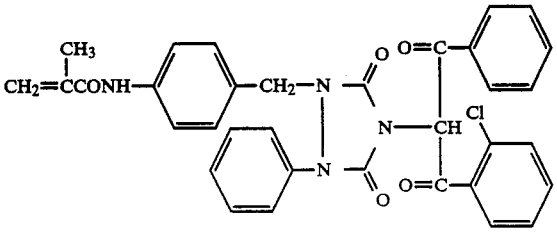
MC-49
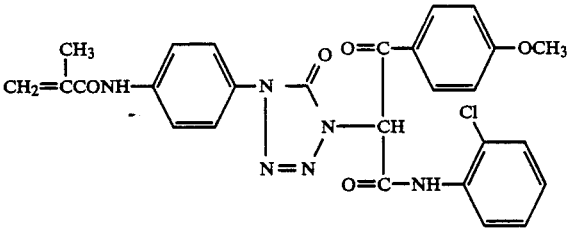
MC-50
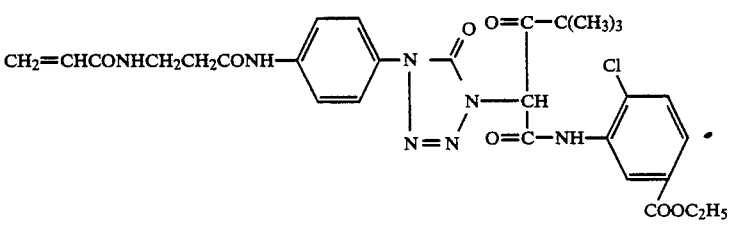
MC-51
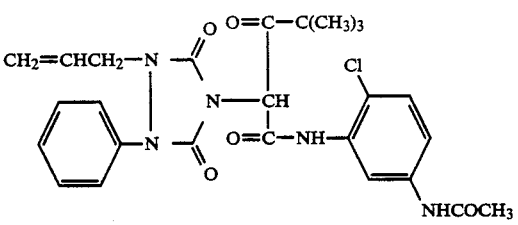
MC-52
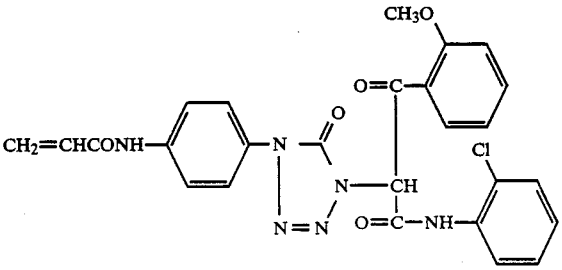

-continued
MC-53
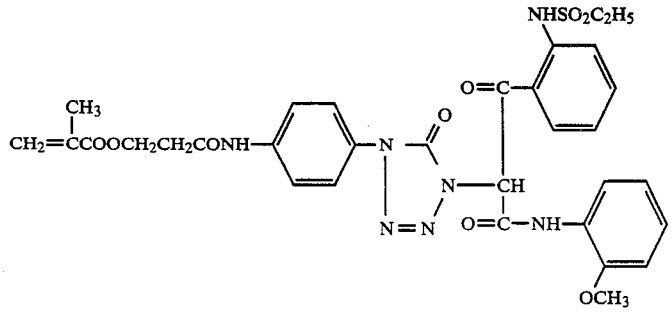
MC-54
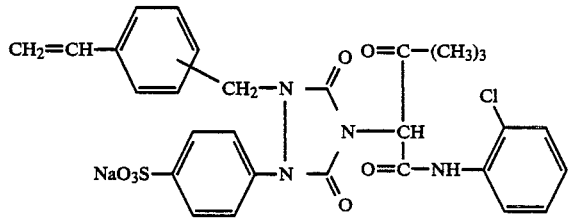
MC-55
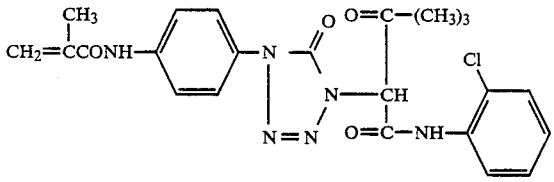
MC-56
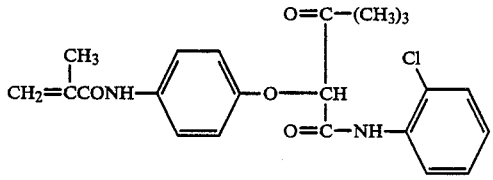
MC-57
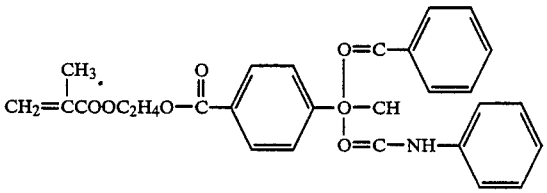
MC-58
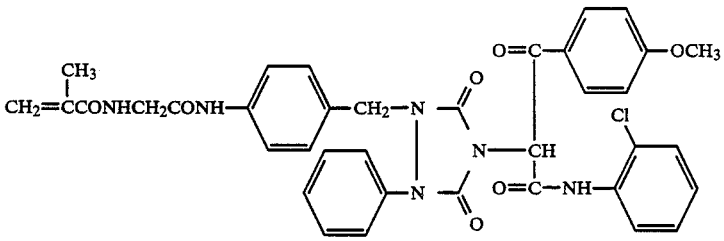
MC-59
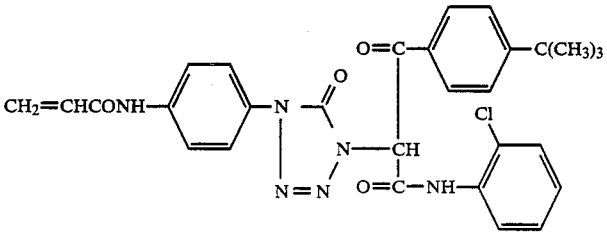

-continued
MC-60
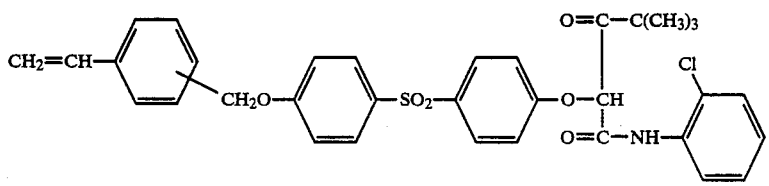
MC-61
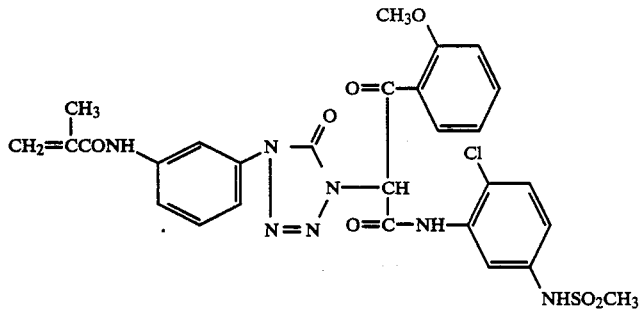
MC-62
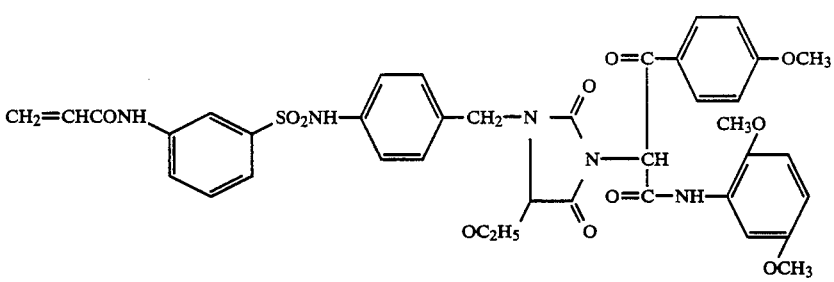
MC-63
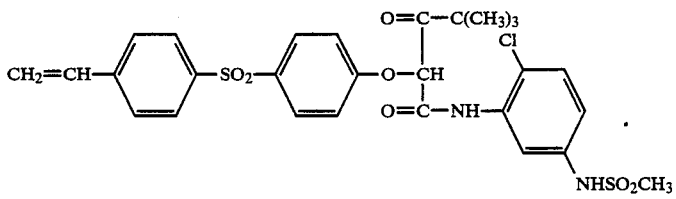
MC-64
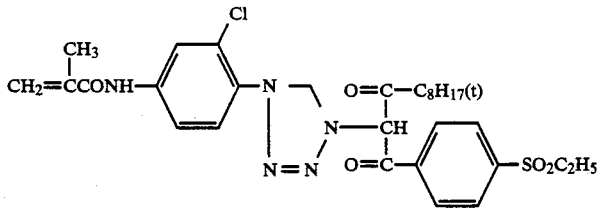
MC-65
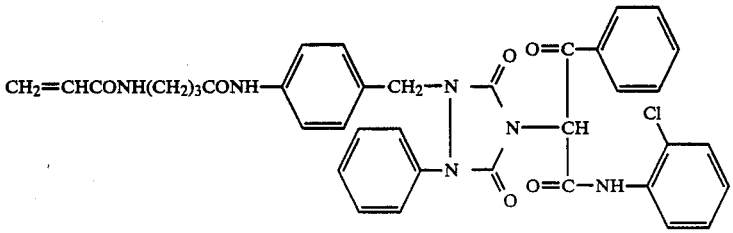

-continued
MC-66
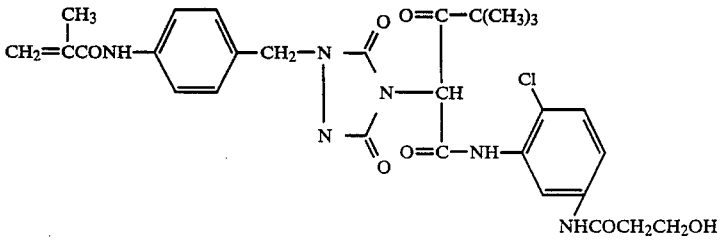
MC-67
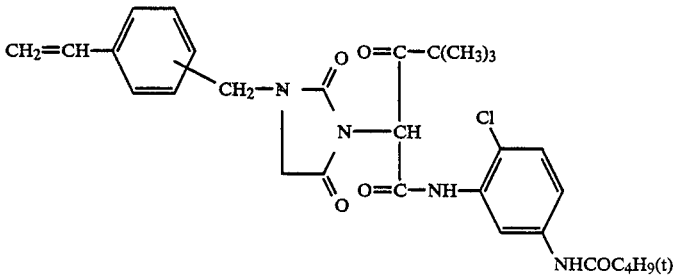
MC-68
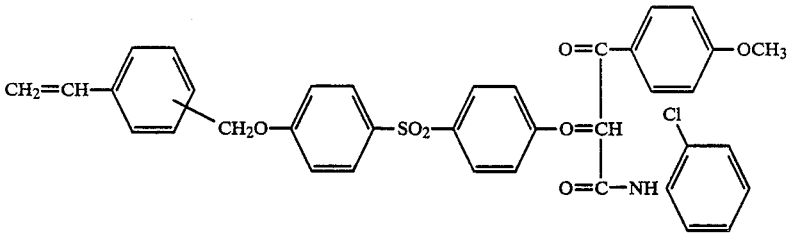
MC-69
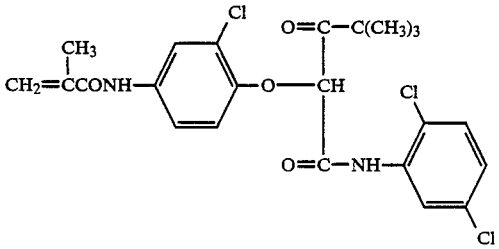
MC-70
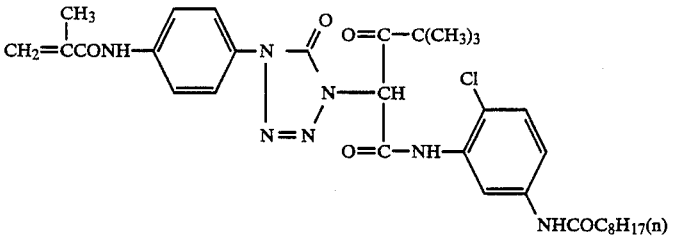
MC-71
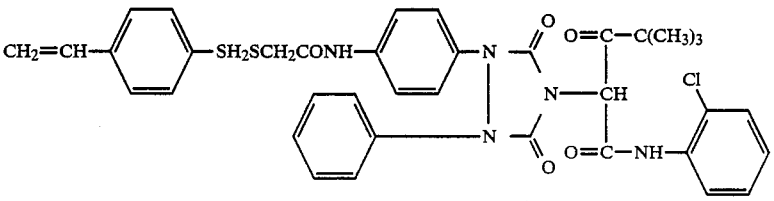

-continued
MC-72
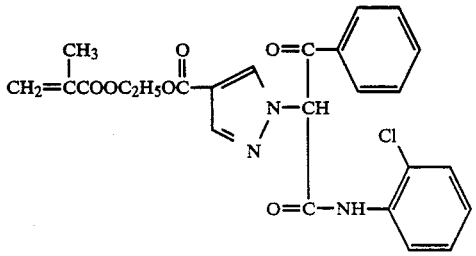
MC-73
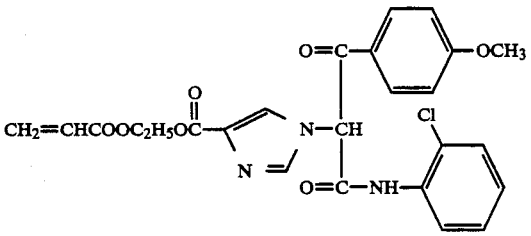
MC-74
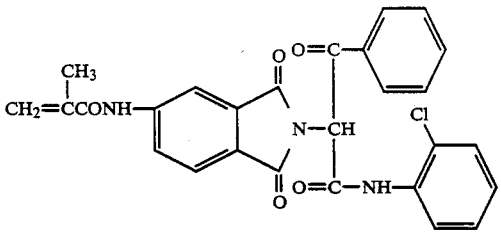
MC-75
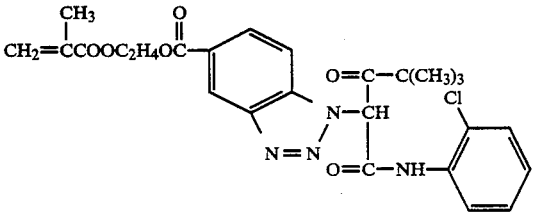
MC-76
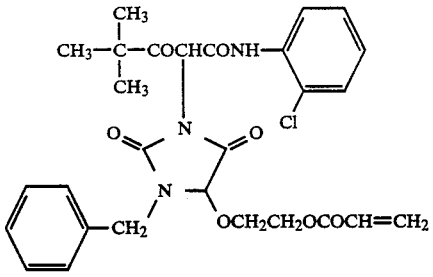
MC-77
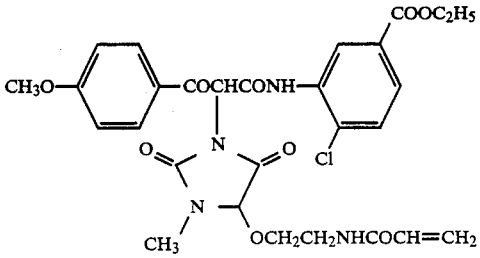

-continued
MC-78
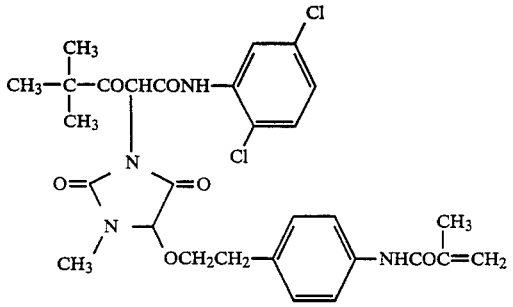
MC-79
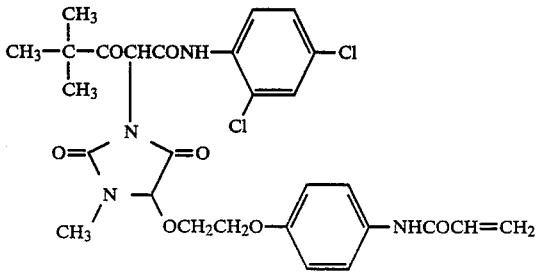
MC-80
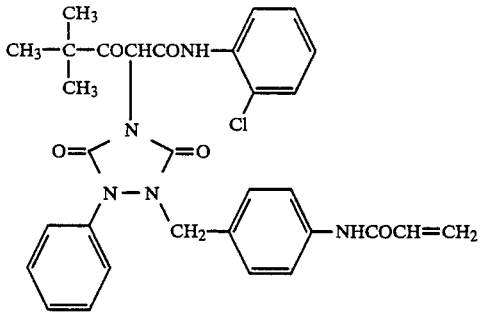
MC-81
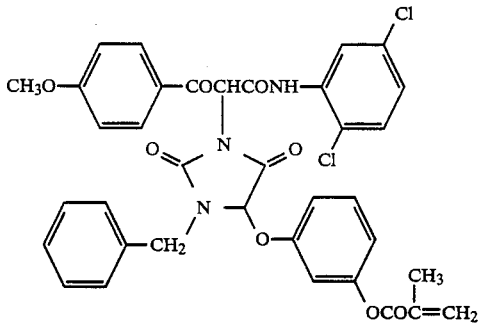
MC-82
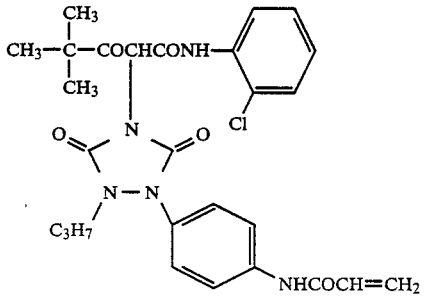

-continued
MC-83
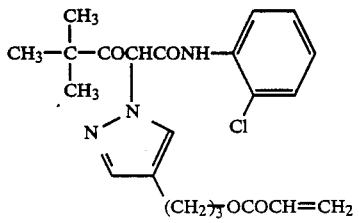
MC-84
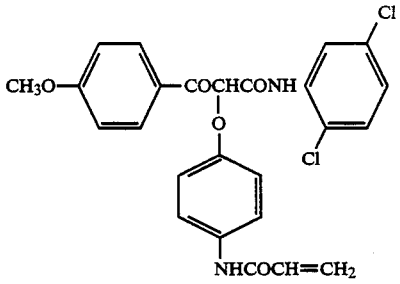
MC-85
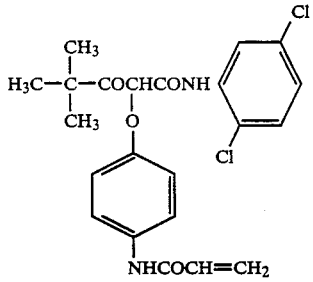
MC-86
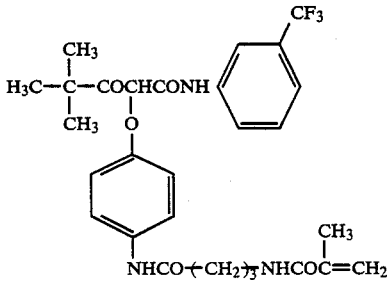
MC-87
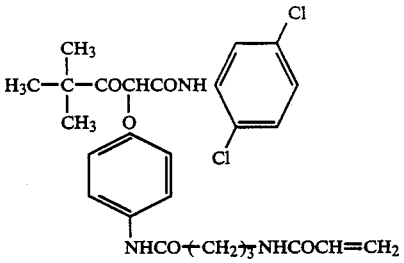
MC-88
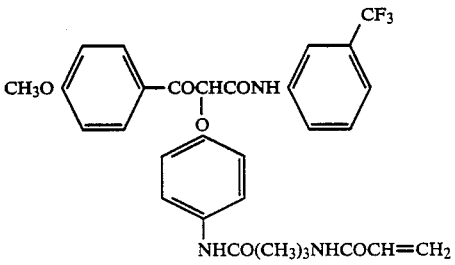

-continued

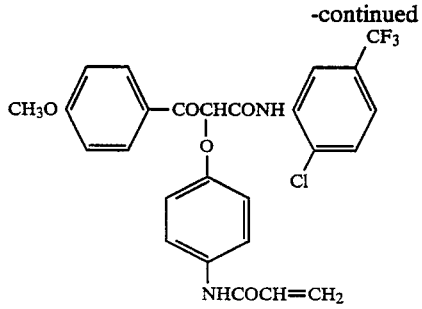

MC-89

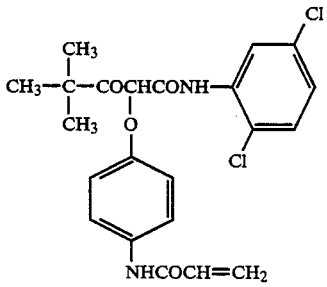

MC-90

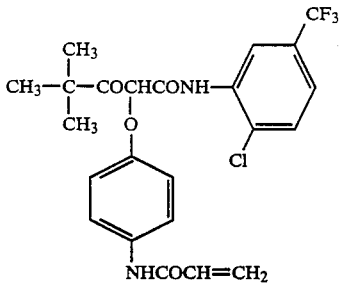

MC-91

In the repeating unit represented by formula (II-A), $R^1$ represents a hydrogen atom, a lower alkyl group having from 1 to 6 carbon atoms (for example, a methyl group, an ethyl group, a butyl group, a n-hexyl group, etc.) or a chlorine atom. A hydrogen atom and a methyl group are particularly preferred.

L represents a divalent linking group having from 1 to 20 carbon atoms and preferably represents a group represented by formula (IIa), (IIb) or (IIc)

$$-J- \quad \text{(IIa)}$$

$$-\underset{\underset{O}{\|}}{C}-K-Z- \quad \text{(IIb)}$$

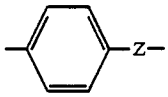

(IIc)

wherein J represents an alkylene group having from 1 to 10 carbon atoms (for example, a methylene group, an ethylene group, a propylene group, etc.) or an arylene group having from 6 to 12 carbon atoms; K represents —O—, —NH— or $$-\overset{\overset{R_4}{|}}{N}-;$$

Z represents a group selected from the groups defined for J, or a divalent group containing at least one amido bond, ester bond, ether bond and thioether bond and J groups at both ends (for example, $-CH_2CH_2-$, $-CH_2CH_2CH_2CH_2CH_2-$, $-CH_2CONHCH_2-$, $-CH_2CONHCH_2CONHCH_2-$, $-CH_2CH_2OCOCH_2CH_2-$, $-CH_2NHCOCH_2CH_2SCH_2-$, etc.); and $R_4$ represents a hydrogen atom or an alkyl group having from 1 to 6 carbon atoms.

Specific examples of L include $-CONHCH_2-$, $-CONHCH_2CH_2-$, $-CONHCH_2CH_2CH_2-$, $-CONHCH_2CH_2CH_2CH_2CH_2-$, $-CO_2CH_2CH_2OCOCH_2CH_2-$, $-CONHCH_2CONHCH_2-$, $-CONHCH_2CONHCH_2CONHCH_2-$, $-COOCH_2-$, $-CONHCH_2NHCOCH_2CH_2SCH_2CH_2-$, $-CONHCH_2OCOCH_2CH_2-$, etc.

In the repeating unit represented by formula (II-A), L need not be present (i.e., k can be o).

X in formula (II-A) represents an active ester group (i.e., active in reaction with gelatin), more specifically a carboxylic acid ester of phenol, an alcohol or a hydroxylsuccinimide derivative preferably having pKa of 5 to 13, and including the following groups:

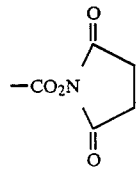

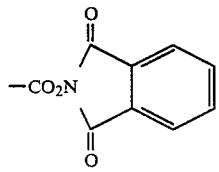

-continued

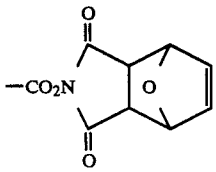

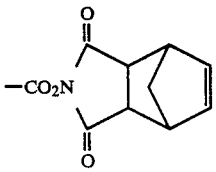

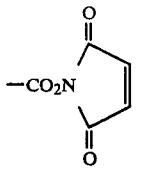

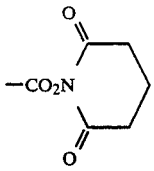

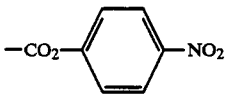

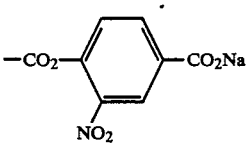

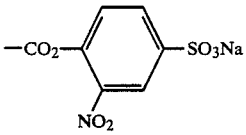

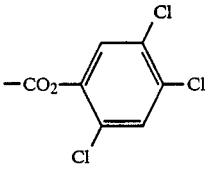

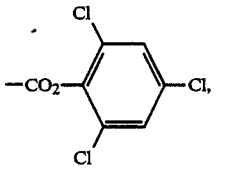

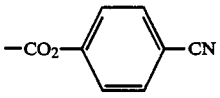

$-CO_2CH_2CN$, $-CO_2CH_2CO_2C_2H_5$, $-CO_2CH_2CONH_2$, $-CO_2CH_2COCH_3$,

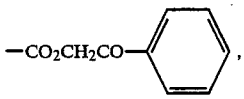

$-CO_2CH_2CO_2CH{=}CH_2$, $-CO_2N{=}CHCH_3$, $-CO_2N{=}C(CH_3)_2$, $-CO_2C(CH_3){=}CHCOCH_3$,

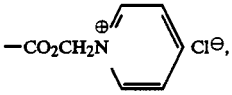

$-CO_2CH_2CH_2Br$, $-CO_2CH_2CH_2CN$, $-CO_2CH_2CH_2\overset{\oplus}{N}(CH_3)_2CH_3Cl^{\ominus}$ X may be appropriately selected depending on a kind of $R^1$, and a kind and property (for example, hydrophilicity, hydrophobicity, rigidity, etc.) of L.

Representative examples of the unsaturated monomer which provide the repeating unit represented by formula (II-A) used in the present invention are set forth below, but the present invention is not to be construed as being limited thereto.

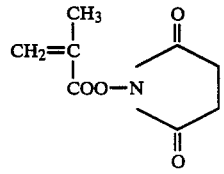

(H-1)

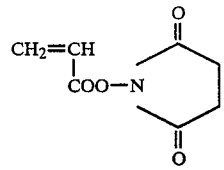

(H-2)

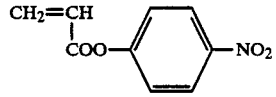

(H-3)

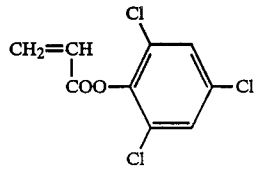

(H-4)

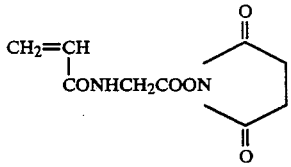

(H-5)

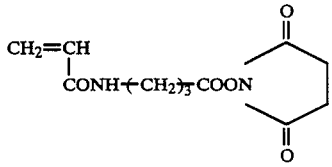

(H-6)

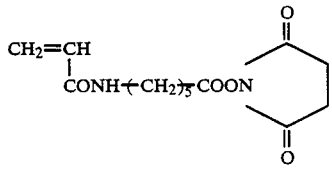

(H-7)

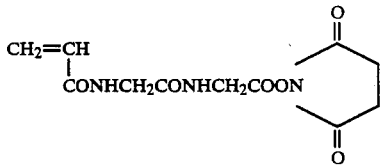

(H-8)

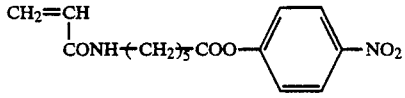

(H-9)

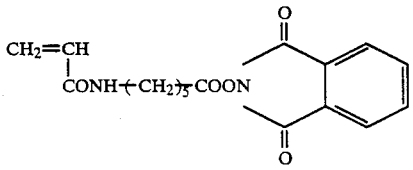

(H-10)

-continued (H-11)

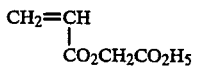

(H-12)

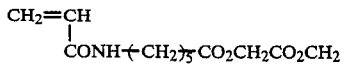

(H-13)

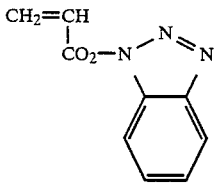

(H-14)

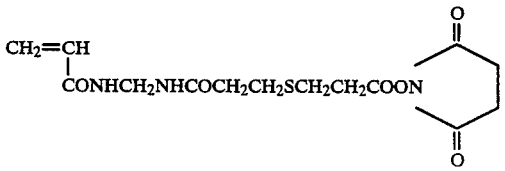

(H-15)

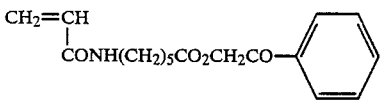

(H-16)

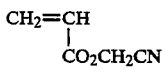

The synthesis of the unsaturated monomer having an active ester group described above and polymerization thereof can be performed according to, for example, Lee method as described in *Biochemistry,* page 1535 (1975), a method as described in *Journal of Polymer Science: Polymer Chemistry Edition,* page 2155 (1976), a method as described in *Die Makromolekule Chemie,* Vol. 177, page 683 (1976), a method as described in *Anqewante Chemie: Internat. Edit.,* page 1103 (1972), and a method as described in *Polymer,* page 462 (1972), etc.

In the repeating unit represented by formula (II-B), (II-C), or (II-D), $R^2$ represents a hydrogen atom, a chlorine atom or a lower alkyl group (for example, an alkyl group having from 1 to 4 carbon atoms and $R^3$ represents an alkylene group (for example, an alkylene group having from 1 to 6 carbon atoms).

(II-1)

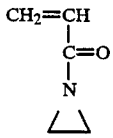

(II-2)

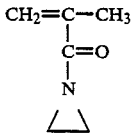

-continued (II-3)

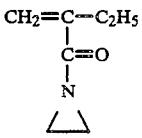

(II-4)

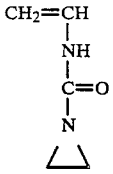

(II-5)

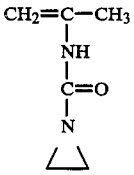

(II-6)

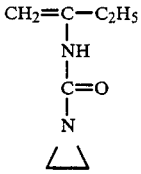

(II-7)

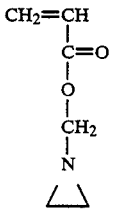

(II-8)

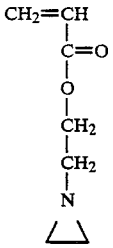

(II-9)

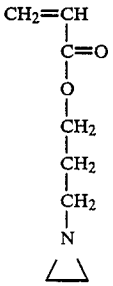

-continued (II-10)

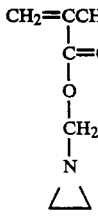

(II-11)

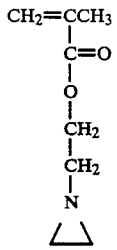

(II-12)

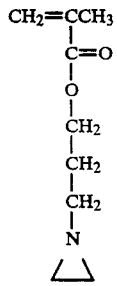

(II-13)

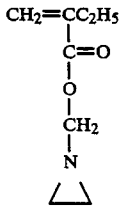

(II-14)

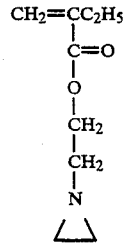

(II-15)

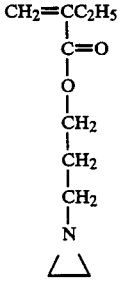

Now, the repeating unit represented by the general formula II-E) will be described in detail below.

(II-E)

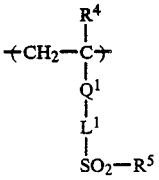

wherein $R^4$ represents a hydrogen atom or a lower alkyl group having from 1 to 6 carbon atoms (for example, a methyl group, an ethyl group, a butyl group, a n-hexyl group, etc.). Of these groups, a hydrogen atom and a methyl group are particularly preferred.

$Q^1$ represents

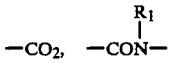

or an arylene group having from 6 to 10 carbon atoms, and includes, for example

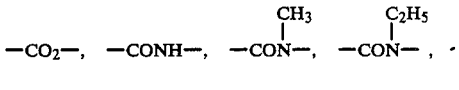

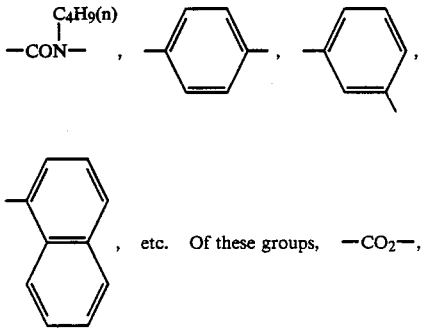

, etc. Of these groups, $-CO_2-$,

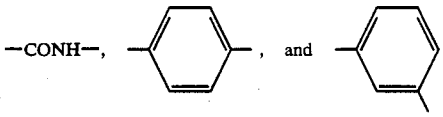

are particularly preferred.

$L^1$ represents a divalent group having from 3 to 15 carbon atoms and containing at lease one (preferably up to (3) bond selected from

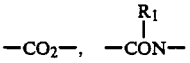

or a divalent group having from 1 to 12 carbon atoms and containing at least one bond selected from

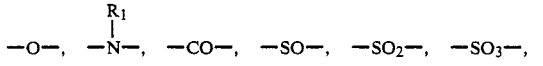

-continued $$-SO_2\overset{R_1}{\overset{|}{N}}-,\quad -\overset{R_1}{\overset{|}{N}}C\overset{R_1}{\overset{|}{O}}N-\quad \text{and}\quad -\overset{R_1}{\overset{|}{N}}CO_2-.$$

$L_1$ may have one or two of alkylene groups, arylene groups, and aralkylene groups. $R^1$ represents a hydrogen atom or a lower alkyl group having from 1 to 6 carbon atoms.

Suitable examples of $L^1$ are set forth below.

$-CH_2CO_2CH_2-$
$-CH_2CO_2CH_2CH_2-$
$-CH_2CH_2CO_2CH_2CH_2-$
$-(CH_2)_3CO_2CH_2CH_2-$
$-(CH_2)_{10}CO_2CH_2CH_2-$
$-CH_2NHCOCH_2-$
$-CH_2NHCOCH_2CH_2-$
$-(CH_2)_3NHCOCH_2CH_2-$
$-(CH_2)_5NHCOCH_2CH_2-$
$-(CH_2)_{10}NHCOCH_2CH_2-$
$-CH_2OCH_2-$
$-CH_2CH_2OCH_2CH_2CH_2-$ $$-\overset{CH_3}{\overset{|}{N}}CH_2CH_2-,\quad -CH_2\overset{CH_3}{\overset{|}{N}}CH_2CH_2-$$

$-COCH_2CH_2-$
$-CH_2COCH_2CH_2-$

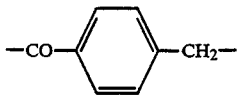

$-SOCH_2CH_2-$
$-CH_2SOCH_2CH_2-$
$-SO_2CH_2CH_2-$
$-SO_2CH_2CH_2SO_2CH_2CH_2-$ $$-SO_2CH_2CH_2SO_2CH_2\underset{\underset{OH}{|}}{C}HCH_2-$$

$-SO_3CH_2CH_2CH_2-$
$-SO_3CH_2CO_2CH_2CH_2-$
$-SO_3CH_2CH_2CO_2CH_2CH_2-$
$-SO_2NHCH_2CO_2CH_2CH_2-$
$-SO_2NHCH_2CH_2CO_2CH_2CH_2-$
$-NHCONHCH_2CH_2-$
$-CH_2NHCONHCH_2CH_2-$
$-NHCO_2CH_2CH_2-$
$-CH_2NHCO_2CH_2CH_2-$ $L^1$ can be appropriately selected depending on the purpose of the present invention, for example, to provide a diffusion-resistant photographic polymer, to render a photographic additive having a nucleophilic group diffusion-resistant, or to employ as a hardening agent, etc.

$R^5$ is a vinyl group or a functional group which is a precursor of a vinyl group, and is represented by $-CH=CH_2$ or $-CH_2CH_2X_1$, wherein $X_1$ represents a group capable of being substituted with a nucleophilic group (such as $-NH_2$ of gelatin) or a group capable of being released by a base in the form of HX.

Suitable examples of R5 are set forth below.

$-CH=CH_2$, $-CH_2CH_2Cl$, $-CH_2CH_2Br$,

-continued $-CH_2CH_2O_3SCH_3$, $-CH_2CH_2O_3S-$ 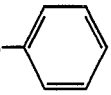 , $-CH_2CH_2O_3S-$ 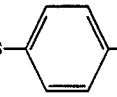 $-CH_3$, $-CH_2CH_2OH$, $-CH_2CH_2O_2CCH_3$, $-CH_2CH_2O_2CCF_3$, $-CH_2CH_2O_2CCHCl_2$ Of these groups $-CH=CH_2$, $-CH_2CH_2Br$, $-CH_2CH_2Cl$ and $-CH_2CH_2O_3S-$ 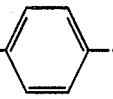 $-CH_3$ are particularly preferred.

The polymer having the repeating unit represented by formula (II-E) according to the present invention wherein R5 is precursor of a vinyl group can be generally obtained by polymerization of a monomer coupler which provides a repeating unit represented by formula (III) described above with an ethylenically unsaturated monomer represented by the general formula (II-E) described below. Further, the polymer having the repeating unit represented by formula (II-E) wherein $R^5$ is a vinyl group can be easily obtained by treating a polymer having a precursor of a vinyl group as R5 with a base such as triethylamine, pyridine, etc.

$$CH_2=\overset{R^4}{\overset{|}{C}}-Q^1-L^1-SO_2-R^5 \qquad \text{(II-E)'}$$

wherein $R^4$, $Q^1$, $L^1$ and $R^5$ each has the same meaning as defined above.

Of the ethylenically unsaturated monomers represented by formula (II-E)[40 , those preferred are set forth below.

$$CH_2=\underset{\underset{CO_2CH_2CH_2OCOCH_2CH_2SO_2CH_2CH_2Cl}{|}}{CH} \qquad \text{(H-1)}$$

$$CH_2=\underset{\underset{CONHCH_2CH_2CH_2NHCOCH_2CH_2SO_2CH_2CH_2Cl}{|}}{CH} \qquad \text{(H-2)}$$

$$CH_2=\underset{\underset{CO_2CH_2CH_2OCH_2CH_2SO_2CH_2CH_2Br}{|}}{CH} \qquad \text{(H-3)}$$

-continued (H-4)

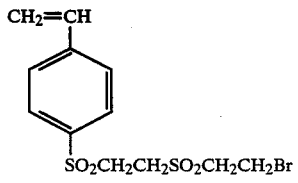

(H-5)

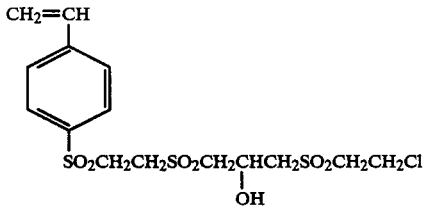

(H-6)

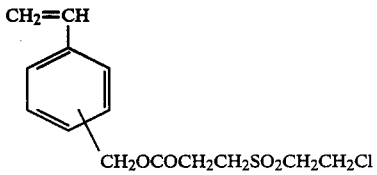

(H-7)

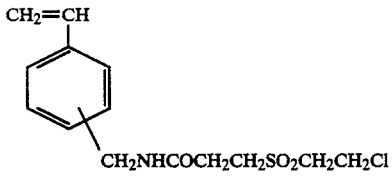

(H-8)

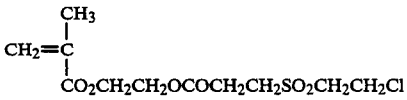

(H-9)

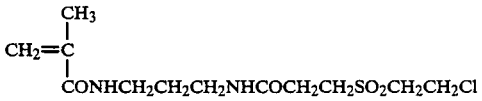

(H-10)

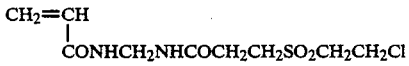

(H-11)

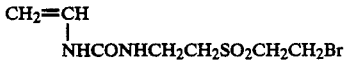

(H-12)

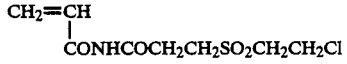

Synthesis methods of these compounds are desiribed in Japanese Patent Publication 22340/85 (U.S. Pat. No. 4,600,687).

Now, the repeating unit represented by the general formula (II-F) will be described in detail below.

(II-F)

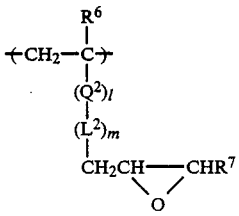

wherein $R^6$ represents a hydrogen atom, a chlorine atom or an alkyl group preferably having from 1 to 6 carbon atoms (for example, a methyl group, an ethyl group, a butyl group, a n-hexyl group, etc.). Of these groups, a hydrogen atom and a methyl group are particularly preferred.

$R^7$ represents a hydrogen atom or an alkyl group preferably having from 1 to 10 carbon atoms (for example a methyl group, a decyl group, etc.).

$Q^2$ represents

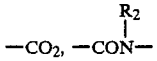

or an arylene group having from 6 to 10 carbon atoms, and includes, for example

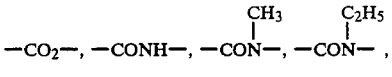

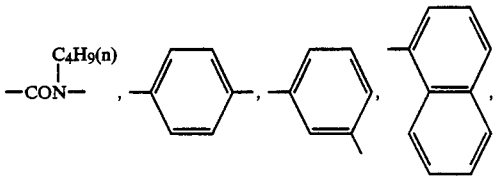

etc. Of these groups, $-CO_2-$, $-CONH-$,

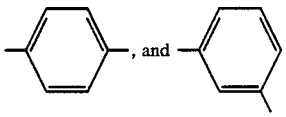

are particularly preferred.

$L^2$ represents a divalent group having from 3 to 15 carbon atoms and containing at least one bond selected from

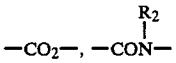

or a divalent group having from 1 to 12 carbon atoms and containing at least one bond selected from

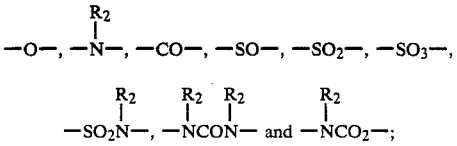

$R^2$ represents a hygrogen atom or a lower alkyl group having from 1 to 6 carbon atoms. L2 may contain one or two of alkylene groups, arylene groups and aralkylene groups.

Suitable examples of $L^2$ are set forth below.

$-CH_2CO_2CH_2-$
$-CH_2CO_2CH_2CH_2-$
$-CH_2CH_2CO_2CH_2CH_2-$
$\text{-}(CH_2)_3CO_2CH_2CH_2-$
$\text{-}(CH_2)_{10}CO_2CH_2CH_2-$
$-CH_2NHCOCH_2-$
$-CH_2NHCOCH_2CH_2-$
$\text{-}(CH_2)_3NHCOCH_2CH_2-$
$\text{-}(CH_2)_5NHCOCH_2CH_2-$
$\text{-}(CH_2)_{10}NHCOCH_2CH_2-$
$-CH_2OCH_2-$
$-CH_2CH_2OCH_2CH_2CH_2-$ $-N(CH_3)CH_2CH_2-$, $-CH_2N(CH_3)CH_2CH_2-$ $-COCH_2CH_2-$
$-CH_2COCH_2CH_2-$

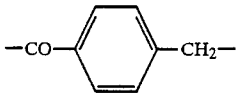

$-SOCH_2CH_2-$
$-CH_2SOCH_2CH_2-$
$-SO_2CH_2CH_2-$
$-SO_2CH_2CH_2SO_2CH_2CH_2-$ $-SO_2CH_2CH_2SO_2CH_2CH(OH)CH_2-$ $-SO_3CH_2CH_2CH_2-$
$-SO_3CH_2CO_2CH_2CH_2-$
$-SO_3CH_2CH_2CO_2CH_2CH_2-$
$-SO_2NHCH_2CH_2CO_2CH_2CH_2-$
$-NHCONHCH_2CH_2-$
$-CH_2NHCONHCH_2CH_2$
$-NHCO_2CH_2CH_2-$
$-CH_2NHCO_2CH_2CH_2-$ $L^2$ can be appropriately selected depending on the purpose of the present invention, for example, to provide a diffusion-resistant photographic polymer, to render a photographic additive having a nucleophilic group diffusion-resistant, or to employ as a hardening agent, etc.

Representative examples of the unsaturated monomer which provides a repeating unit represented by the general formula (II-E) according to the present invention are set forth below, but the present invention should not be construed as being limited thereto.

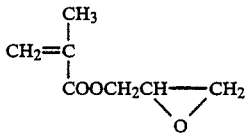

II-1

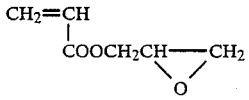

II-2

-continued

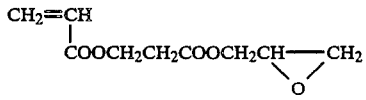

II-3

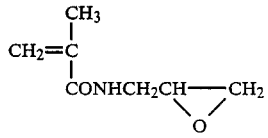

II-4

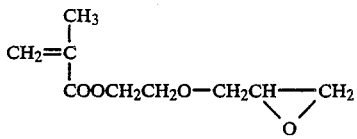

II-5

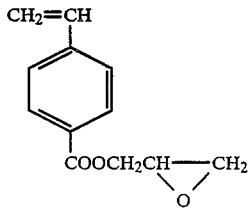

II-6

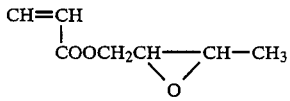

II-7

In accordance with the present invention, it is preferred to introduce a non-color forming ethylenic monomer which does not couple with the oxidation product of an aromatic primary amine developing agent as a copolymerizable monomer in view of solubility and reactivity with a hardener. Suitable examples of the non-color forming ethylenic monomers include acrylic acid, an acrylic acid ester, methacrylic acid, a methacrylic acid ester, crotonic acid, a crotonic acid ester, a vinyl ester, maleic acid, a maleic acid diester, fumaric acid, a fumaric acid diester, itaconic acid, an itaconic acid diester, an acrylamide, a methacrylamide, a vinyl ester, a styrene, etc. The acid moiety included in these monomers may form a salt with an alkali metal (for example, Na, K, etc.) ion or an ammonium ion.

Specific examples of such non-color forming monomers are set forth below. Examples of acrylic acid esters include methyl acrylate, ethyl acrylate, n-propyl acrylate, isopropyl acrylate, n-butyl acrylate, 3-acryloylpropanesulfonic acid, acetoacetoxyethyl acrylate, acetoxyethyl acrylate, phenyl acrylate, 2-methoxyethyl acrylate, 2-ethoxyethyl acrylate, 2-(2-methoxyethoxy)ethyl acrylate, etc. Examples of methacrylic acid esters include methyl methacrylate, ethyl methacrylate, n-propyl methacrylate, n-butyl methacrylate, tert-butyl methacrylate, cyclohexyl methacrylate, 2-hydroxyethyl methacrylate, 2-ethoxyethyl methacrylate, etc. Examples of crotonic acid esters include butyl crotonate, hexyl crotonate, etc. Examples of vinyl esters include vinyl acetate, vinyl propionate, vinyl butyrate, vinyl methoxyacetate, vinyl benzoate, etc. Examples of maleic acid diesters include diethyl maleate, dimethyl maleate, dibutyl maleate, etc. Examples of fumaric acid diesters include diethyl fumarate, dimethyl fumarate, dibutyl fumarate, etc. Examples of itaconic acid diesters include diethyl itaconate, dimethyl itaconate, dibutyl itaconate, etc. Examples of acrylamides include acrylamide, methylacrylamide, ethylacrylamide, isopropylacrylamide, n-butylacrylamide, hydroxymethylacrylamide, diacetoneacrylamide, acryloylmorpholine, acrylamido-2-methylpropanesulfonic acid, etc. Examples of methacrylamides include methylmethacrylamide, ethylmethacrylamide, n-butylmethacrylamide, tert-butylmethacrylamide, 2-methoxymethacrylamide, dimethylmethacrylamide, diethylmethacrylamide, etc. Examples of vinyl ethers include methyl vinyl ether, butyl vinyl ether, hexyl vinyl ether, methoxyethyl vinyl ether, dimethylaminoethyl vinyl ether, etc. Examples of styrenes include styrene, methylstyrene, dimethylstyrene, trimethylstyrene, ethylstyrene, isopropylstyrene, butylstyrene, chloromethylstyrene, methoxystyrene, butoxystyrene, acetoxystyrene, chlorostyrene, dichlorostyrene, bromostyrene, vinyl benzoic acid methyl ester, 2-methyl styrene, styrene sulfonic acid, styrene sulfinic acid, vinyl benzoic acid, etc.

Other examples of the non-color forming ethylenic monomers include an allyl compound (for example, allyl acetate, etc.), a vinyl ketone (for example, methyl vinyl ketone, etc.), a vinyl heterocyclic compound (for example, vinyl pyridine, etc.), a glycidyl ester (for example, glycidyl acrylate, etc.), an unsaturated nitrile (for example, acrylonitrile, etc.), and the like.

Of these non-color forming monomers, those having high hydrophilicity are particularly preferred.

Two or more of these monomers can be used together. For example, a combination of potassium styrenesulfinate and sodium acrylamido-2-methylpropanesulfonate, acetoacetoxyethyl methacrylate and sodium 3-acryloylpropanesulfonate, sodium acrylamido-2-methylpropanesulfonate and sodium acrylate, sodium 3-acryloylpropanesulfonate, butyl acrylate and sodium styrenesulfonate, etc., can be used.

Specific examples of the polymeric couplers which can be used in the present invention are set forth below, but the present invention should not be construed as being limited thereto. The figures attached to the following structural formulae denote molar ratios.

Polymeric Couplers Including the Repeating Unit Represented by Formula (II-A)

$Y_1$-1

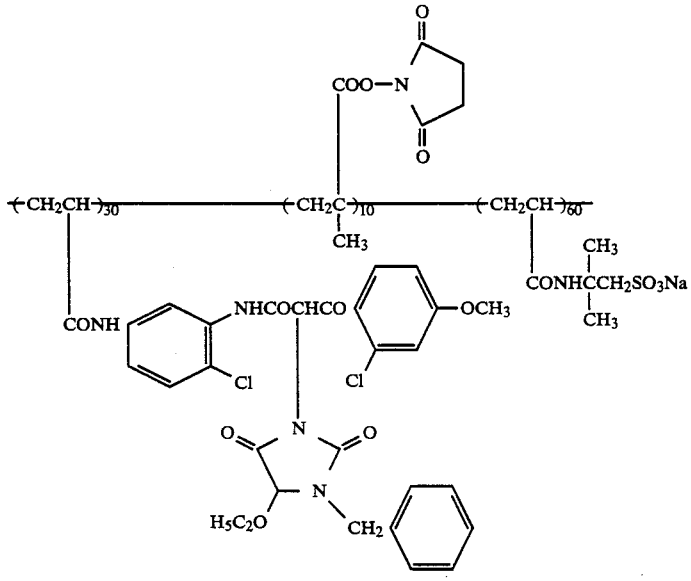

$Y_1$-2

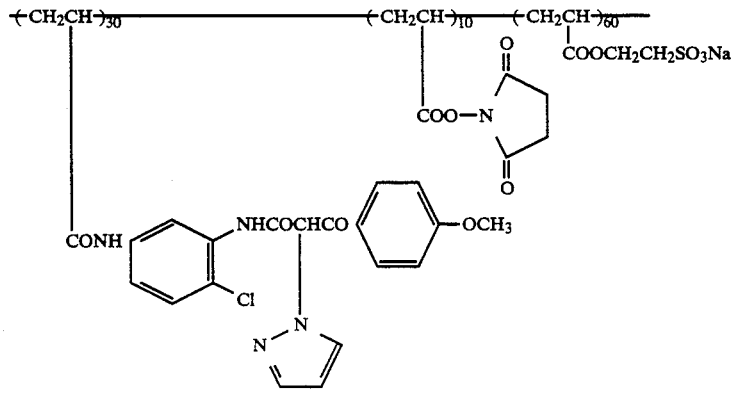

-continued
Polymeric Couplers Including the Repeating Unit Represented by Formula (II-A)
$Y_1$-3
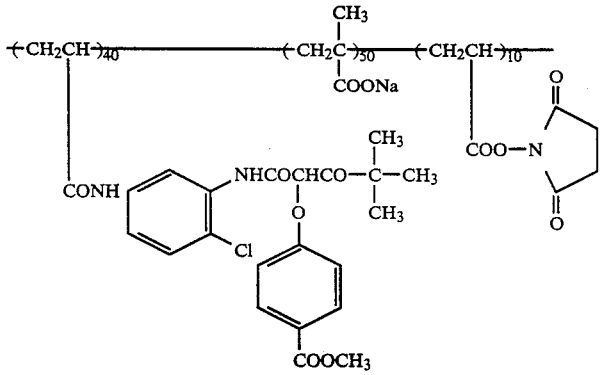
$Y_1$-4
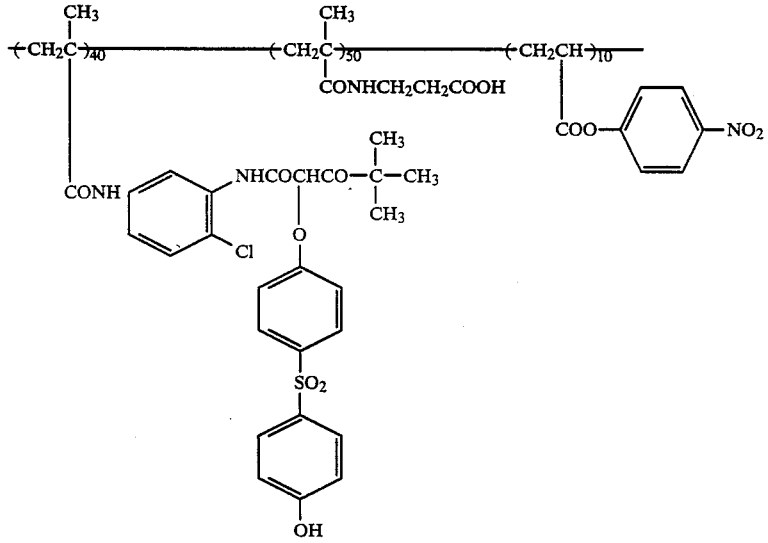
$Y_1$-5
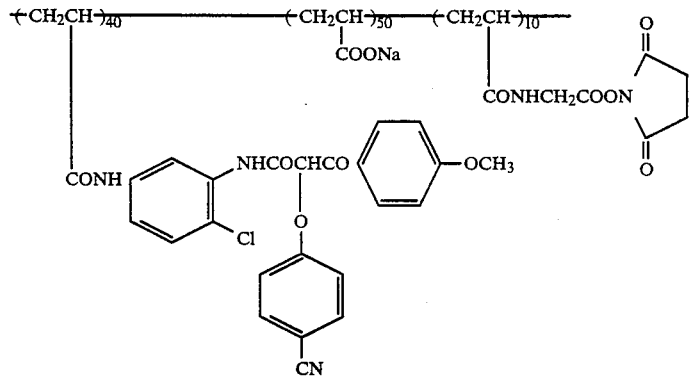
$Y_1$-6
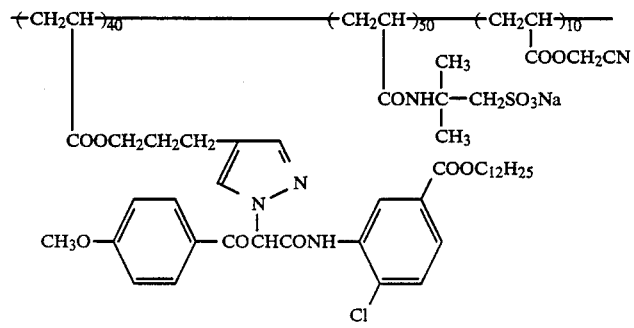

-continued
Polymeric Couplers Including the Repeating Unit Represented by Formula (II-A)
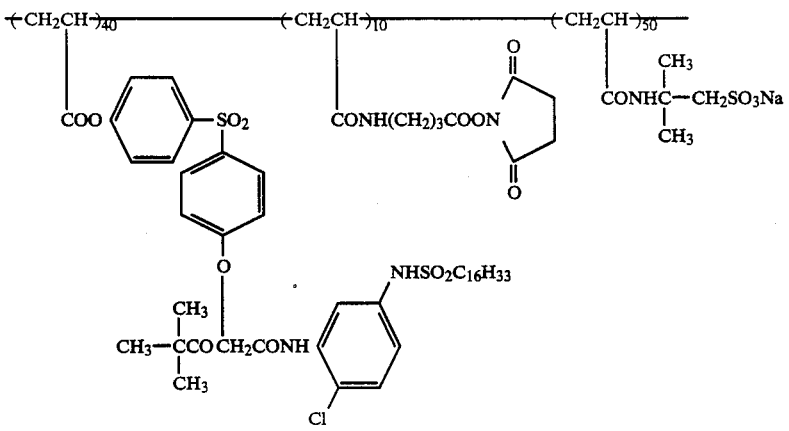
$Y_1$-7
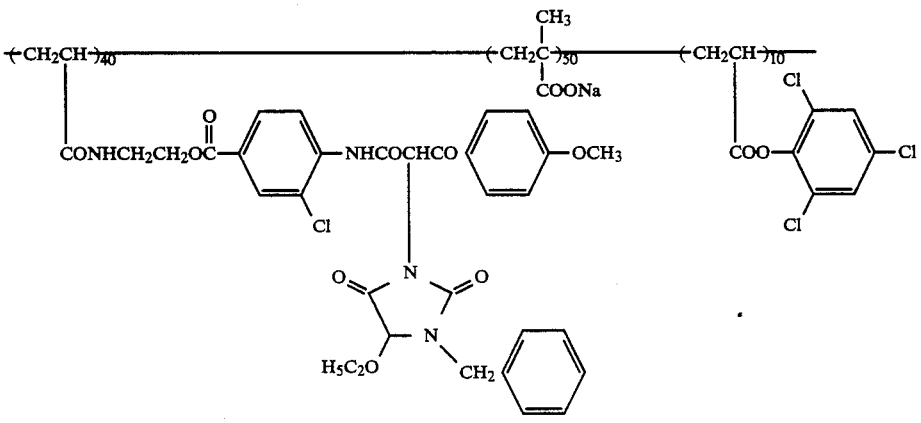
$Y_1$-8
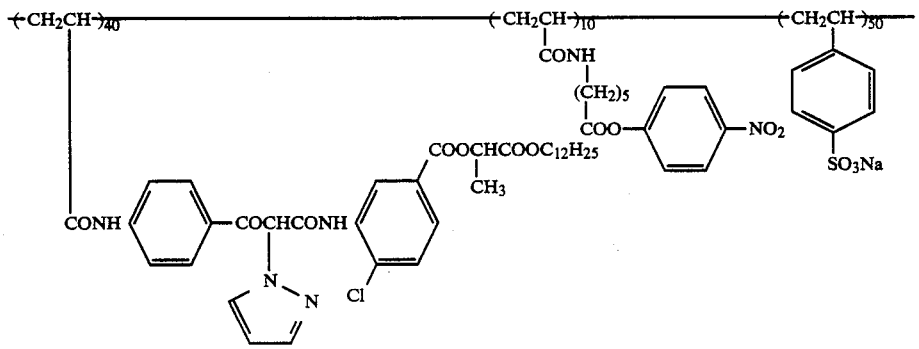
$Y_1$-9

-continued
Polymeric Couplers Including the Repeating Unit Represented by Formula (II-A)
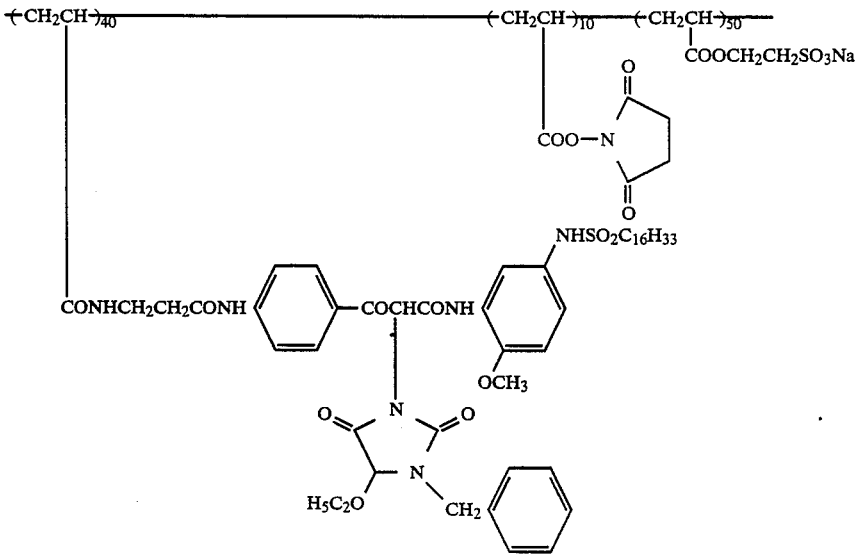
$Y_1$-10
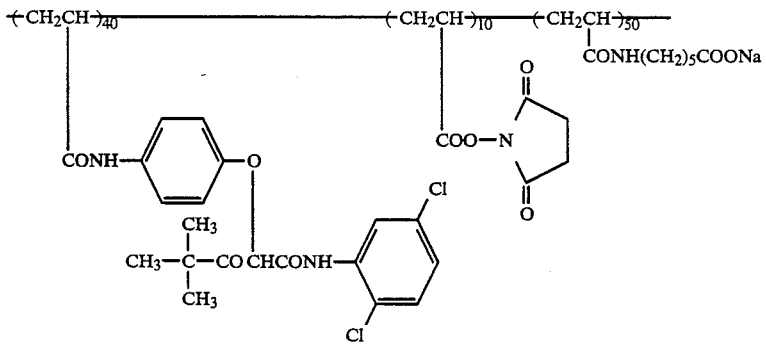
$Y_1$-11
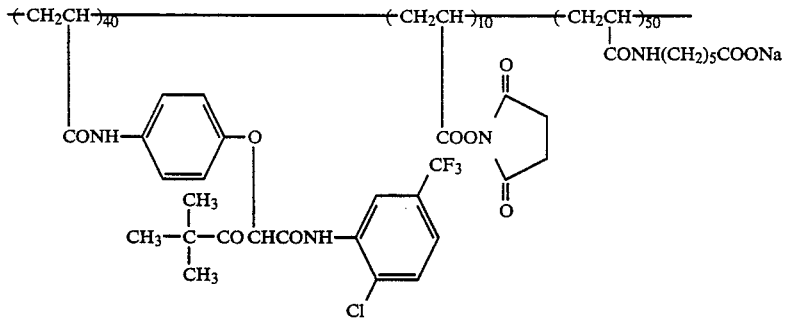
$Y_1$-12
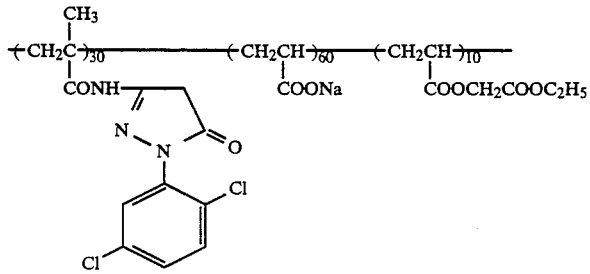
$M_1$-1

-continued
Polymeric Couplers Including the Repeating Unit Represented by Formula (II-A)
$M_1$-2
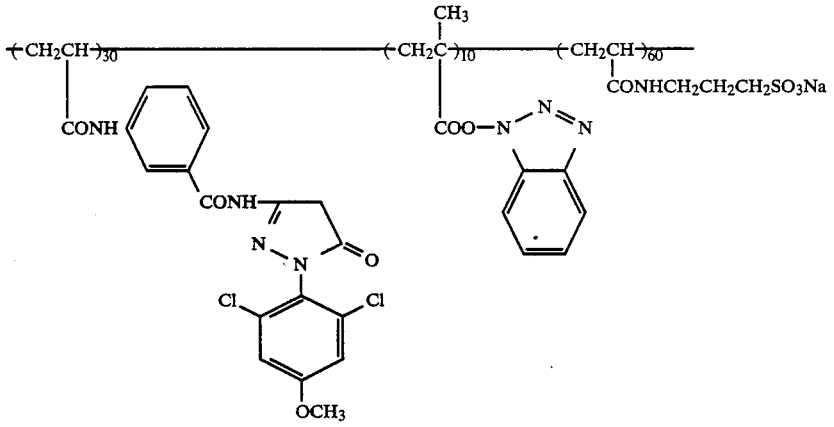
$M_1$-3
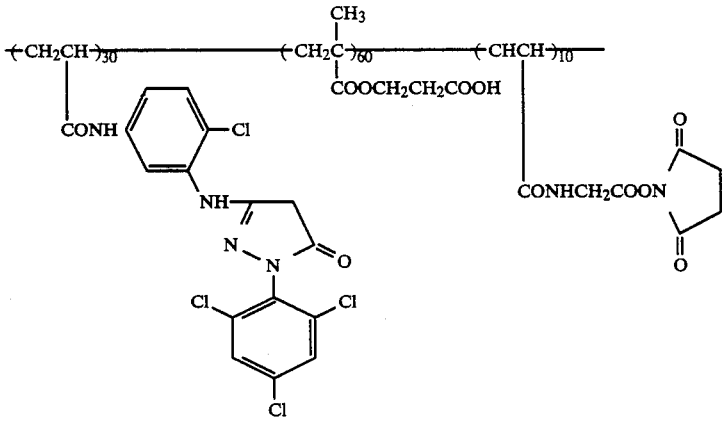
$M_1$-4
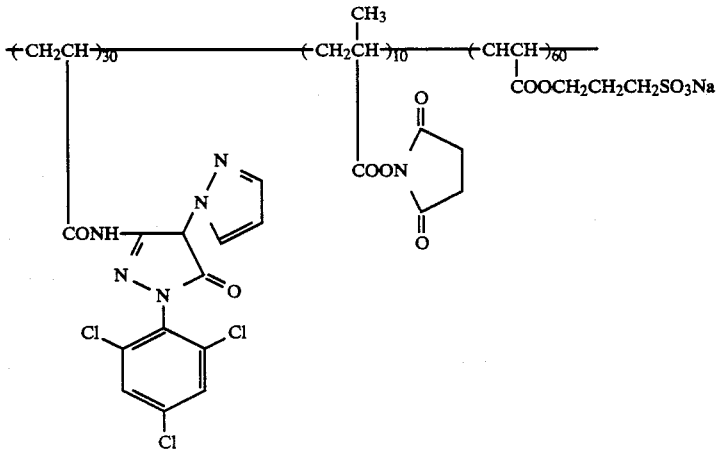

-continued
Polymeric Couplers Including the Repeating Unit Represented by Formula (II-A)
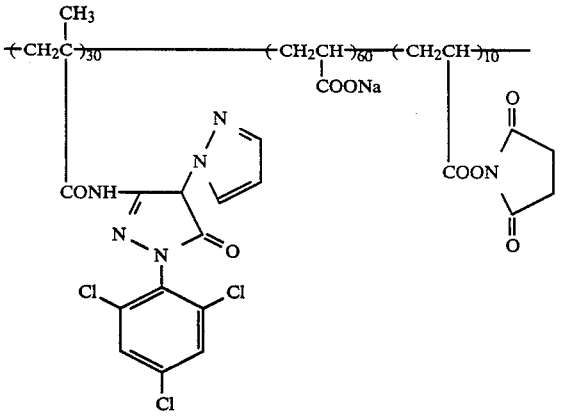
$M_1$-5
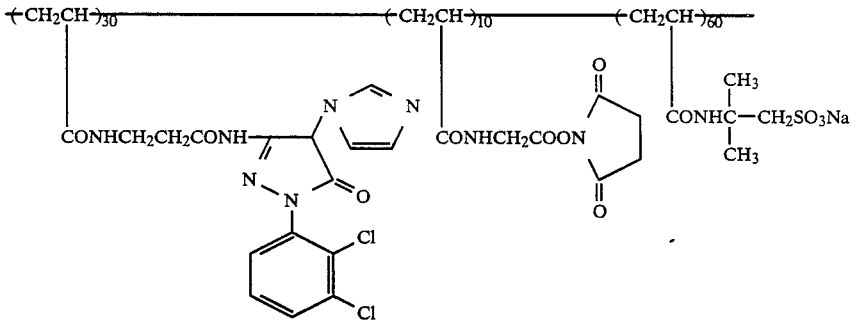
$M_1$-6
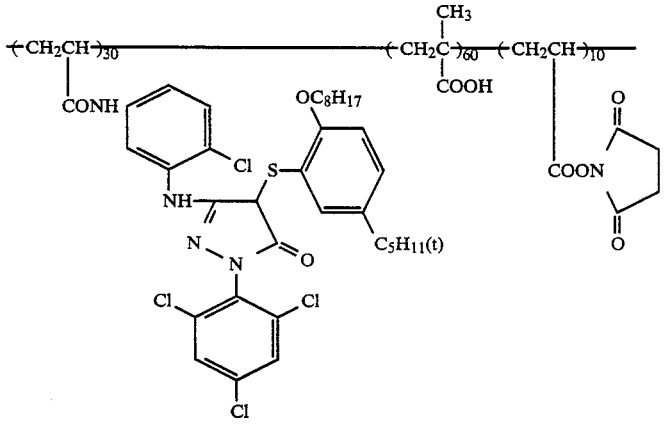
$M_1$-7
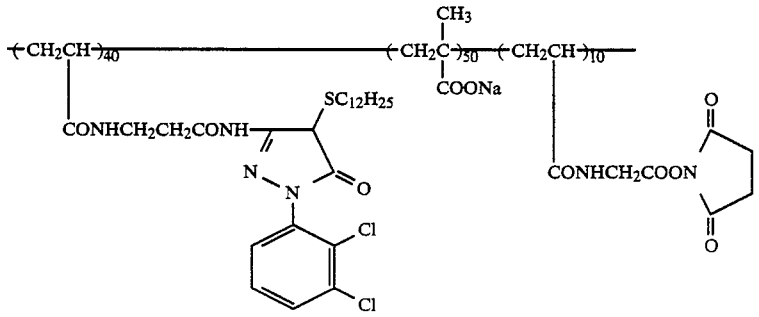
$M_1$-8

-continued
Polymeric Couplers Including the Repeating Unit Represented by Formula (II-A)
$M_1$-9
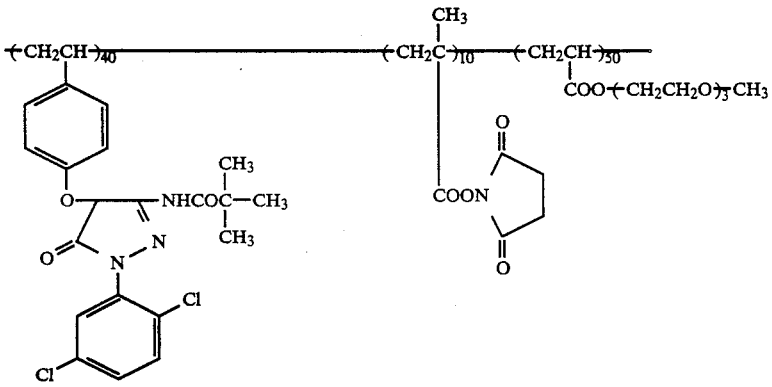
$M_1$-10
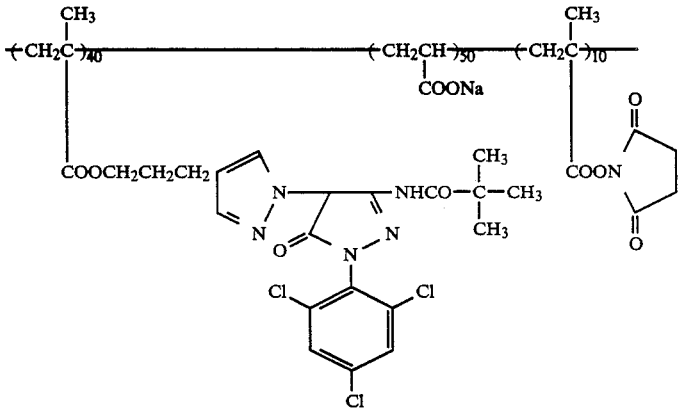
$M_1$-11
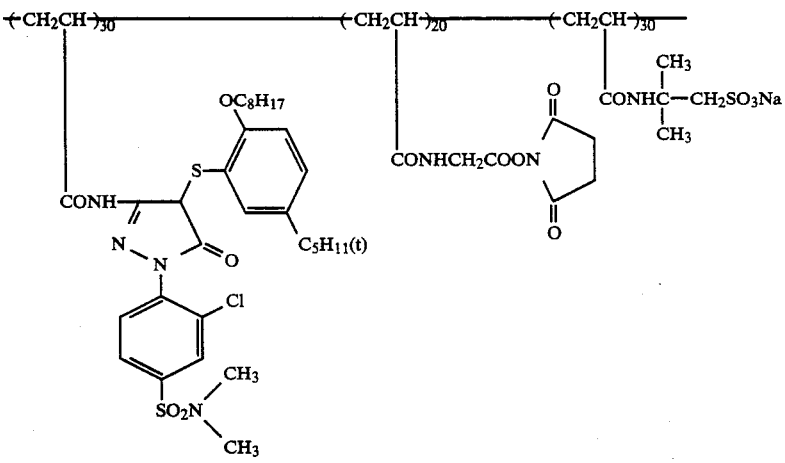
$M_1$-12
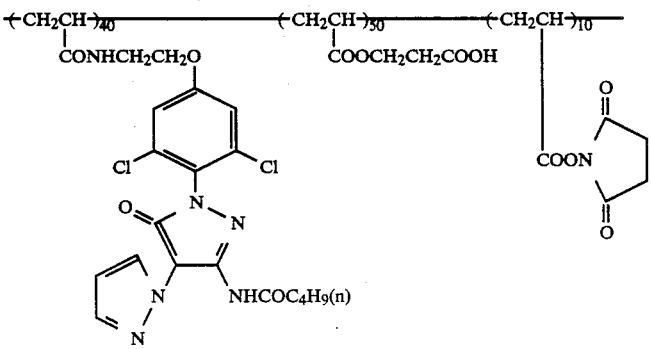

-continued
Polymeric Couplers Including the Repeating Unit Represented by Formula (II-A)
$M_1$-13
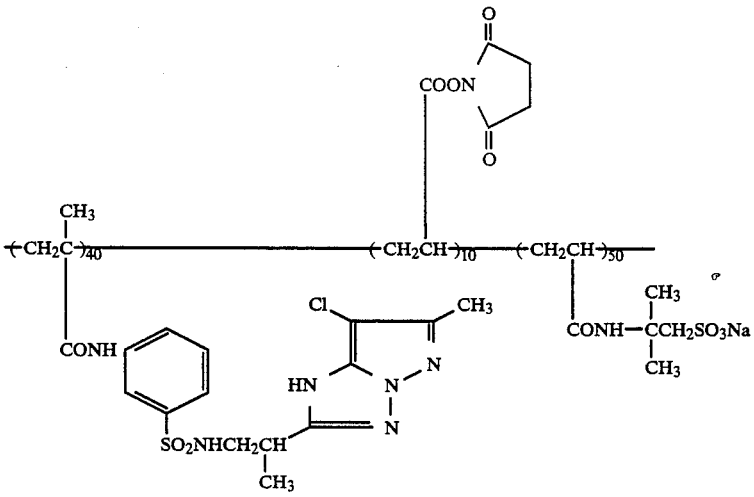
$M_1$-14
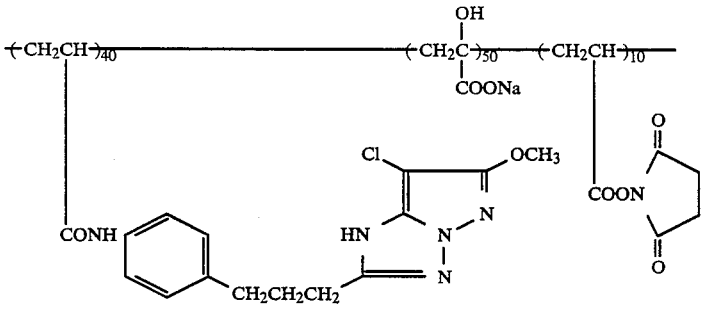
$M_1$-15
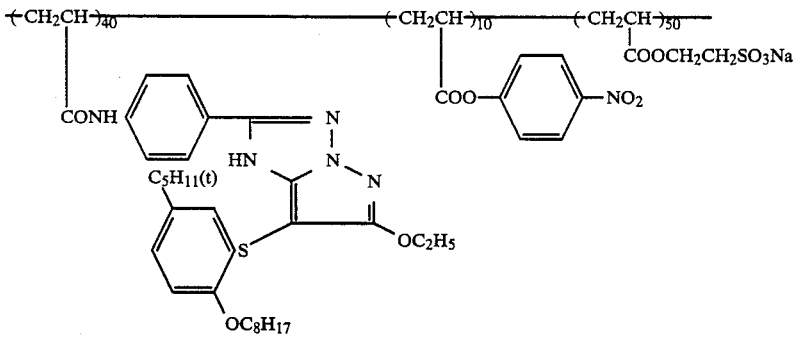
$M_1$-16
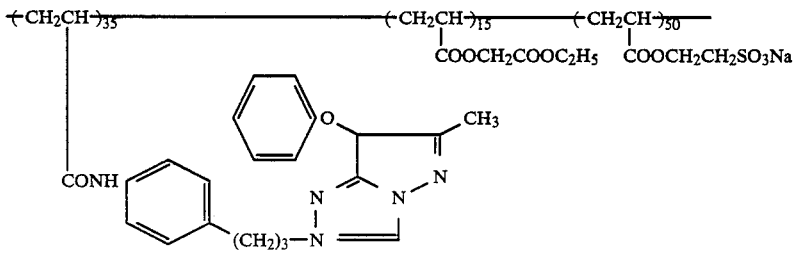

-continued
Polymeric Couplers Including the Repeating Unit Represented by Formula (II-A)
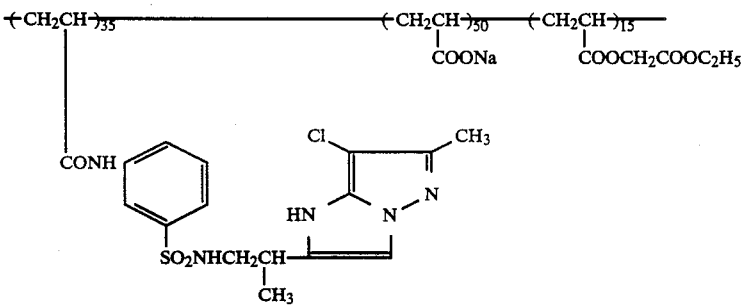
$M_1$-17
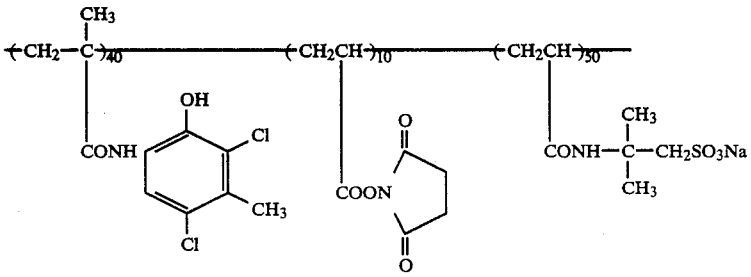
$C_1$-1
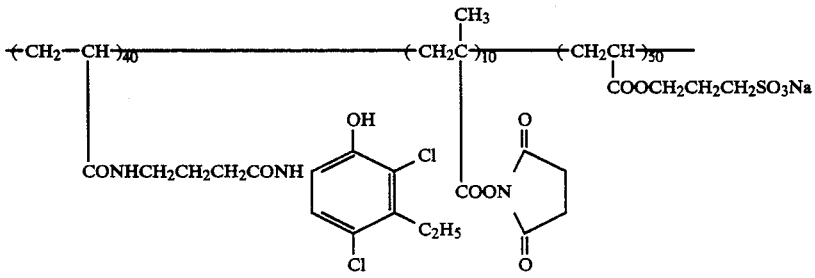
$C_1$-2
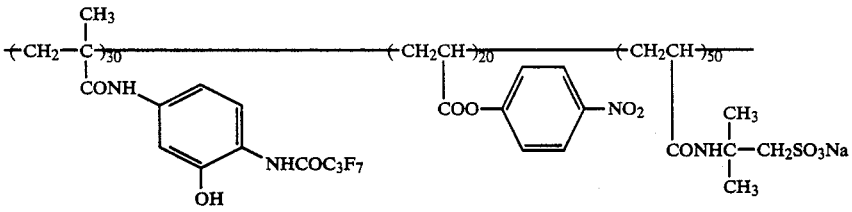
$C_1$-3
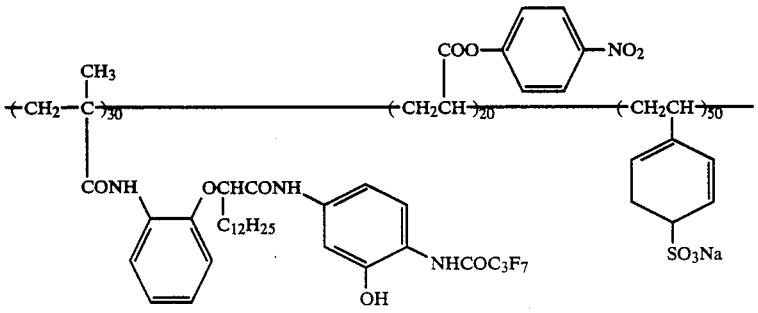
$C_1$-4

-continued
Polymeric Couplers Including the Repeating Unit Represented by Formula (II-A)
$C_1$-5
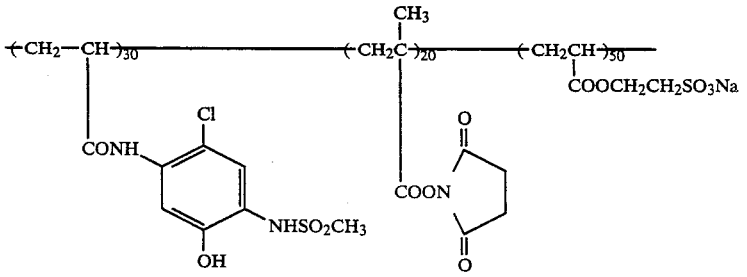
$C_1$-6
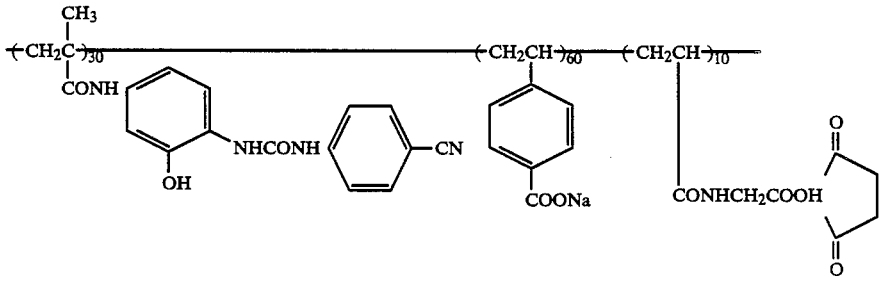
$C_1$-7
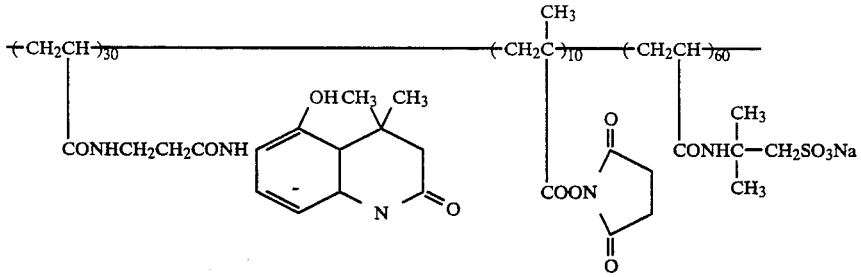
$C_1$-8
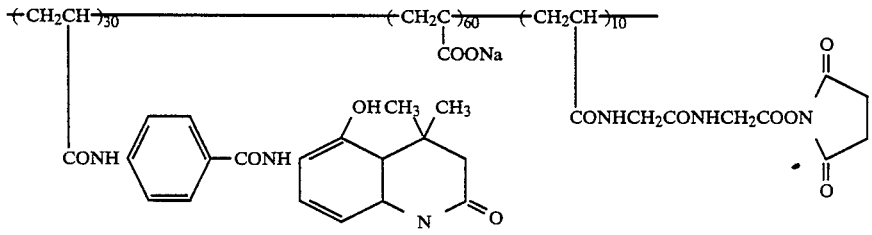
$C_1$-9
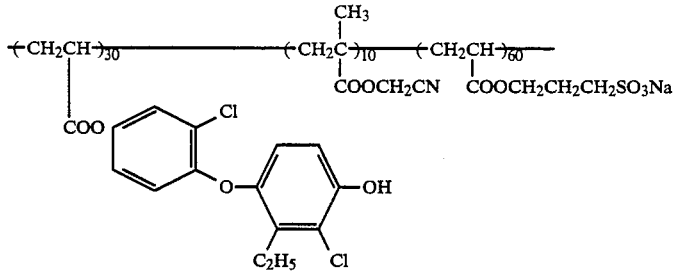
$C_1$-10
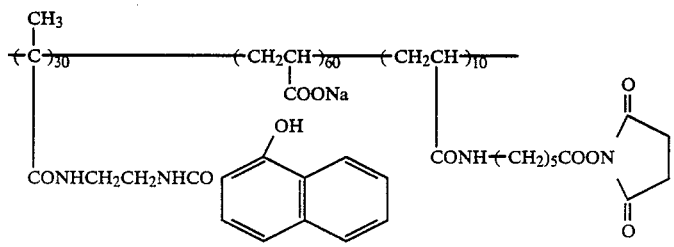

-continued
Polymeric Couplers Including the Repeating Unit Represented by Formula (II-A)
$C_1$-11
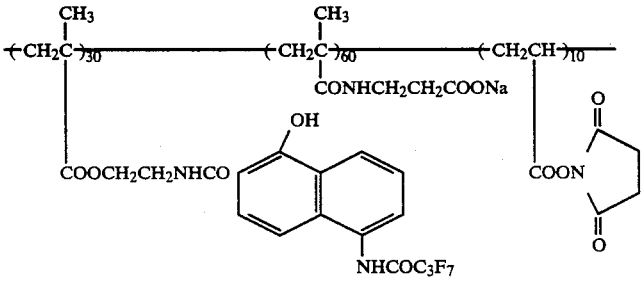
$C_1$-12
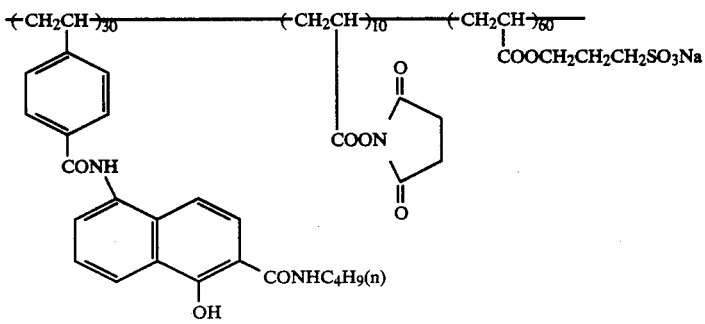
$C_1$-13
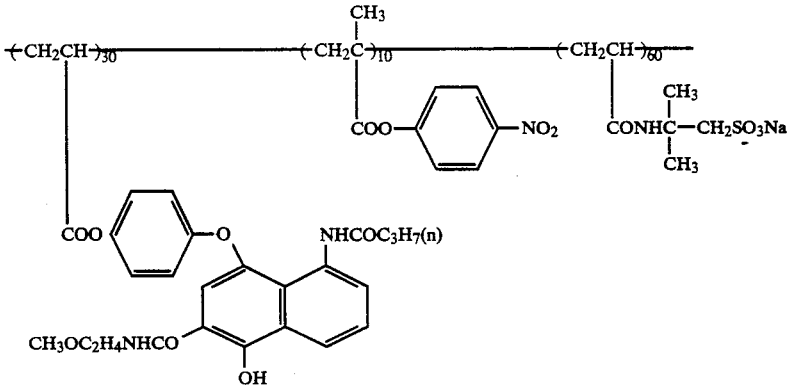
$C_1$-14
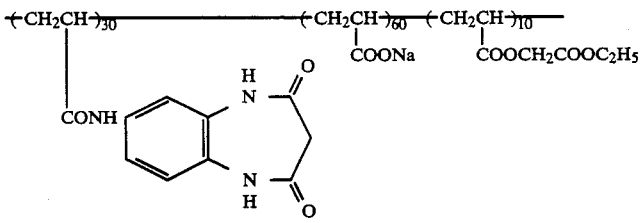
$C_1$-15
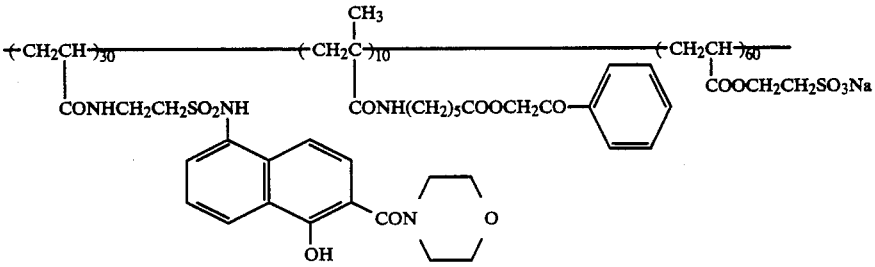

Polymeric Couplers Including the Repeating Unit Represented by Formula (II-B), (II-C) or (II-D)
$Y_2$-1
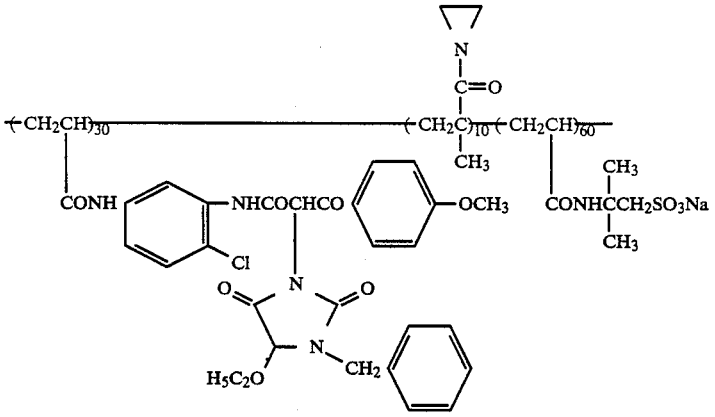
$Y_2$-2
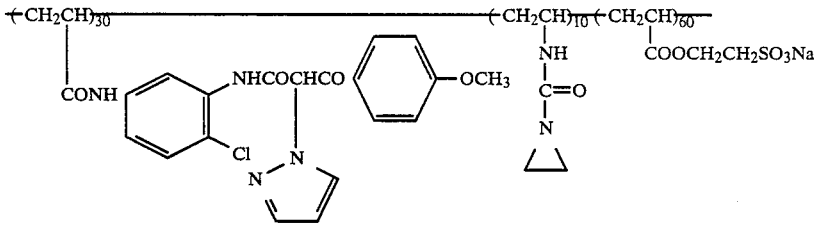
$Y_2$-3
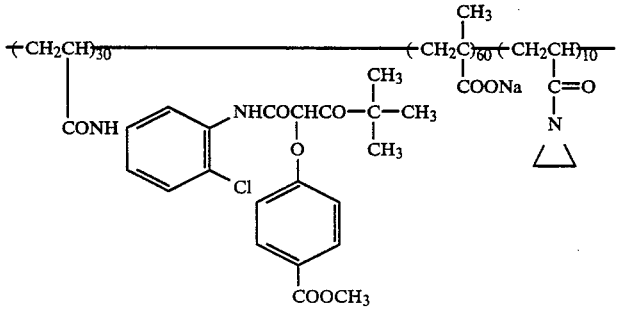
$Y_2$-4
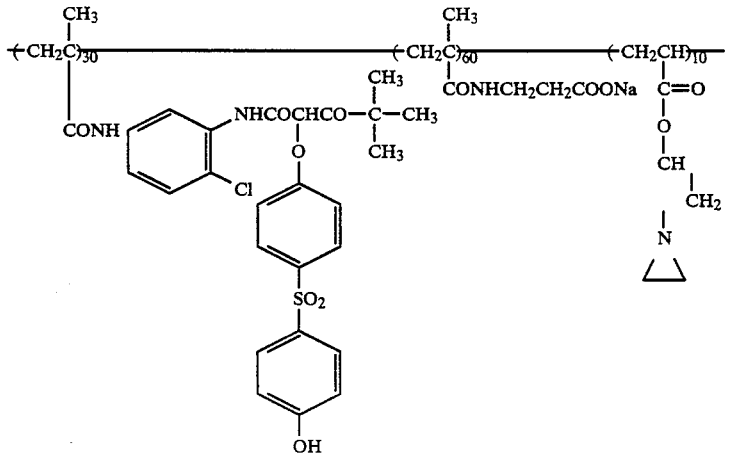

-continued
Polymeric Couplers Including the Repeating Unit Represented by Formula (II-B), (II-C) or (II-D)
$Y_2$-5
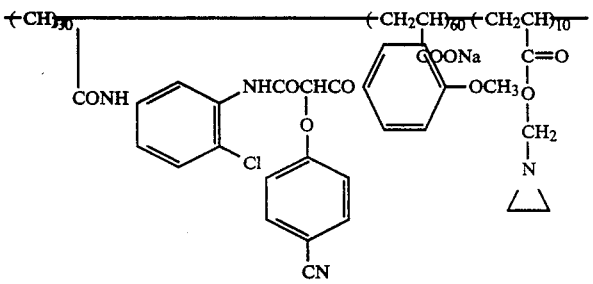
$Y_2$-6
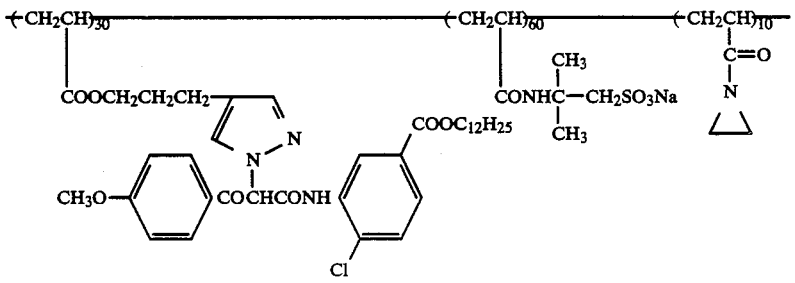
$Y_2$-7
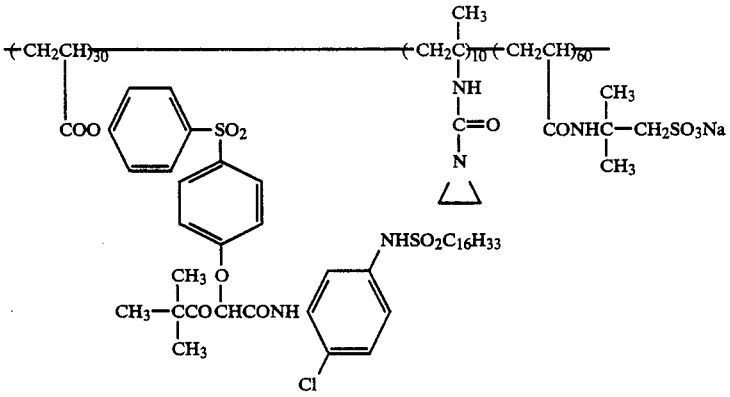
$Y_2$-8
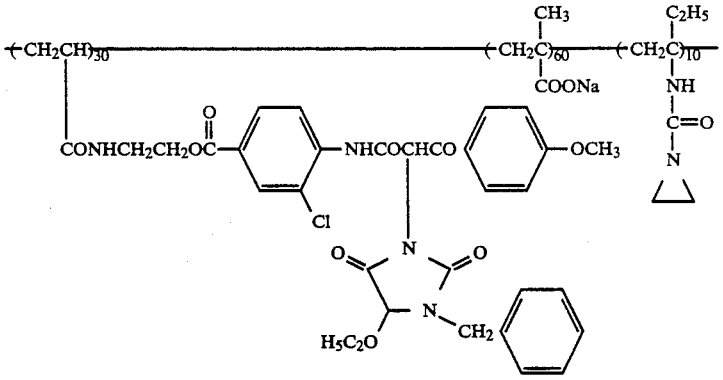
$Y_2$-9
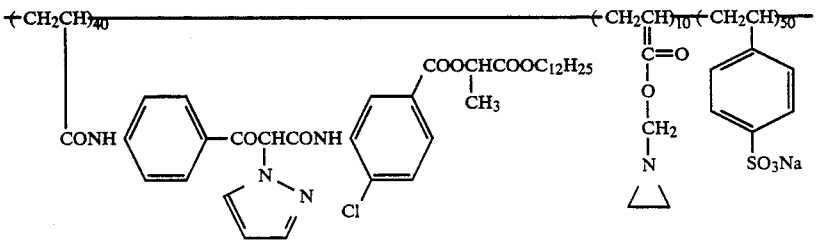

-continued
Polymeric Couplers Including the Repeating Unit Represented by Formula (II-B), (II-C) or (II-D)
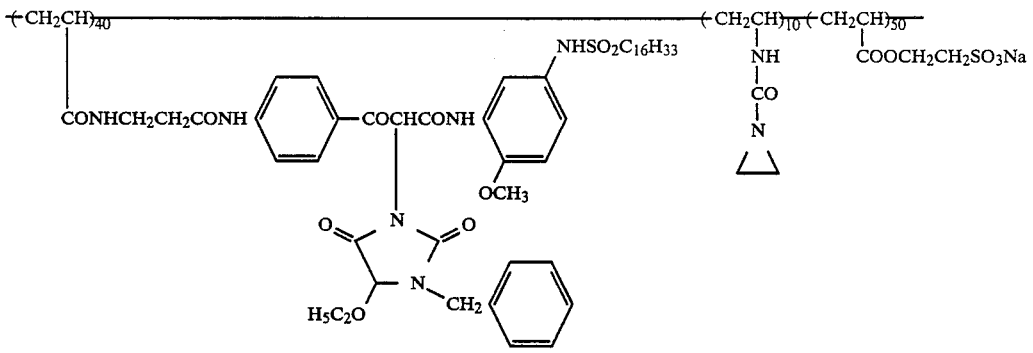
$Y_2$-10
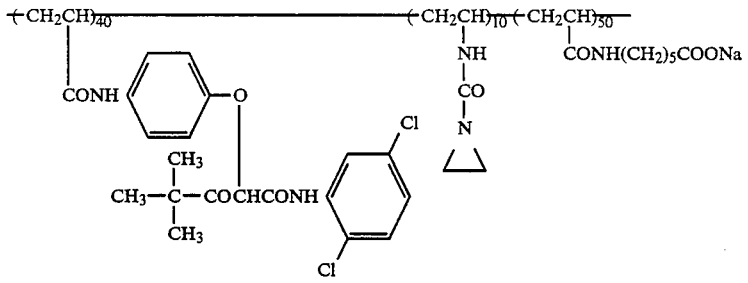
$Y_2$-11
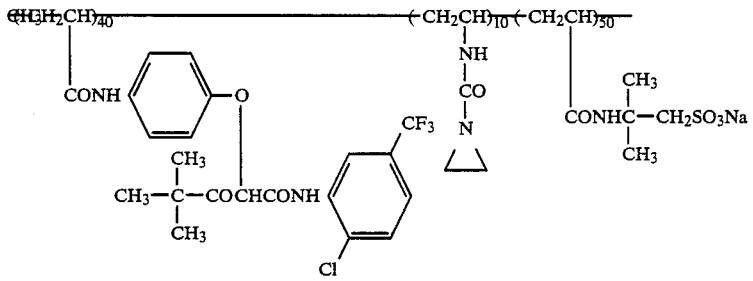
$Y_2$-12
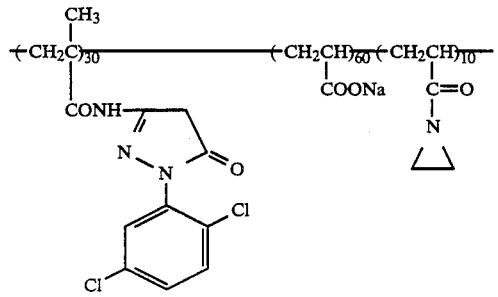
$M_2$-1

-continued
Polymeric Couplers Including the Repeating Unit Represented by Formula (II-B), (II-C) or (II-D)
$M_2$-2
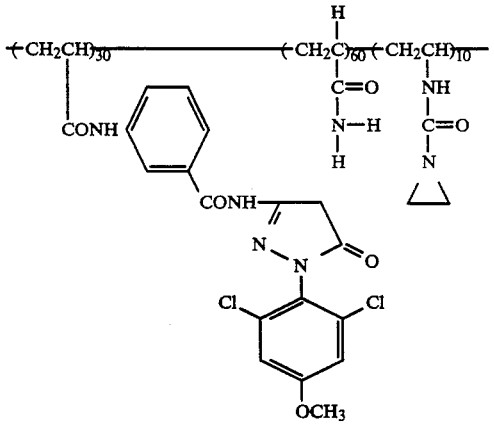
$M_2$-3
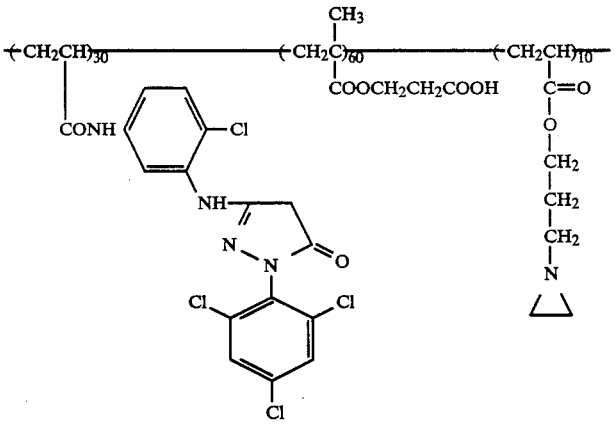
$M_2$-4
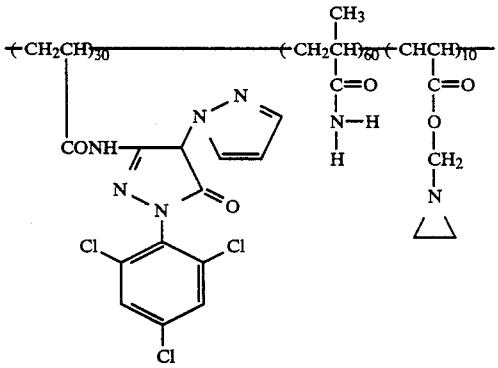
$M_2$-5
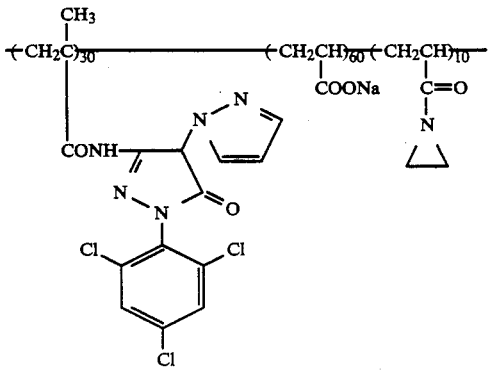

-continued
Polymeric Couplers Including the Repeating Unit Represented by Formula (II-B), (II-C) or (II-D)
$M_2$-6
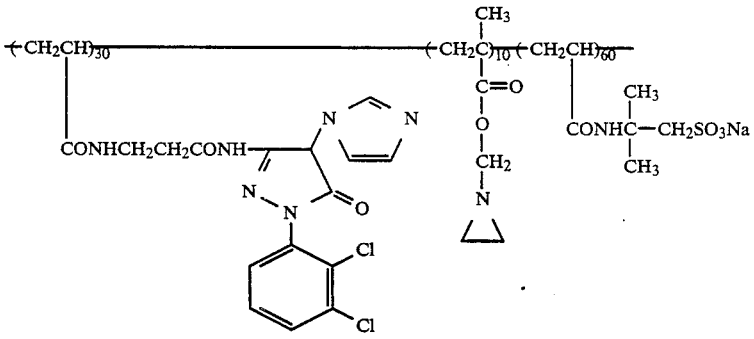
$M_2$-7
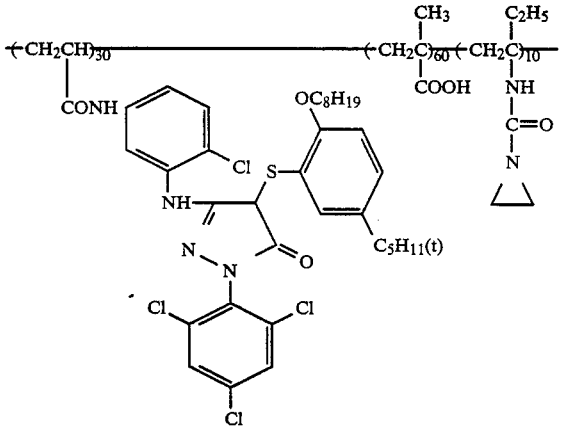
$M_2$-8
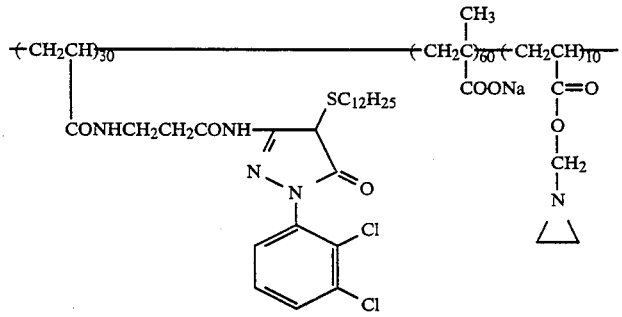
$M_2$-9
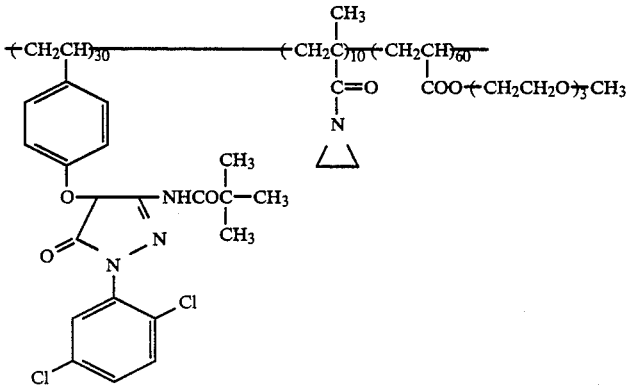

-continued
Polymeric Couplers Including the Repeating Unit Represented by Formula (II-B), (II-C) or (II-D)
M2-10
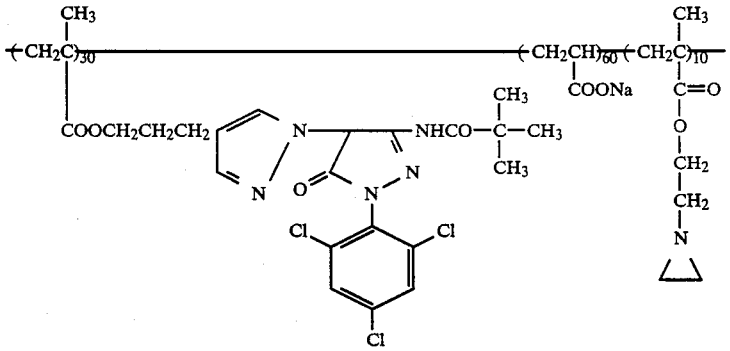
M2-11
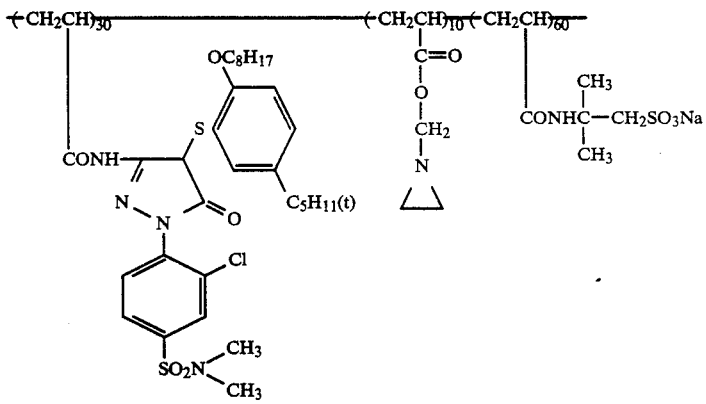
M2-12
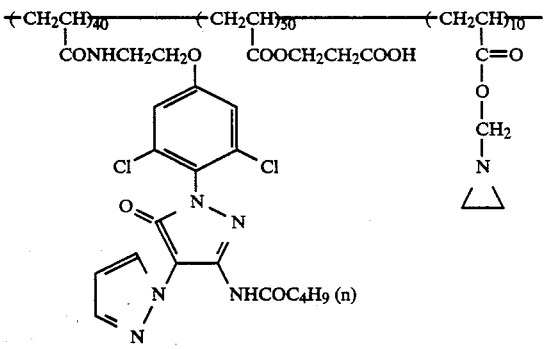
M2-13
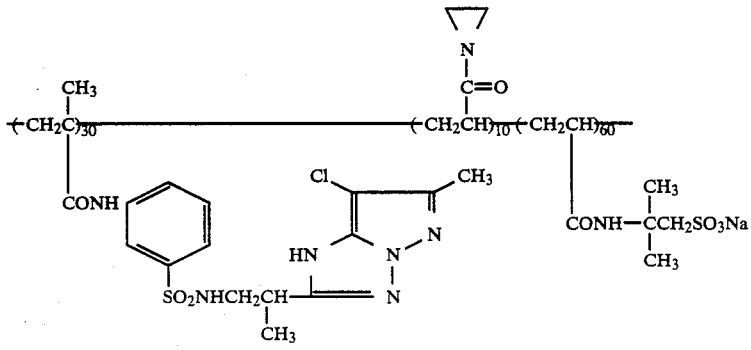

-continued
Polymeric Couplers Including the Repeating Unit Represented by Formula (II-B), (II-C) or (II-D)
M2-14
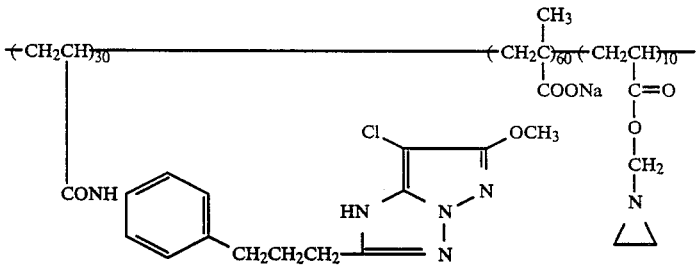
M2-15
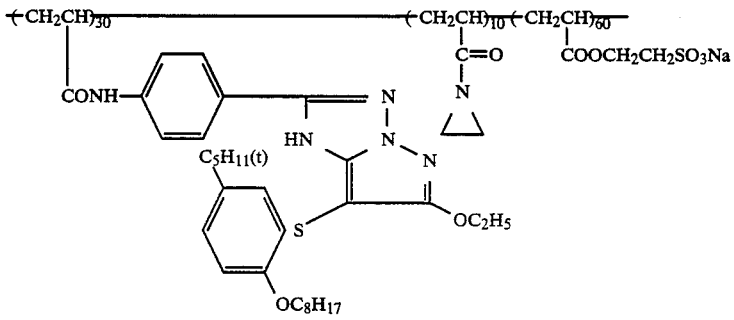
M2-16
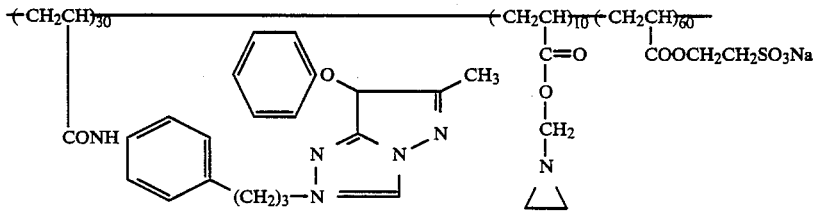
M2-17
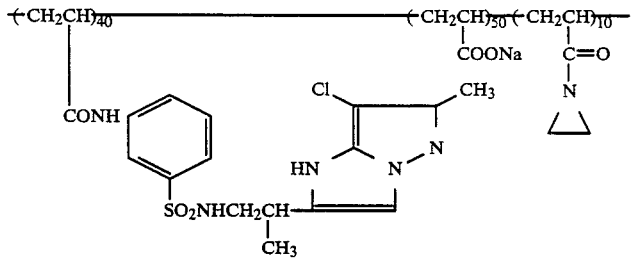
C2-1
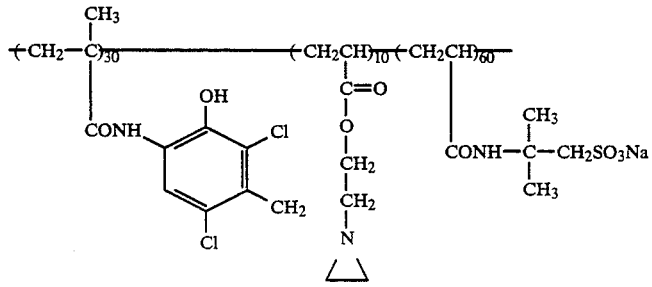

-continued
Polymeric Couplers Including the Repeating Unit Represented by Formula (II-B), (II-C) or (II-D)
$C_2$-2
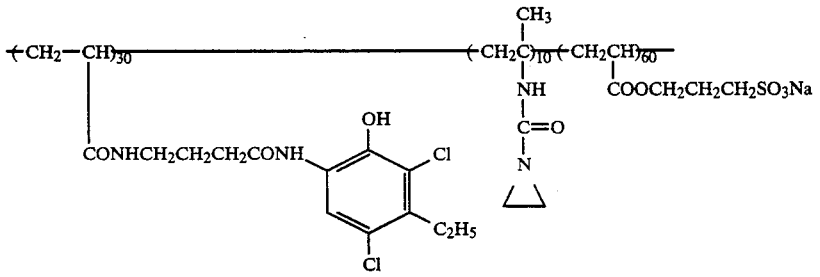
$C_2$-3
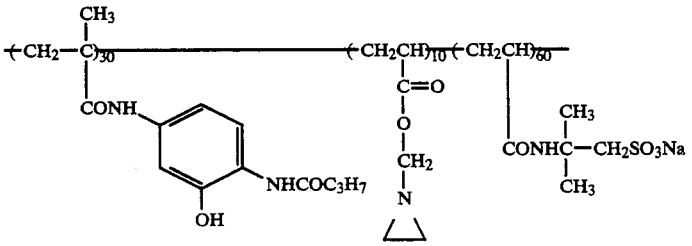
$C_2$-4
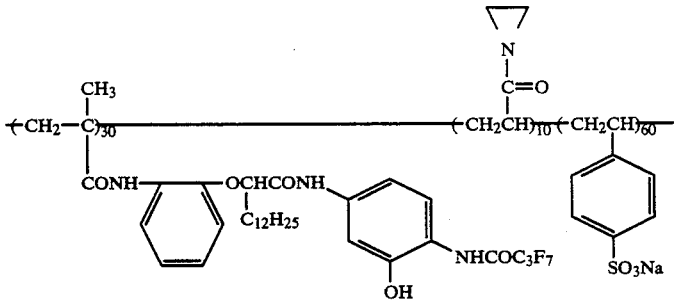
$C_2$-5
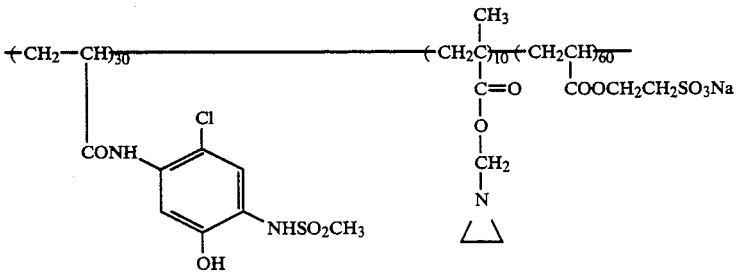
$C_2$-6
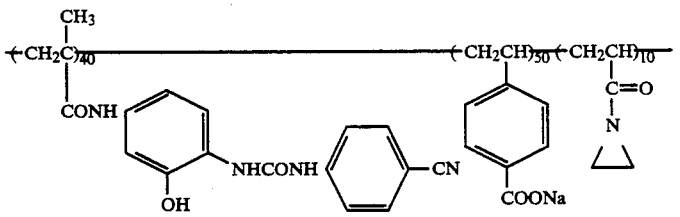
$C_2$-7
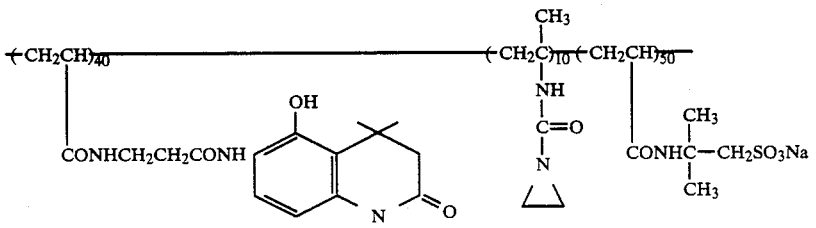

-continued
Polymeric Couplers Including the Repeating Unit Represented by Formula (II-B), (II-C) or (II-D)
$C_2$-8
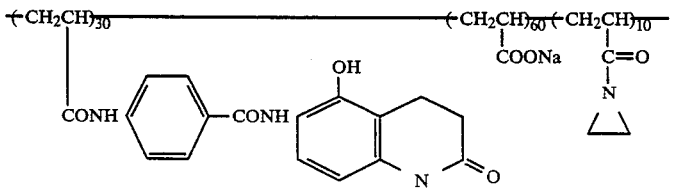
$C_2$-9
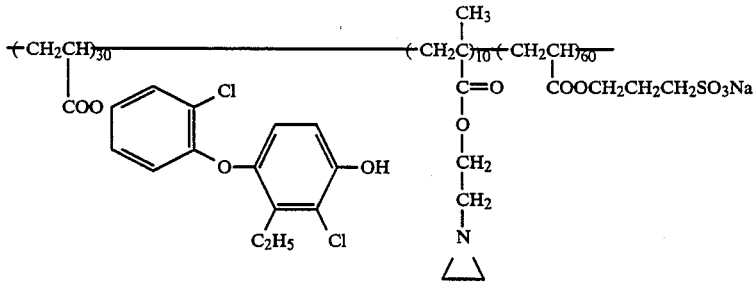
$C_2$-10
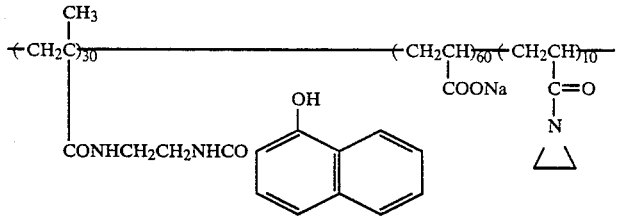
$C_2$-11
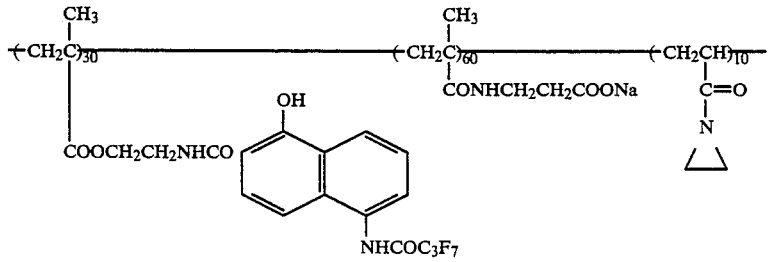
$C_2$-12
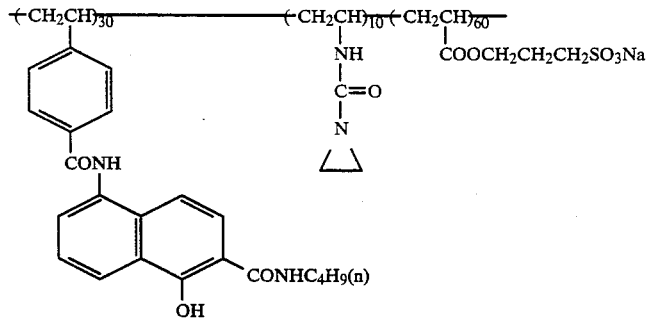
$C_2$-13
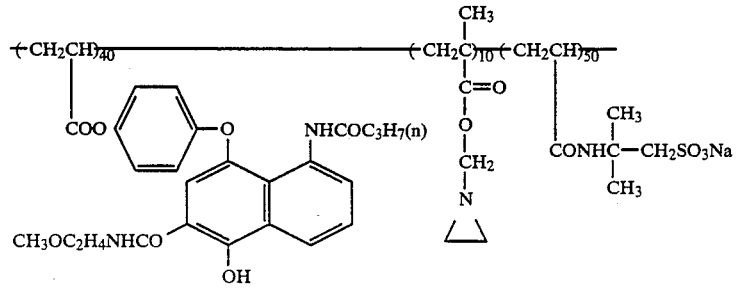

-continued
Polymeric Couplers Including the Repeating Unit Represented by Formula (II-B), (II-C) or (II-D)
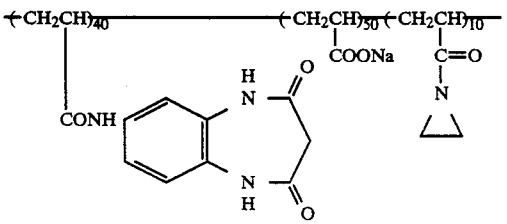
$C_2$-14
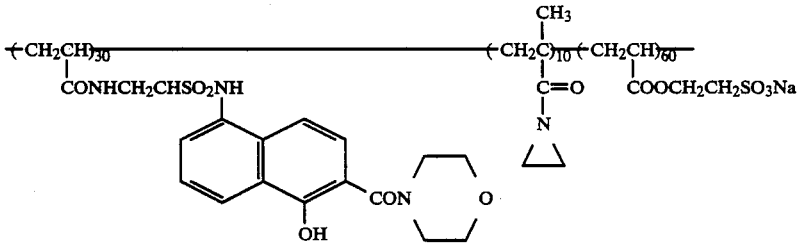
$C_2$-15
Polymeric Couplers Including the Repeating Unit Represented by Formula (II-E)
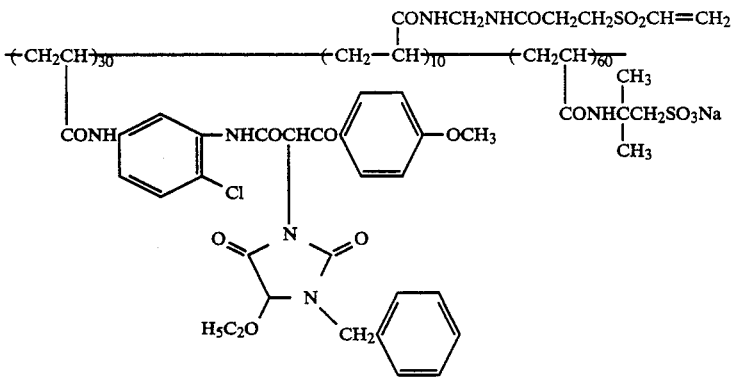
$Y_3$-1
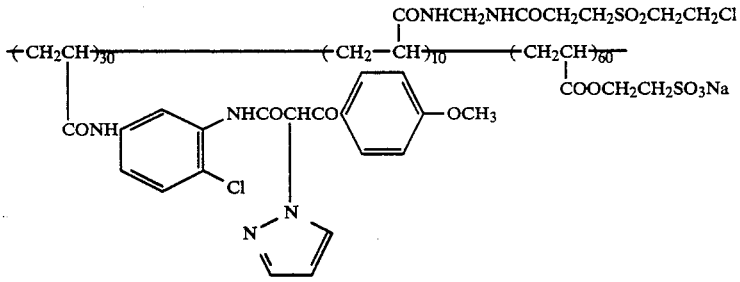
$Y_3$-2
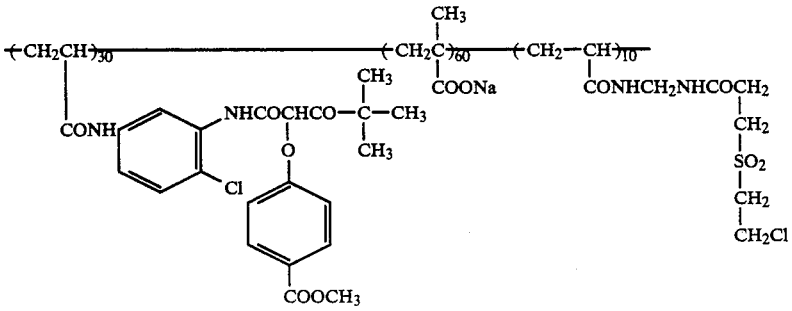
$Y_3$-3

-continued
Polymeric Couplers Including the Repeating Unit Represented by Formula (II-E)
Y3-4
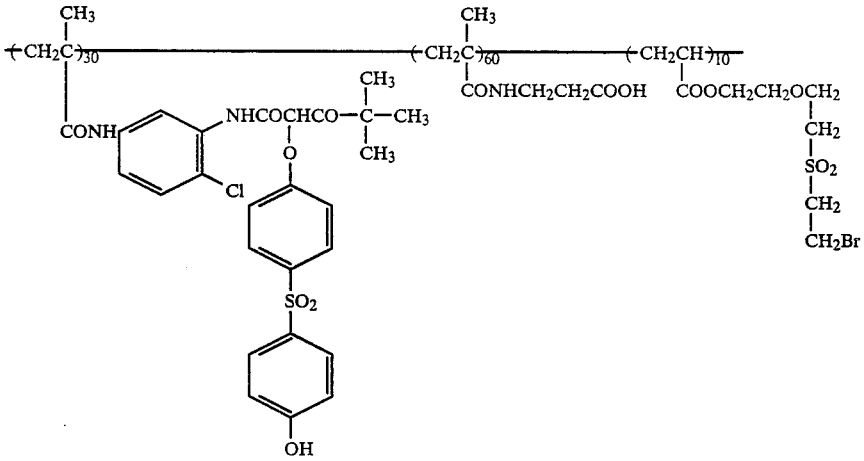
Y3-5
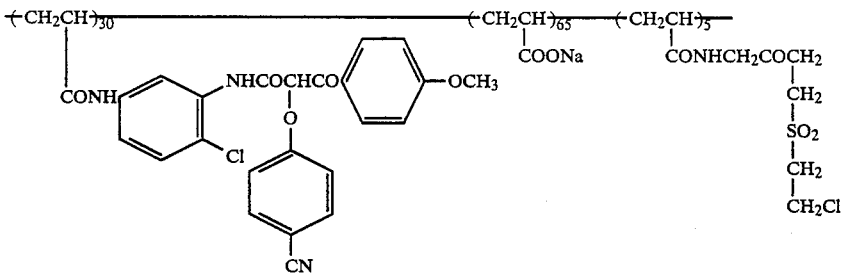
Y3-6
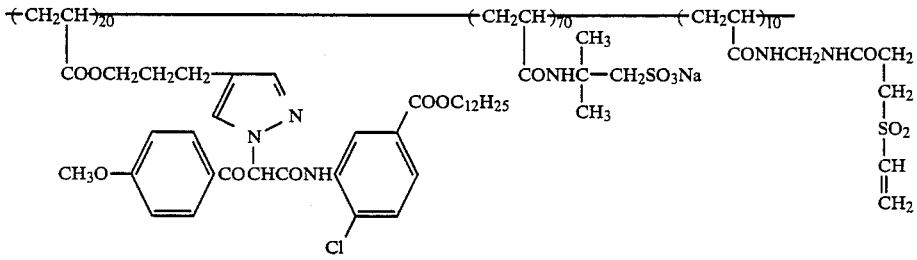
Y3-7
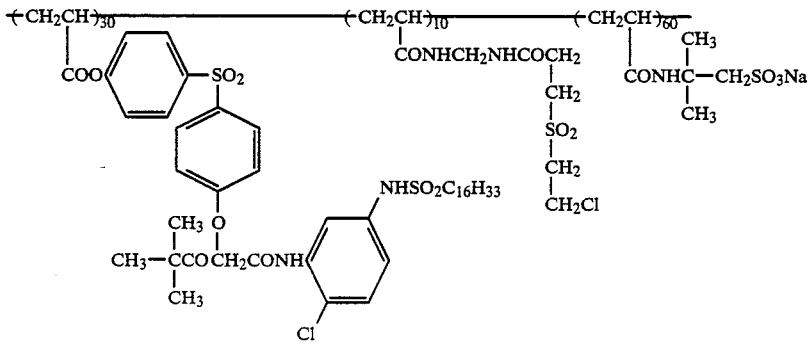

-continued
Polymeric Couplers Including the Repeating Unit Represented by Formula (II-E)
Y3-8
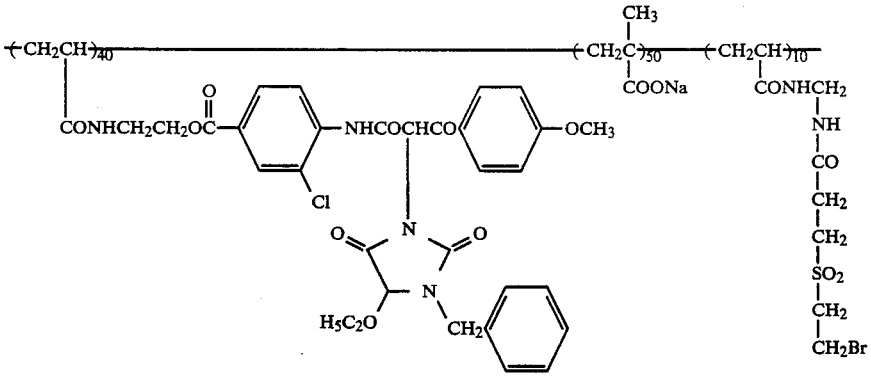
Y3-9
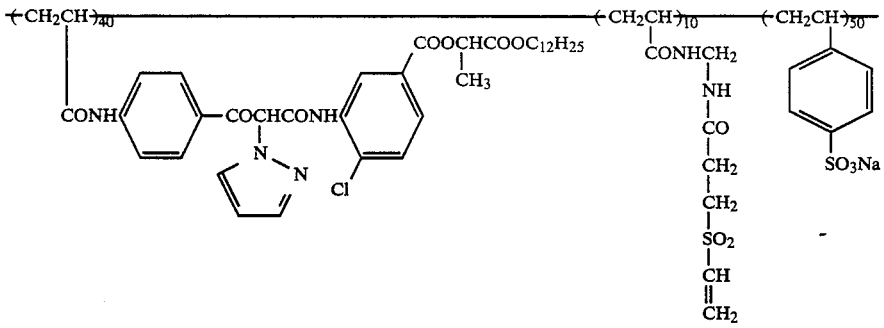
Y3-10
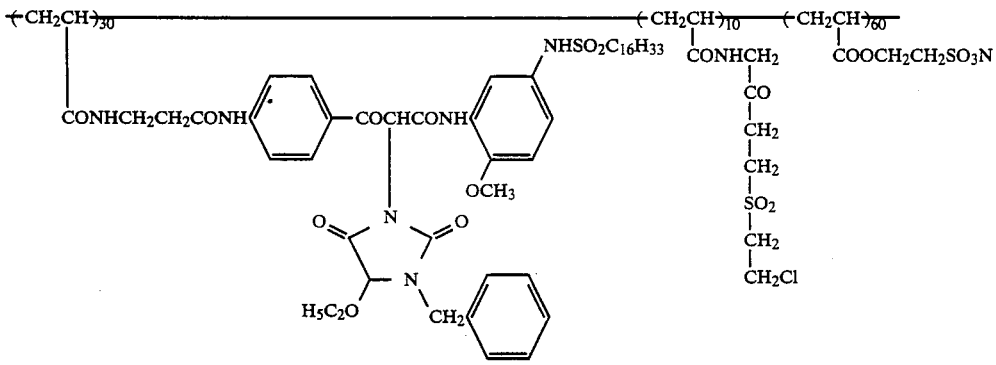
Y3-11
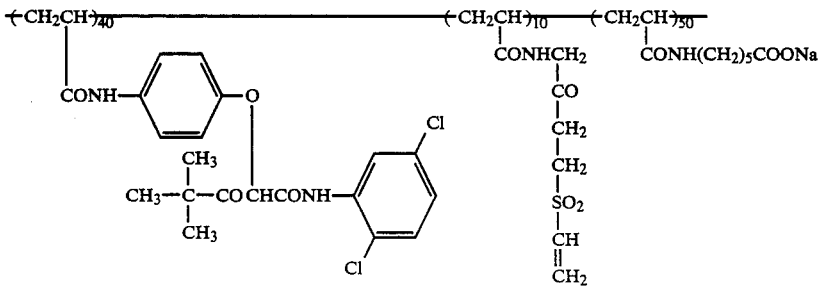

-continued
Polymeric Couplers Including the Repeating Unit Represented by Formula (II-E)
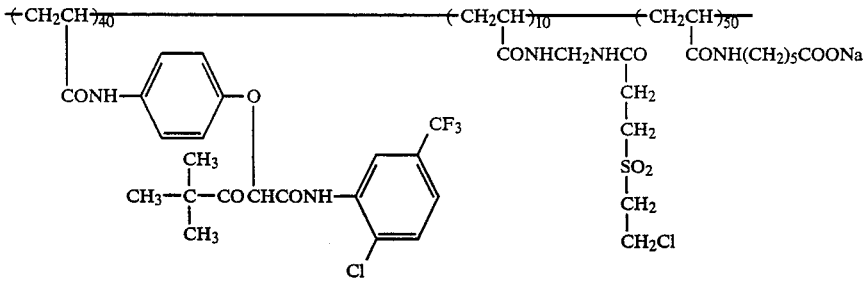
Y3-12
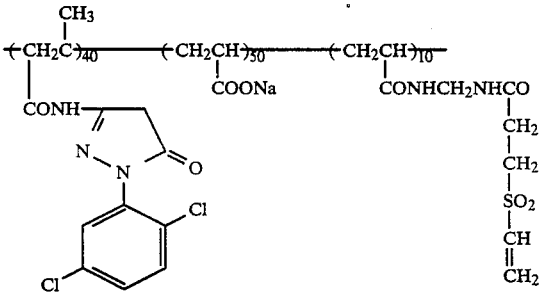
M3-1
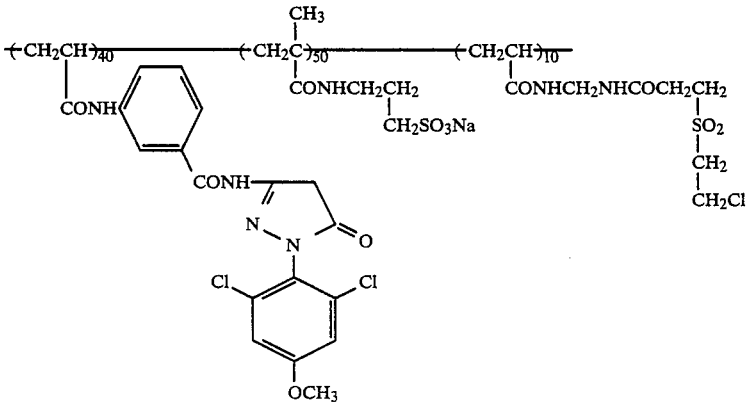
M3-2
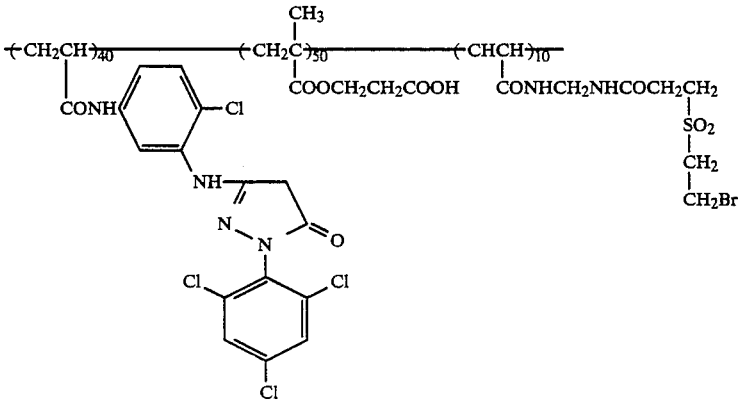
M3-3

-continued
Polymeric Couplers Including the Repeating Unit Represented by Formula (II-E)
M3-4
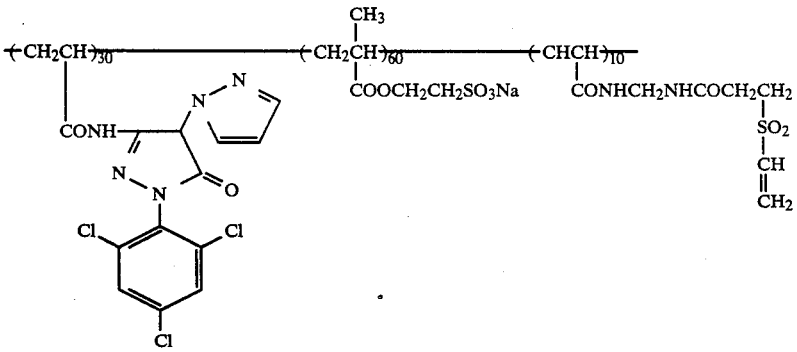
M3-5
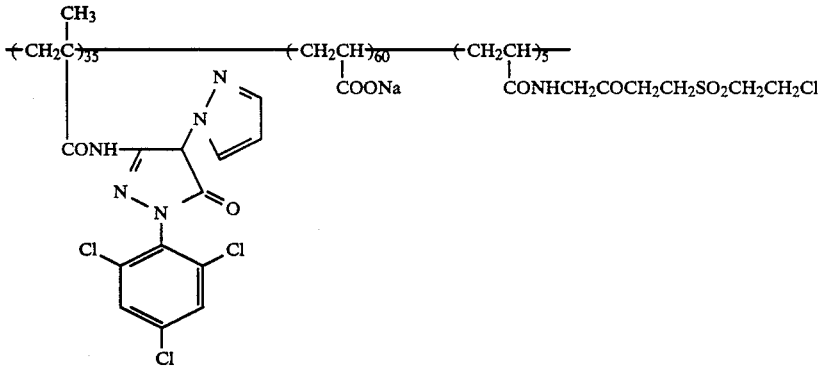
M3-6
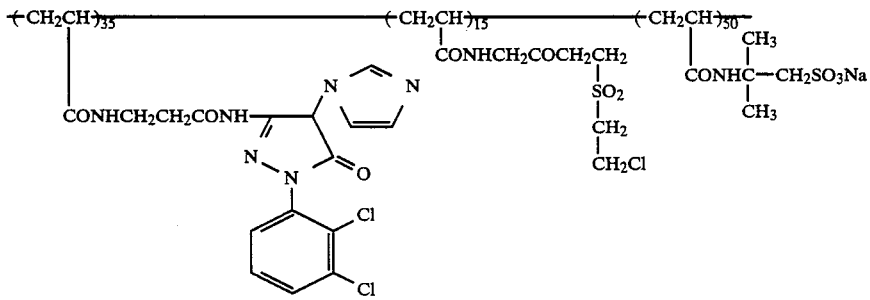
M3-7
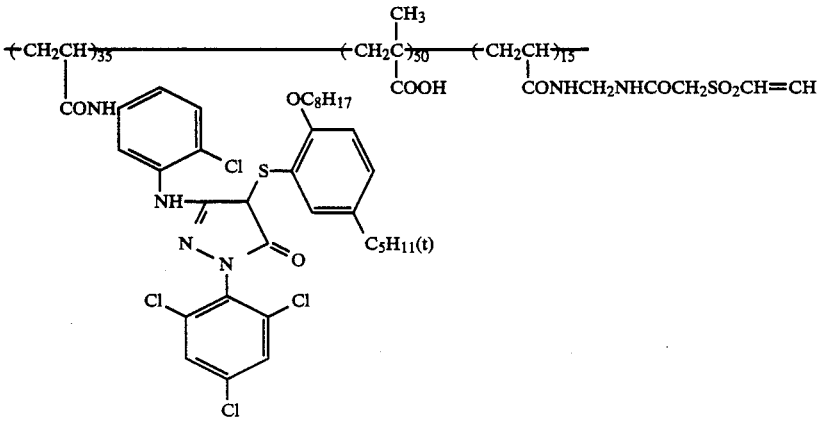

-continued
Polymeric Couplers Including the Repeating Unit Represented by Formula (II-E)
M3-8
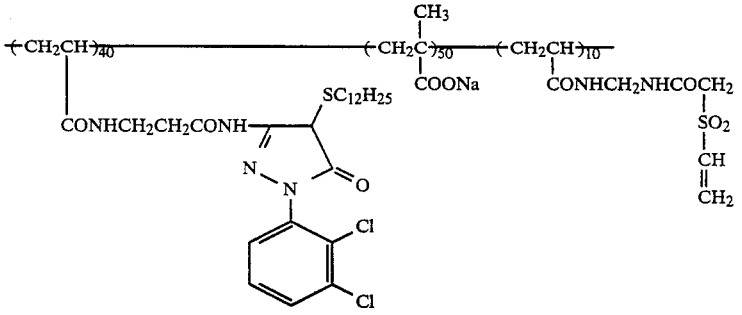
Polymeric Couplers Including the Repeating Unit Represented by Formula (II-F)
Y4-1
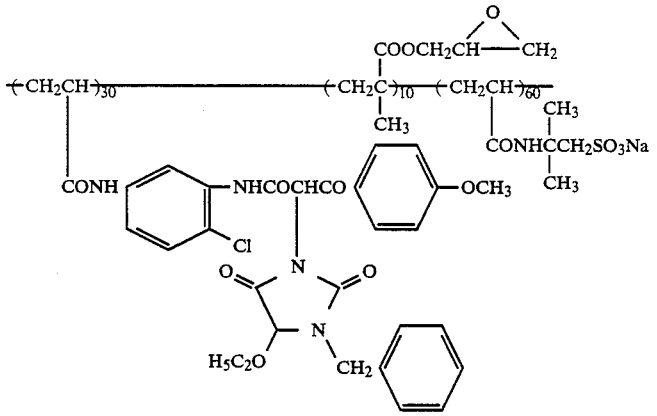
Y4-2
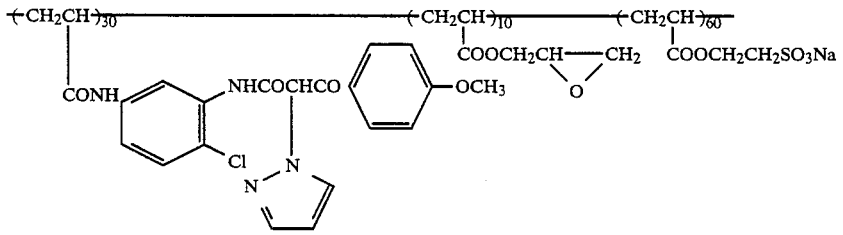
Y4-3
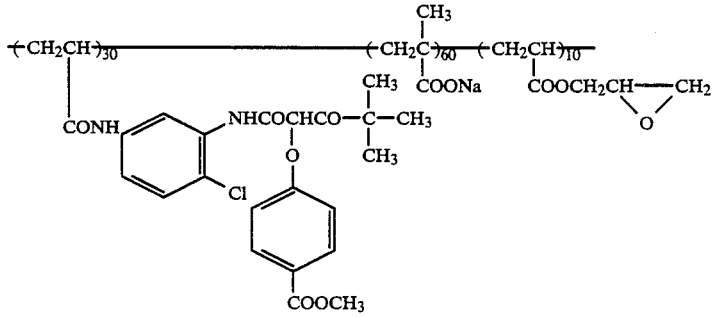

-continued
Polymeric Couplers Including the Repeating Unit Represented by Formula (II-F)
Y4-4
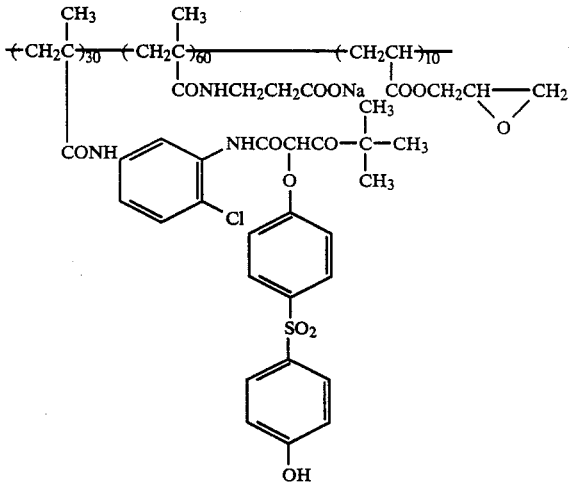
Y4-5
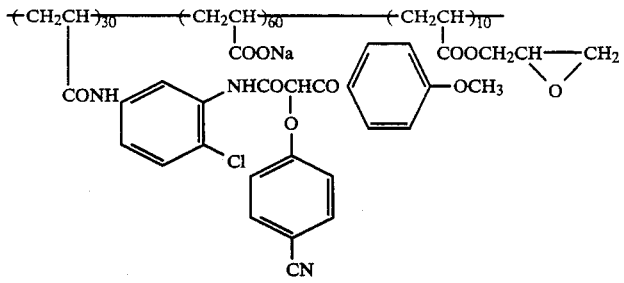
Y4-6
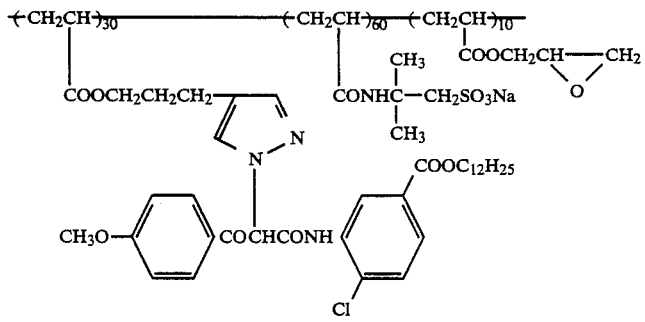
Y4-7
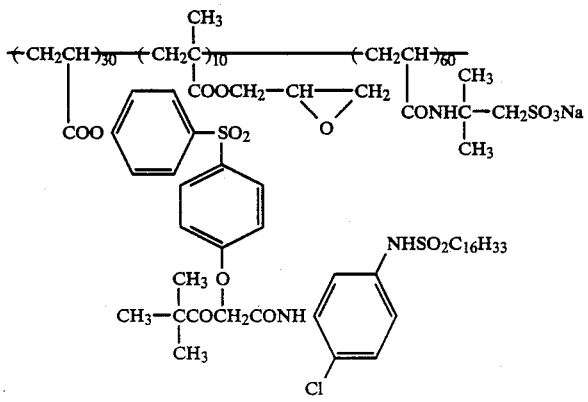

-continued
Polymeric Couplers Including the Repeating Unit
Represented by Formula (II-F)
Y4-8
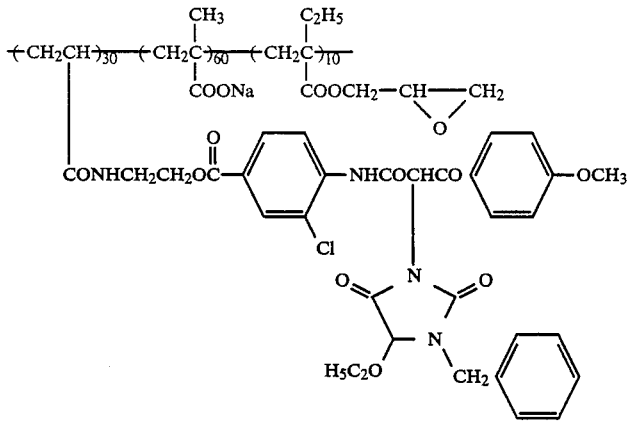
Y4-9
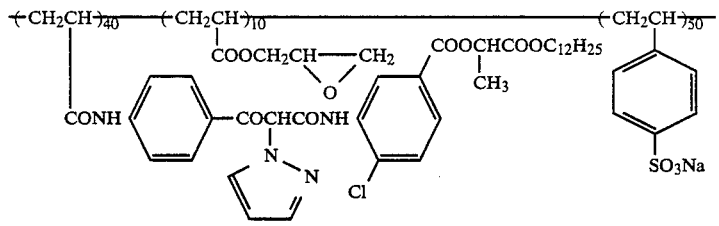
Y4-10
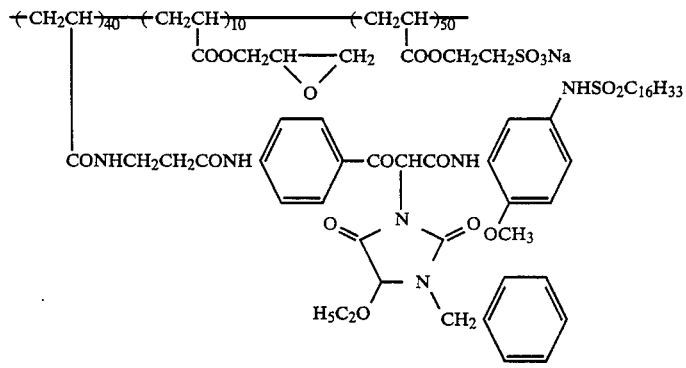
Y4-11
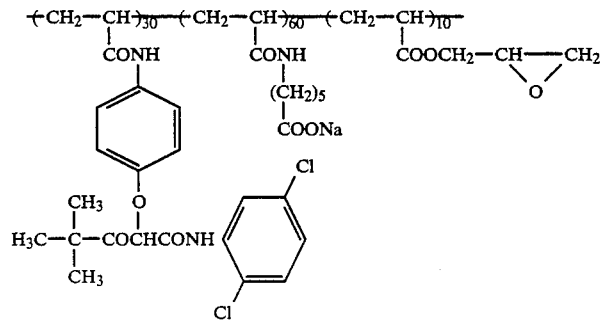

-continued
Polymeric Couplers Including the Repeating Unit Represented by Formula (II-F)
Y4-12
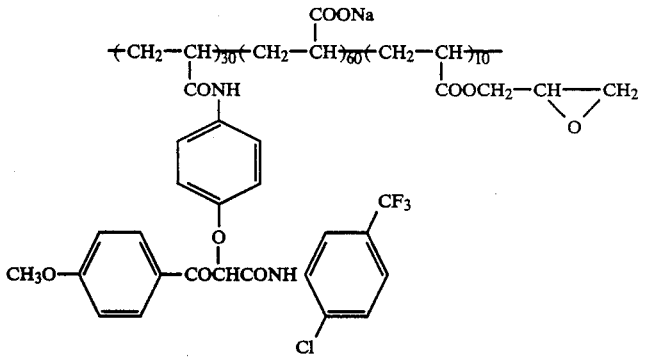
Y4-13
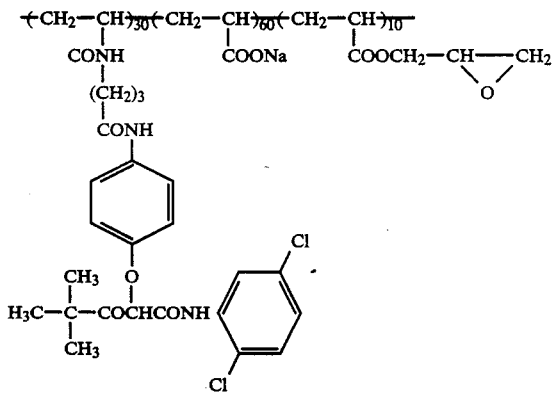
Y4-14
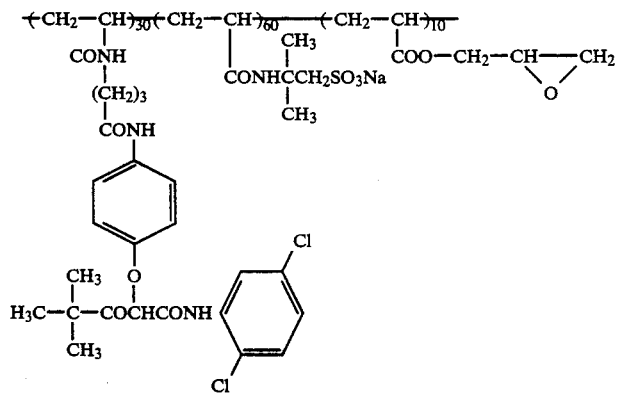
M4-1
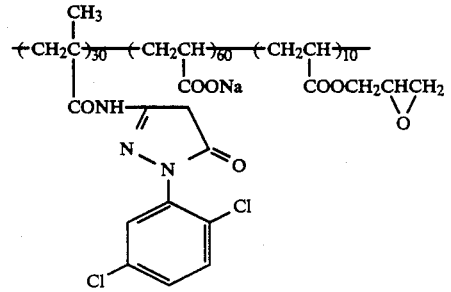

-continued
Polymeric Couplers Including the Repeating Unit Represented by Formula (II-F)
M4-2
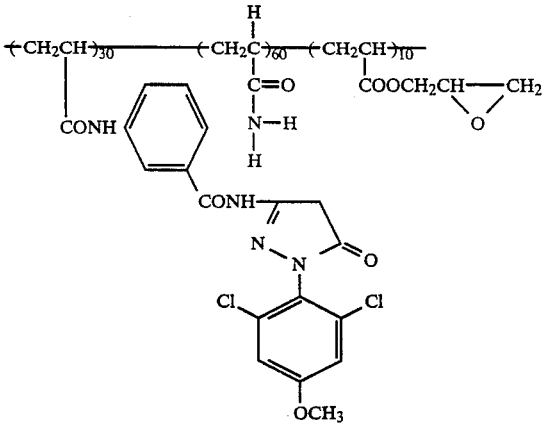
M4-3
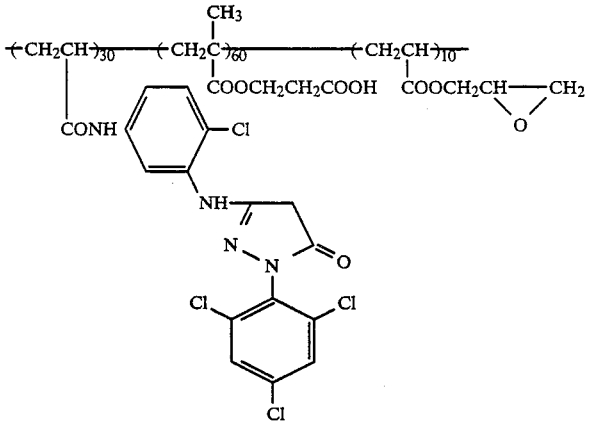
M4-4
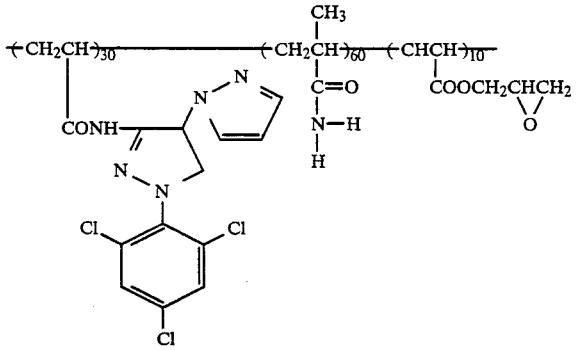
M4-5
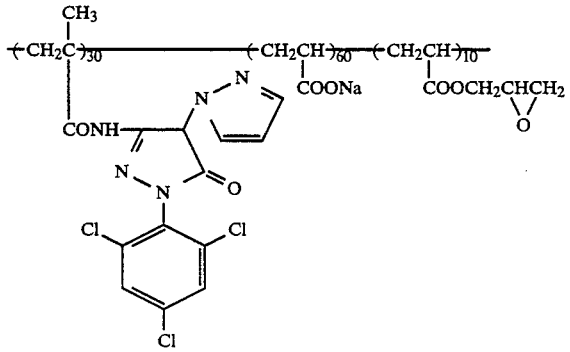

-continued
Polymeric Couplers Including the Repeating Unit Represented by Formula (II-F)
M4-6
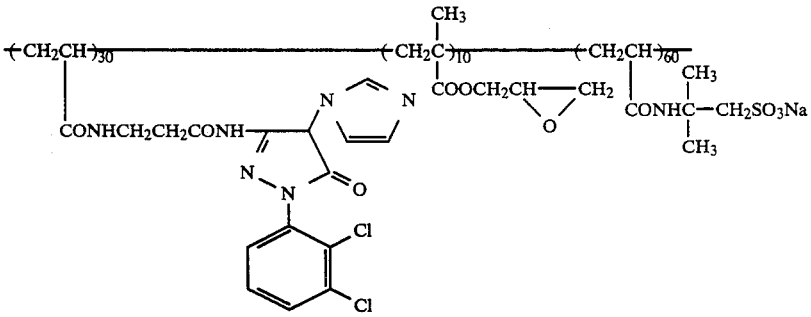
M4-7
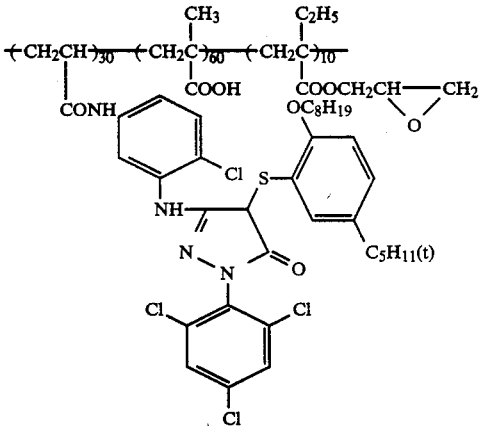
M4-8
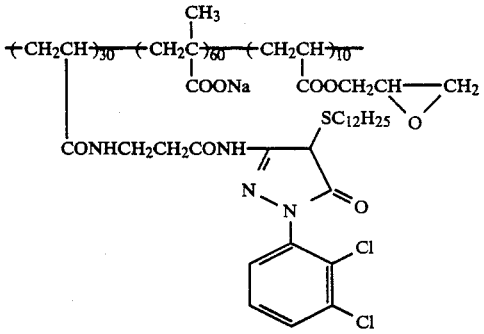
M4-9
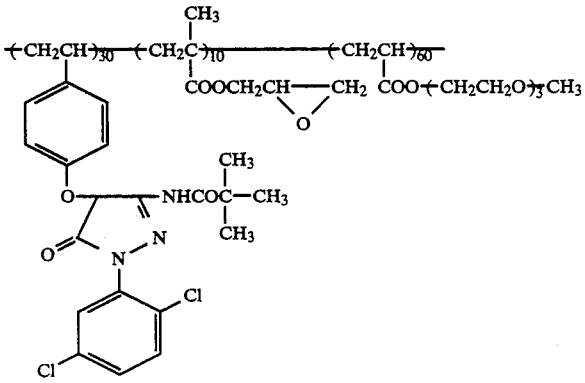

-continued
Polymeric Couplers Including the Repeating Unit Represented by Formula (II-F)
M4-10
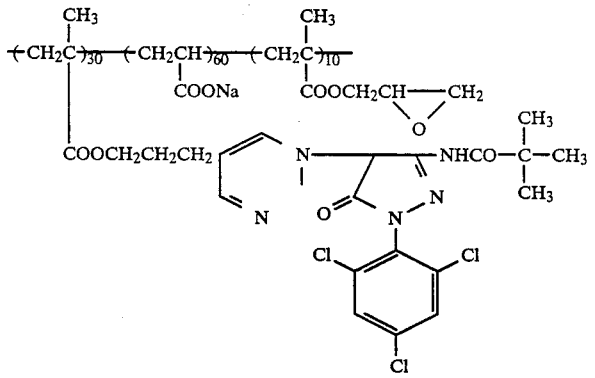
M4-11
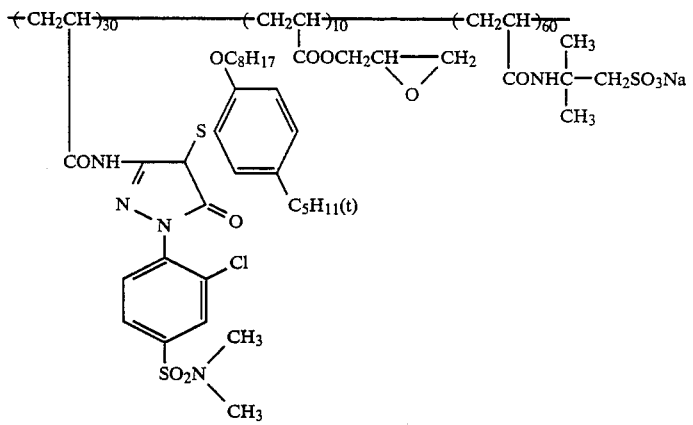
M4-12
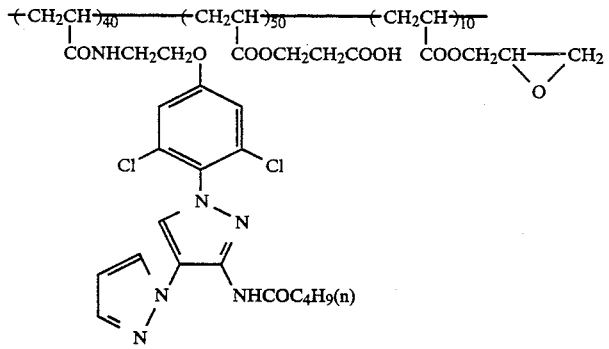
M4-13
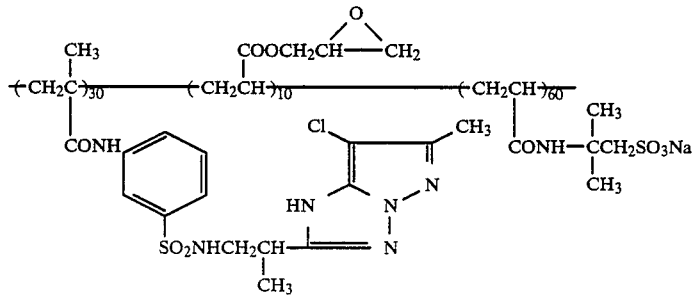

-continued
Polymeric Couplers Including the Repeating Unit Represented by Formula (II-F)
M4-14
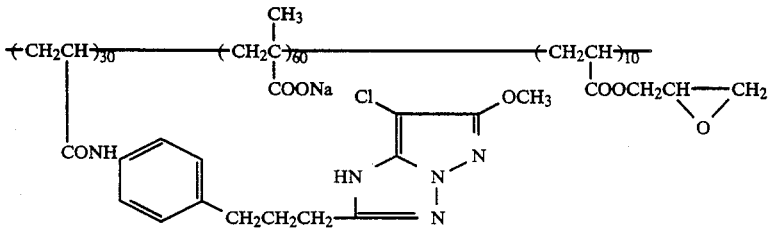
M-15
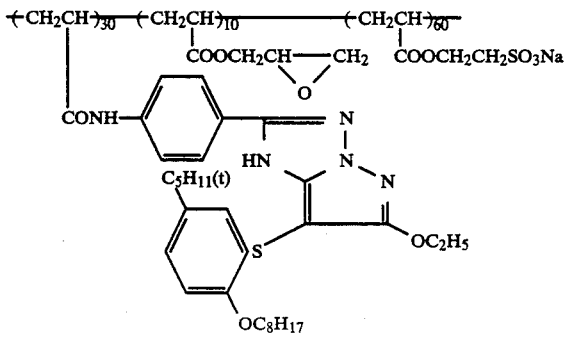
M4-16
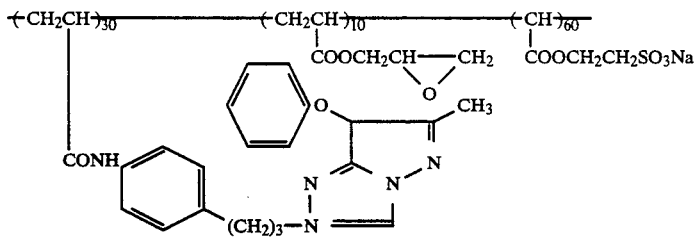
M4-17
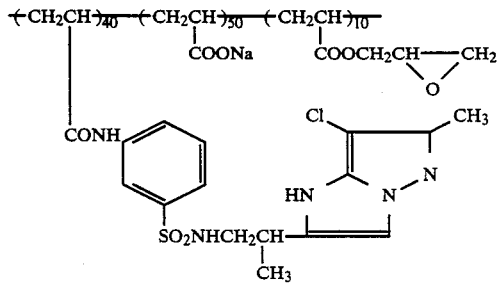
C4-1
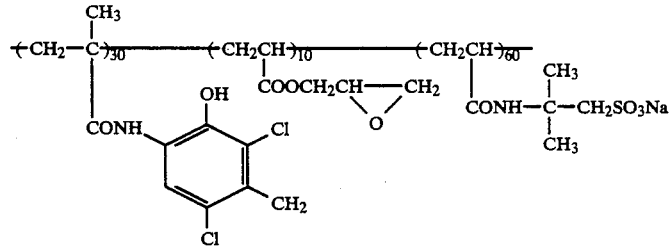
C4-3
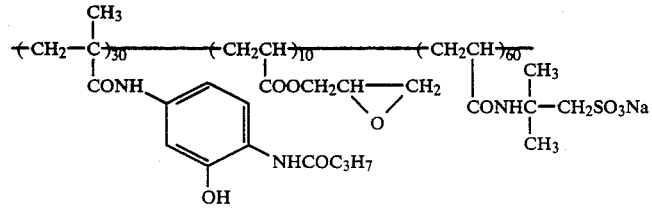

-continued
Polymeric Couplers Including the Repeating Unit Represented by Formula (II-F)
C4-2
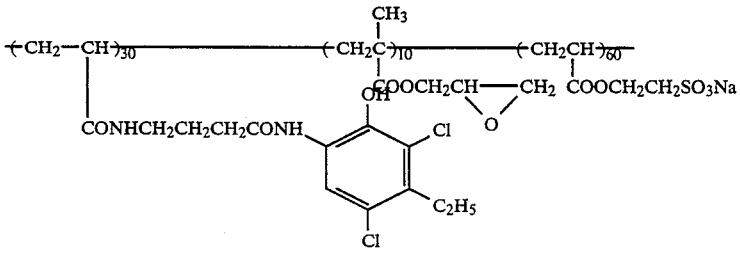
C4-4
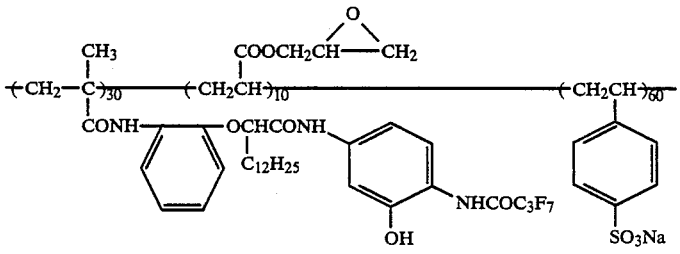
C4-6
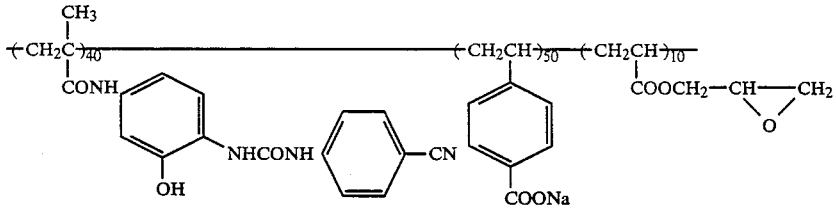
C4-5
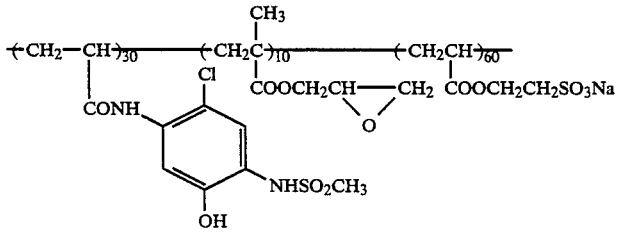
C4-7
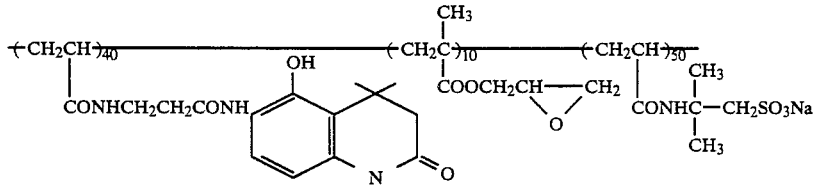
C4-9
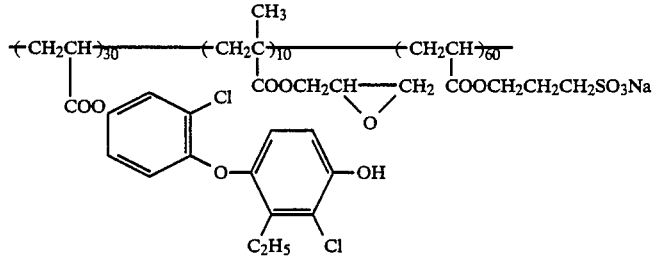
C4-8
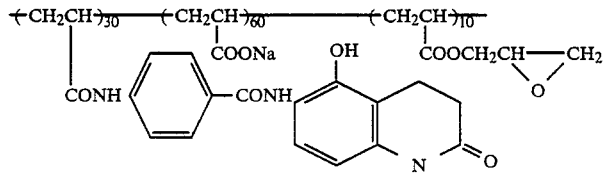

-continued
Polymeric Couplers Including the Repeating Unit Represented by Formula (II-F)
C4-10
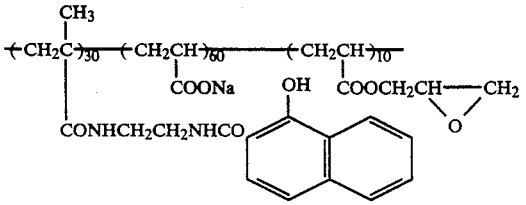
C4-11
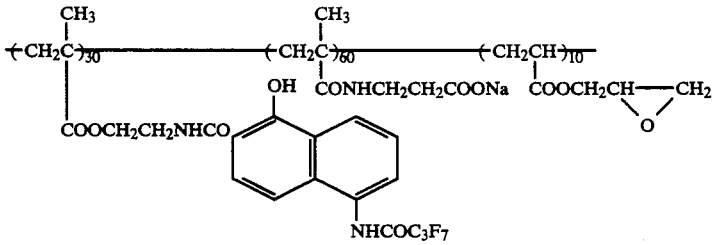
C4-12
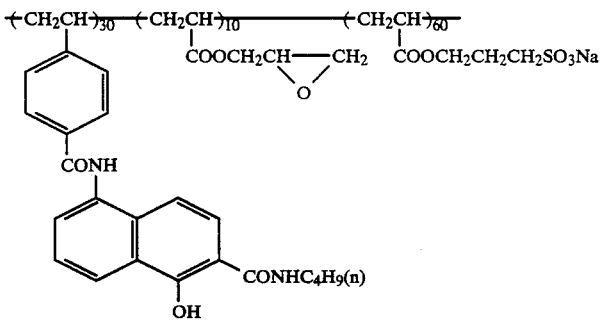
C4-13
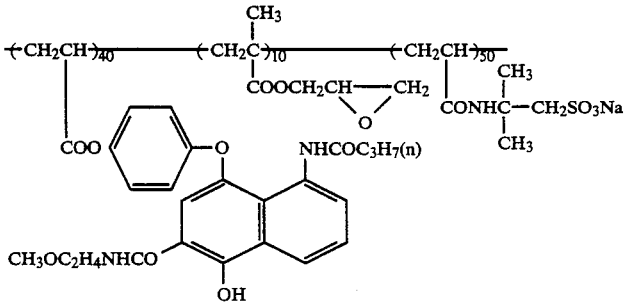
C4-14
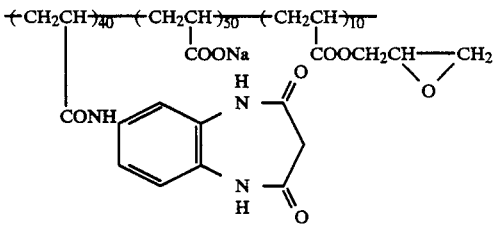
C4-15
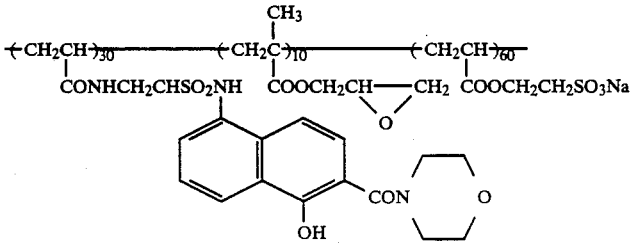

In the polymeric coupler used in the present invention, the molar ratio of the coupler portion (A) represented by formula (I) and the hardener portion (B) represented by formula (II-A)–(II-F) may be appropriately varied depending on the coating amount of silver, the coating amount of gelatin, the pH and viscosity of a coating emulsion, etc. However, it is preferable that (A) is from 10% to 95% and (B) is from 5% to 50%, and more preferable (A) is from 20% to 60% and (B) is from 5 to 30%.

The amount of the polymeric coupler to be used may also be appropriately varied. Ordinarily, it can be employed in a range preferably of from $5\times10^{-4}$ equivalent to $5\times10^{-2}$ equivalent, more preferably from $5\times10^{-4}$ equivalent to $1\times10^{-2}$ equivalent of the hardener portion (B) per 100 g of dry gelatin.

In the case of introducing a non-color forming ethylenic monomer as the third component, a ratio of the monomer may be variously varied depending on concentration of the coupler solution to be added and a method for adding the coupler, etc., but preferably from 5% by weight to 90% by weight based on the total weight of the polymer coupler.

It is advantageous in view of the photographic properties that the polymeric coupler according to the present invention is added to an emulsion layer in an amount from 1 to 200, and preferably from 5 to 100 calculated as a molar ratio of a coating amount of silver to the coupler portion (A). The coating amount of the polymeric coupler in the photographic material is preferably from 0.1 to 100 parts by weight per part by weight of gelatin contained in the same layer.

The molecular weight of the polymeric coupler according to the present invention is preferably from $5\times10^3$ to $1\times10^7$. When the molecular weight is too low, the polymer tends to migrate. On the other hand, when the molecular weight is excessively high, problems may occur during coating. A more preferred molecular weight is from $1\times10^4$ to $2\times10^6$.

In synthesis of the water soluble polymeric coupler according to the present invention, as polymerization initiators and polymerization solvents, compounds as described in Japanese Patent Application (OPI) Nos. 120252/83 (U.S. Pat. No. 4,474,870), 145944/83 (U.S. Pat. No. 4,436,808), 211756/83 (U.S. Pat. No.4,455,366), 224352/83, 42543/84 (U.S. Pat. No. 4,468,613), 171956/84 (U.S. Pat. No. 4,540,654), 228252/84 (U.S. Pat. No. 4,576,910), 35732/85 (U.S. Pat. No.4,576,910) and 46555/85 (U.S. Pat. No. 4,522,916), etc. can be employed.

The polymerization temperature should be determined taking the molecular weight of the polymer to be synthesized, and the kind of polymerization initiator, etc. into consideration. While it is possible from 0° C. or lower to 100° C. or higher, polymerization is ordinarily performed in a range of from 30° C. to 100° C.

Synthesis of the water-soluble polymeric couplers are specifically illustrated below.

SYNTHESIS EXAMPLE 1

Synthesis of Water-Soluble Polymeric Coupler $Y_1$-3

Into a 300 ml three-necked flask, were put 16 g of Monomer Coupler MC-36, 2 g of Hardener Monomer H-2, 22 g of sodium methacrylate and 200 ml of demethylformamide (DMF); the mixture was heated to 80° C. under nitrogen atmosphere and 5 ml of a DMF solution containing 0.4 g of dimethyl azobisisobutyrate was added thereto to initiate polymerization. After the polymerization for 3 hours, the mixture was cooled and dialyzed for 3 days using a dialysis membrane 50FTC-65 manufactured by Sanko Junyaku, followed by freeze drying to obtain 36.8 g of Polymeric Coupler $Y_1$-3. As the result of alkalimetry, it was found that the polymer contained 39.8% of the coupler monomer unit.

SYNTHESIS EXAMPLE 2

Synthesis of Water-Soluble Polymeric Coupler $Y_1$-4

Into a 300 ml three-necked flask, were put 20 g of Monomer Coupler MC-38, 3 g of Hardener Monomer H-3, 16 g of 2-methacrylamidopropionic acid and 220 ml of DMF, the mixture was heated at 80° C. under nitrogen atmosphere and 5 ml of a DMF solution containing 0.4 g of dimethyl azobisisobutyrate was added thereto to initiate polymerization. After the polymerization for 3 hours, the mixture was cooled and reprecipitated with 1,000 ml of acetone. After filtration and drying, 37.1 g of Polymer Coupler $Y_1$-4 was obtained. As the result of alkalimetry, it was found that the polymer contained 40.8% of the coupler monomer unit.

SYNTHESIS EXAMPLE 3

Synthesis of Water-Soluble Polymeric Coupler $Y_2$-1

Into a 300 ml three-necked flask, were put 20 g of Monomer Coupler MC-33, 3 g of Hardener Monomer II-2, 17 g of sodium 2-acrylamide -2-methylpropane sulfonate and 160 ml of DMF, the mixture was heated at 80° C. under nitrogen atmosphere and 5 ml of a DMF solution containing 0.4 g of dimethyl azobisisobutyrate was added thereto to initiate polymerization. After the polymerization for 3 hours, the mixture was cooled and reprecipitated with 1,000 ml of acetone. After filtration and drying, 36.2 g of Polymeric Coupler $Y_2$-1 was obtained. As the result of alkalimetry, it was found that the polymer contained 43.5% of the coupler monomer unit.

SYNTHESIS EXAMPLE 4

Synthesis of Water-Soluble Polymeric Coupler $Y_2$-3

Into a 300 ml three-necked flask, were put 20 g of Monomer Coupler MC-36 3 g of Hardener Monomer II-1, 22 g of sodium methylpropane and 200 ml of DMF, the mixture was heated at 80° C. under nitrogen atmosphere and 5 ml of a DMF solution containing 0.4 g of dimethyl azobisisobutyrate was added thereto to initiate polymerization. After the polymerization for 3 hours, the mixture was cooled and reprecipitated with 1,000 ml of acetone. After filtration and drying, 38.6 g of Polymeric Coupler $Y_2$-3 was obtained. As the result of alkalimetry, it was found that the polymer contained 37.2% of the coupler monomer unit.

SYNTHESIS EXAMPLE 5

Synthesis of Water-Soluble Polymeric Couler $Y_3$-3

Into a 300 ml three-necked flask, were put 20 g of Monomer Coupler MC-36, 3.5 g of Hardener Monomer H-10, 15 g of sodium methylpropane and 200 ml of DMF, the mixture was heated at 80° C. under nitrogen atmosphere and 5 ml of a DMF solution containing 0.4 g of dimethyl azobisisobutyrate was added thereto to initiate polymerization. After the polymerization for 3 hours, the mixture was cooled and reprecipitated with 1,000 ml of acetone. After filtration and drying, 38.0 g of Polymeric Coupler $Y_3$-3 was obtained. As the result of alkalimetry, it was found that the polymer contained 40.4% of the coupler monomer unit.

SYNTHESIS EXAMPLE 6

Synthesis of Water-Soluble Polymeric Coupler $Y_3$-4

Into a 300 ml three-necked flask, were put 18 g of Monomer Coupler MC-38, 2.5 g of Hardener Monomer H-3, 28 g of 3-methacrylamidopropionic acid and 250 ml of DMF, the mixture was heated at 80° C. under nitrogen atmosphere and 5 ml of a DMF solution containing 0.4 g of dimethyl azobisisobutyrate was added thereto to initiate polymerization. After the polymerization for 3 hours, the mixture was cooled and reprecipitated with 1,000 ml of acetone. After filtration and drying, 44.3 g of Polymeric Coupler $Y_3$-4 was obtained. As the result of alkalimetry, it was found that the polymer contained 34.3% of the coupler monomer unit.

SYNTHESIS EXAMPLE 7

Synthesis of Water-Soluble Polymeric Coupler $Y_4$-11

Into a 300 ml three-necked flask, were put 13 g of Monomer Coupler MC-85, 1 g of Hardener Monomer II-2, 12 g of sodium N-aryloyl-ε-amino-n-caproate and 160 ml of DMF, the mixture was heated at 80° C. under nitrogen atmosphere and 5 ml of a DMF solution containing 0.4 g of dimethyl azobisisobutyrate was added thereto to initiate polymerization. After the polymerization for 3 hours, the mixture was cooled and reprecipitated with 1,000 ml of acetone. After filtration and drying, 23.1 g of Polymeric Coupler $Y_4$-11 was obtained. As the result of alkalimetry, it was found that the polymer contained 48.0% of the coupler monomer unit.

SYNTHESIS EXAMPLE 8

Synthesis of Water-Soluble Polymeric Coupler $Y_4$-12

Into a 300 ml three-necked flask, were put 17 g of Monomer Coupler MC-89, 1 g of Hardener Monomer II-1, 6 g of sodium methacrylate and 200 ml of demethylformanide (DMF), the mixture was heated at 80° C. under nitrogen atmosphere and 5 ml of a DMF solution containing 0.4 g of dimethyl azobisisobutyrate was added thereto to initiate polymerization. After the polymerization for 3 hours, the mixture was cooled and dialyzed for 3 days using a dialysis membrane 50FTC-65 manufactured by Sanko Junyaku, followed by freeze drying to obtain 19.2 g of Polymeric Coupler $Y_4$-12. As the result of alkalimetry, it was found that the polymer contained 62 wt % of the coupler monomer unit.

The term "water-soluble" as used with respect to the polymeric coupler in the present invention means that the polymeric coupler obtained is soluble in water in a concentration of not less than 1.0% by weight at 25° C. It is preferred in view of production factors of a photographic material that the polymer is soluble in water in a concentration of not less than 10% by weight.

The polymeric coupler according to the present invention can be added to a coating solution as an aqueous solution thereof or it can be added by dissolving it in a solvent mixture of water and a water-miscible organic solvent such as a lower alcohol, tetrahydrofuran (THF), acetone, ethyl acetate, etc.

Further, it may be added by dissolving it in an alkaline aqueous solution or an organic solvent containing alkaline water. Moreover, it may be dispersed in a gelatin solution or by adding a small amount of a surface active agent.

In any case, it is believed that the water-soluble polymeric coupler according to the present invention does not form an oil droplet or latex in the coating solution and the coated layer, but interacts with a hydrophilic binder and is solubilized to each other to a certain extent. It is considered that based on such a reason layer strength is superior as compared with the case using an oil-soluble polymer coupler (including a latex form).

The polymeric coupler according to the present invention can be used individually or as a combination of two or more, as a hardener. Also, it may be employed together with one or more other hardeners heretofore known. Suitable examples of known hardeners include an aldehyde type compound such as formaldehyde, glutaraldehyde, etc., a ketone type compound such as diacetyl, cyclopentanedione, etc., a compound having an active halogen such as bis(2-chloroethylurea), 2-hydroxy-4,6-dichloro-1,3,5-triazine, and those as described in U.S. Pat. Nos. 3,288,775 and 2,732,303, British Patents 974,723 and 1,167,207, etc., a compound having an active olefin such as divinylsulfone, 5-acetyl-1,3-diacryloyl-hexahydro-1,3,5-triazine, and those as described in U.S. Pat. Nos. 3,635,718 and 3,232,763, British Patent No. 994,869, etc., an N-methylol compound such as N-hydroxymethylphthalimide, and those as described in U.S. Pat. Nos. 2,732,316 and 2,586,168, etc., an isocyanate such as those as described in U.S. Pat. No. 3,103,437, etc., an aziridine compound such as those as described in U.S. Pat. Nos. 3,017,280 and 2,983,611, etc., an acid derivative such as those as described in U.S. Pat. Nos. 2,725,294 and 2,725,295, etc., an epoxy compound such as those as described in U.S. Pat. No. 3,091,537, etc., and a halogencarboxyaldehyde such as mucochloric acid, etc. Also, an inorganic hardener such as chromium alum, zirconium sulfate, etc. may be employed. Further, in place of the above-described compound, a precursor thereof such as an alkali metal bisulfite aldehyde adduct, a methylol derivative of hydantoin, a primary aliphatic nitro alcohol, a mesyloxyethylsulfonyl type compound, a chloroethylsulfonyl type compound, etc. may be employed.

In the case of using the polymeric coupler according to the present invention together with other hardeners, the ratio of the polymeric coupler according to the present invention to be used can be appropriately selected depending on the intended purpose and effect.

The polymeric coupler according to the present invention can be employed together with a compound capable of acclerating hardening of gelatin. For instance, in a system of the polymer coupler according to the present invention and a vinylsulfone type hardener, a polymer containing a sulfinic acid group as described in Japanese Patent Application(OPI) No. 4141/81 (U.S. Pat. No. 4,294,921)is used together as a hardening accelerating agent.

Gelatin which can be used together with the polymeric coupler according to the present invention may be any of so-called alkali-processed (lime-processed) gelatin which is produced by immersing in an alkaline bath before gelatin extraction, acid-processed gelatin produced by immersing in an acid bath, double-immersed gelatin effected both processings and enzyme-processed gelatin. Further, low molecular weight gelatin which is obtained by heating the above-described gelatin in water or applying a proteolytic enzyme to the above-described gelatin to be subjected to partial hydrolysis may be employed.

As a binder or a protective colloid for emulsion layers or intermediate layers of the photographic light-sensitive material of the present invention, gelatin is advantageously used, but other synthetic polymers may be employed as the binder in combination with gelatin.

In the case of adding the polymeric coupler according to the present invention to a coating solution for a light-sensitive emulsion layer or a light-insensitive layer, when the coating solution is allowed to stand for a long period of time after the addition, a crosslinking reaction between gelatin and the polymer coupler according to the present invention occasionally occurs and viscosity of the coating solution remarkably increases. As the result, it is difficult to maintain good coating property.

Therefore, the polymeric coupler used in the present invention is usually added to the coating solution within 60 minutes, and preferably within 30 minutes, before coating. It is particularly preferred to add just before coating.

Some of the polymeric couplers are preferably reacted with gelatin to a certain extent and then coated.

Moreover, it is preferred that the polymeric coupler according to the present invention is dissolved in a solvent and the resulting solution is coated, since physical properties of the coating solution do not change. In this case, the polymeric coupler diffuses into a gelatin containing layer, reacts with gelatin, and is immobilized during drying of the coating.

In the photographic emulsion layers of the photographic light-sensitive material used in the present invention, any of silver bromide, silver iodobromide, silver iodochlorobromide, silver chlorobromide and silver chloride may be used as silver halide.

Silver halide grains in the silver halide emulsion may have a regular crystal structure, for example, a cubic, octahedral or tetradecahedral structure, etc., an irregular crystal structure, for example, a spherical or tabular structure, etc., a crystal defect, for example, a twin plane, etc., or a composite structure thereof.

A grain size of silver halide may be varied and include from fine grains having about 0.2 micron or less to large size grains having about 10 microns of a diameter of projected area. Further, a polydispersed emulsion and a monodispersed emulsion may be used.

The silver halide photographic emulsion used in the present invention can be prepared using known methods, for example, those as described in *Research Disclosure,* No. 17643 (December 1978), pages 22 to 23, "I. Emulsion Preparation and Types" and ibid., No. 18716 (November 1979), page 648, P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photohraphic Emulsion,* The Focal Press (1964), etc.

Monodispersed emulsions as described in U.S. Pat. Nos. 3,574,628 and 3,655,394, British Patent No. 1,413,748, etc. are preferably used in the present invention.

Further, tabular silver halide grains having an aspect ratio of about 5 or more can be employed in the present invention. The tabular grains may be easily prepared by the method as described in Gutoff, *Photographic Science and Engineering,* Vol. 14, pages 248 to 257 (1970), U.S. Pat. Nos. 4,434,226, 4,414,310, 4,433,048 and 4,439,520, British Patent No. 2,112,157, etc.

Crystal structure of silver halide grains may be uniform, composed of different halide compositions between the inner portion and the outer portion, or may have a stratified structure.

Further, silver halide emulsions in which silver halide grains having different compositions are connected upon epitaxial junctions or silver halide emulsions in which silver halide grains are connected with compounds other than silver halide such as silver thiocyanate, lead oxide, etc. may also be employed.

Moreover, a mixture of grains having a different crystal structure may be used.

The silver halide emulsions used in the present invention are usually conducted with physical ripening, chemical ripening and spectral sensitization. Various kinds of additives which can be employed in these steps are described in *Research Disclosure,* No. 17643 (December 1978) and ibid., No. 18716 (November 1979) and concerned items thereof ar summarized in the table shown below.

Further, known photographic additives which can be used in the present invention are also described in the above mentioned literature and concerned items thereof are summarized in the table below.

| Kind of Additives | RD 17643 | RD 18716 |
|---|---|---|
| 1. Chemical Sensitizers | Page 23 | Page 648, right column |
| 2. Sensitivity Increasing Agents | | Page 648, right column |
| 3. Spectral Sensitizers and Super Sensitizers | Pages 23 to 24 | Page 648, right column to page 649, right column |
| 4. Whitening Agents | Page 24 | |
| 5. Antifoggants and Stabilizers | Pages 24 to 25 | Page 649, right column |
| 6. Light-Absorbers, Filter Dyes and Ultraviolet Ray Absorbers | Pages 25 to 26 | Page 649, right column to page 650, left column |
| 7. Antistaining Agents | Page 25, right column | Page 650, left column to right column |
| 8. Dye Image Stabilizers | Page 25 | |
| 9. Hardeners | Page 26 | Page 651, left column |
| 10. Binders | Page 26 | Page 651, left column |
| 11. Plasticizers and Lubricants | Page 27 | Page 650, right column |
| 12. Coating Aids and Surfactants | Pages 26 to 27 | Page 650, right column |
| 13. Antistatic Agents | Page 27 | Page 650, right column |

In the present invention, various color couplers can be employed and specific examples thereof are described in the patents cited in *Research Disclosure,* No. 17643, "VII-C" to "VII-G".

As yellow couplers used in the present invention, for example, those as described in U.S. Pat. Nos. 3,933,501, 4,022,620, 4,326,024 and 4,401,752, Japanese Patent Publication No. 10739/83, British Patent Nos. 1,425,020 and 1,476,760, etc. are preferred.

As magenta couplers used in the present invention, 5-pyrazolone type and pyrazoloazole type compounds are preferred. Magenta couplers as described in U.S. Pat. Nos.4,310,619 and 4,351,897, European Patent No. 73,636, U.S. Pat. Nos. 3,061,432 and 3,725,067, *Research Disclosure,* No. 24220 (June 1984), Japanese Patent Application (OPI) No. 33552/85, *Research Disclosure,* No. 24230 (June 1984), Japanese Patent Application (OPI) No. 43659/85, U.S. Pat. Nos. 4,500,630 and 4,540,654, etc. are particularly preferred.

As cyan couplers used in the present invention, phenol type and naphthol type couplers are exemplified. Cyan couplers as described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, European Patent No. 121,365A, U.S. Pat. Nos. 3,446,622, 4,333,999, 4,451,559 and 4,427,767, European Patent No. 161,626A, etc., are preferred.

As colored couplers for correcting undesirable absorptions of dyes formed, those as described in *Research Disclosure,* No. 17643, "VII-G" U.S. Pat. No. 4,163,670, Japanese Patent Publication No. 39413/82, U.S. Pat. Nos. 4,004,929 and 4,138,258, British Patent No. 1,146,368, etc. are preferably employed.

As couplers capable of forming appropriately diffusible dyes, those as described in U.S. Pat. No. 4,366,237, British Patent No. 2,125,570, European Patent No. 96,570, West German Patent Application (OLS) No. 3,234,533, etc. are preferably employed.

Typical examples of polymerized dye forming couplers are described in U.S. Pat. Nos. 3,451,820, 4,080,211 and 4,367,282, British Patent No. 2,102,173, etc.

Couplers capable of releasing a photographically useful residue during the course of coupling can be also employed preferably in the present invention. As DIR couplers capable of releasing a development inhibitor, those as described in the patents cited in *Research Disclosure,* No. 17643, "VII-F" described above, Japanese Patent Application (OPI) Nos. 151944/82, 154234/82 and 184248/85, U.S. Pat. No. 4,248,962, etc. are preferred.

As couplers which release imagewise a nucleating agent or a development accelerator at the time of development, those as described in British Patent Nos. 2,097,140 and 2,131,188, Japanese Patent Application (OPI) Nos. 157638/84 and 170840/84, etc. are preferred.

Furthermore, competing couplers such as those described in U.S. Pat. No. 4,130,427, etc., poly-equivalent couplers such as those described in U.S. Pat. Nos. 4,283,472, 4,338,393 and 4,310,618, etc., DIR redox compound releasing couplers such as those described in Japanese Patent Application (OPI) No. 185950/85, etc., couplers capable of releasing a dye which turns to a colored form after being released such as those described in European Patent No. 173,302A, etc., and the like may be employed in the photographic light-sensitive material of the present invention.

The couplers which can be used in the present invention can be introduced into the photographic light-sensitive material according to various known dispersing methods.

Suitable examples of organic solvent having a high boiling point which can be employed in an oil droplet-in-water type dispersing method are described in U.S. Pat. No. 2,322,027, etc.

The processes and effects of latex dispersing methods and the specific examples of latexes for loading are described in U.S. Pat. No. 4,199,363, West German Patent Application (OLS) Nos. 2,541,274 and 2,541,230, etc.

Suitable supports which can be used in the present invention are described, for example, in *Research Disclosure,* No. 17643, page 28 and ibid., No. 18716, page 647, right column to page 648, left column, as mentioned above.

The color photographic light-sensitive material according to the present invention can be sub]ected to development processing in a conventional manner as described in *Research Disclosure.* No. 17643, pages 28 to 29 and ibid., No. 18716, page 651, left column to right column, as mentioned above.

A color developing solution which can be used in development processing of the color photographic light-sensitive material according to the present invention is an alkaline aqueous solution containing preferably an aromatic primary amine type developing agent as a main component. As the color developing agent, while an aminophenol type compound is useful, a p-phenylenediamine type compound is preferably employed. Typical examples of the p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, or sulfate, hydrochloride, p-toluenesulfonate thereof, etc.

Two or more kinds of color developing agents may be employed in a combination thereof, if desired.

The color developing solution can ordinarily contain pH buffering agents, such as carbonates, borates or phosphates of alkali metals, etc.; and development inhibitors or anti-fogging agents such as bromides, iodides, benzimidazoles, benzothiazoles or mercapto compounds, etc. Further, if necessary, the color developing solution may contain various preservatives such as, hydroxylamine, diethylhydroxylamine, sulfites, hydrazines, phenylsemicarbazides, triethanolamine, catechol sulfonic acids, triethylenediamine(1,4diazabicyclo[2,2,-2]octane), etc.; organic solvents such as ethylene glycol, diethylene glycol, etc.; development accelerators such as benzyl alcohol, polyethylene glycol, quarternary ammonium salts, amines, etc.; dye forming couplers; competing couplers; fogging agents such as sodium borohydride, etc.; auxiliary developing agents such as 1-phenyl-3-pyrazolidone, etc.; viscosity imparting agents; and various chelating agents represented by aminopolycarboxylic acids, aminopolyphosphonic acids, alkylphosphonic acids, phosphonocarboxylic acids, etc. Representative examples of the chelating agents include ethylenediaminetetraacetic acid, nitrilotriacetic acid, diethylenetriaminepentaacetic acid, cyclohexanediaminetetraacetic acid, hydroxyethyl iminodiacetic acid, 1-hydroxyethylidene-1,1-diphosphonic acid, nitrilo-N,N,N -trimethylenephosphonic acid, ethylenediamine-N,N,N',N'-tetramethylenephosphonic acid, ethylenediamine-di(o-hydroxyphenylacetic acid), and salts thereof.

In case of development processing for reversal color light-sensitive materials, color development is usually conducted after black-and-white development. In a black-and-white developing solution, known black-and-white developing agents, for example, dihydroxybenzenes such as hydroquinone, etc., 3-pyrazolidones such as 1-phenyl- 3-pyrazolidone, etc., or aminophenols such as N-methyl-p-aminophenol, etc. may be employed individually or in a combination.

The pH of the color developing solution or the black-and-white developing solution is usuallly in a range from 9 to 12. Further, an amount replenishment for the developing solution can be varied depending on color photographic light-sensitive materials to be processed, but is generally not more than 3 liters per square meter of the photographic light-sensitive material. The amount of replenishment can be reduced to not more than 500 ml by decreasing a bromide ion concentration in the replenisher. In the case of reducing the amount of replenishment, it is preferrred to prevent evaporation and aerial oxidation of the processing solution by means of reducing an area of a processing tank which is contact with the air. Further, the amount of replenishment can be reduced using a means which restrain accumulation of bromide ion in the developing solution.

After color development, the photographic emulsion layers are usually subjected to a bleach processing. The bleach processing can be performed simultaneously with a fix processing (bleach-fix processing), or it can be performed independently from the fix processing. Further, for the purpose of a rapid processing, a processing method wherein after a bleach processing a bleach-fix processing is conducted may be employed. Moreover, it may be appropriately practiced depending on the purpose to process using a continuous two tank bleach-fixing bath, to carry out fix processing before bleach-fix processing, or to conduct bleach processing after bleach-fix processing.

Examples of bleaching agents which can be employed in the bleach processing or bleach-fix processing include compounds of a multivalent metal such as iron(III), cobalt(III), chromium(VI), copper(II), etc.; peracids; quinones; nitro compounds; etc. Representative examples of the bleaching agents include ferricyanides; dichloromates; organic complex salts of iron(III) or cobalt(III), for example, complex salts of aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid, etc.), or complex salts of organic acids such as citric acid, tartaric acid, malic acid, etc.); persulfates; bromates; permanganates; nitrobenzenes; etc. Of these compounds, iron(III) complex salts of aminopolycarboxylic acids represented by iron(III) complex salt of ethylenediaminetetraacetic acid and persulfates are preferred in view of rapid processing and less environmental pollution. Furthermore, iron(III) complex salts of aminopolycarboxylic acids are particularly useful in both bleaching solutions and bleach-fixing solutions.

The pH of the bleaching solution or bleach-fixing solution containing an iron(III) complex salt of aminopolycarboxylic acid is usually in a range from 5.5 to 8. For the purpose of rapid processing, it is possible to process at pH lower than the above described range.

In the bleaching solution, the bleach-fixing solution or a prebath thereof, a bleach accelerating agent can be used, if desired. Specific examples of suitable bleach accelerating agents include compounds having a mercapto group or a disulfide group as described in U.S. Pat. No. 3,893,858, West German Patent Nos. 1,290,812 and 2,059,988, Japanese Patent Application (OPI) Nos. 32736/78, 57831/78, 37418/78, 72623/78, 95630/78, 95631/78, 104232/78, 124424/78, 141623/78 and 28426/78, Research Disclosure, No. 17129 (July 1978), etc.; thiazolidine derivatives as described in Japanese Patent Application (OPI) No. 140129/75, etc.; thiourea derivatives as described in Japanese Patent Publication No. 8506/70, Japanese Patent Application (OPI) Nos. 20832/77 and 32735/78, U.S. Pat. No. 3,706,561, etc.; iodides as described in West German Patent No. 1,127,715, Japanese Patent Application (OPI) No. 16235/83, etc.; polyoxyethylene compounds as described in West German Patent Nos. 966,410 and 2,748,430, etc.; polyamine compounds as described in Japanese Patent Publication No. 8836/70, etc.; compounds as described in Japanese Patent Application (OPI) Nos. 42434/74, 59644/74, 94927/78, 35727/79, 26506/80 and 163940/83; and bromide ions. Of these compounds, the compounds having a mercapto group or a disulfide group are preferred in view of their large bleach accelerating effects. Particularly, the compounds as described in U.S. Pat. No. 3,893,858, West German Patent No. 1,290,812 and Japanese Patent Application (OPI) No. 95630/78 are preferred. Further, the compounds as described in U.S. Pat. No. 4,552,834 are also preferred. These bleach accelerating agents may be incorporated into the color photographic light-sensitive material. These bleach accelerating agents are particularly effectively employed when color photographic light-sensitive materials for photographing are subjected to bleach-fix processing.

As fixing agents which can be employed in the fixing solution or bleach-fixing solution, thiosulfates, thiocyanate, thioether compounds, thioureas, a large amount of iodide, etc., are exemplified. Of these compounds, thiosulfates are generally employed. Particularly, ammonium thiosulfate is most widely employed. It is preferred to use sulfites, bisulfites or carbonyl-bisulfite adducts as preservatives in the bleach-fixing solution.

After a desilvering step such as fixing or bleach-fixing, etc., the silver halide color photographic material according to the present invention is generally subjected to a water washing step and/or a stabilizing step.

An amount of water required for the water washing step may be set in a wide range depending on characteristics of photographic light-sensitive materials (due to substances used therein, for example, couplers, etc.), uses thereof, temperature of washing water, a number of water washing tanks (stages), a replenishment system such as countercurrent or orderly current, etc., or other various conditions. The relationship between the number of water washing tanks and an amount of water in a multistage countercurrent system can be determined based on the method as described in *Journal of the Society of Motion Picture and Television Engineers,* Vol. 64, pages 248 to 253 (May, 1955).

According to the multi-stage countercurrent system described in the above literature, the amount of water for washing can be significantly reduced. However, increase in staying time of water in a tank causes propagation of bacteria, and problems such as adhesion of floatage formed on the photographic materials, etc. occur. In the method of processing the silver halide color photographic material according to the present invention, a method for reducing amounts of calcium and magnesium as described in Japanese Patent Application No. 131632/86 can be particularly effectively employed in order to solve such problems. Further, sterilizers, for example, isothiazolone compounds as described in Japanese Patent Application (OPI) No. 8542/82, cyabendazoles, chlorine type sterilizers such as sodium chloroisocyanurate, etc., benzotriazoles, sterilizers as described in Hiroshi Horiguchi, *Bokin-Bobai No Kagaku, Biseibutsu No Mekkin-, Sakkin-, Bobai-Gijutsu,* edited by Eiseigijutsu Kai, *Bokin-Bobaizai Jiten,* edited by Nippon Bokin-Bobai Gakkai, etc. can be employed.

The pH of the washing water used in the processing of the photographic light-sensitive materials according to the present invention is usually from 4 to 9, and preferably from 5 to 8. Temperature of washing water and time for a water washing step can be variously set depending on characteristics or uses of photographic light-sensitive materials, etc. However, it is general to select a range of from 15° C. to 45° C. and a period from 20 sec. to 10 min. and preferably a range of from 25° C. to 40° C. and a period from 30 sec. to 5 min.

The photographic light-sensitive material of the present invention can also be directly processed with a stabilizing solution in place of the above-described water washing step. In such a stabilizing process, any of known methods as described in Japanese Patent Application (OPI) Nos. 8543/82, 14834/83, 184343/84, 220345/85, 238832/85, 239784/85, 239749/85, 4054/86 and 118749/86, etc. can be employed. Particularly, a stabilizing bath containing 1-hydroxyethylidene-1,1-diphosphonic acid, 5-chloro-2-methyl-4-isothiazolin-3-one, a bismuth compound, or an ammonium compound, etc. is preferably used.

Further, it is possible to conduct the stabilizing process subsequent to the above-described water washing process. One example is a stabilizing bath containing formalin and a surface active agent, which is employed as a final bath in the processing of color photographic light-sensitive materials for photographing.

The present invention is described in detail with reference to the following examples, but the present invention is not to be construed as being limited thereto.

EXAMPLE 1

Sample 101

On a cellulose triacetate film support provided with a subbing layer was coated each layer having the composition set forth below to prepare a multilayer color photographic light-sensitive material which was designated as Sample 101.

| | |
|---|---|
| First Layer: Emulsion Layer | |
| Monodispersed silver iodobromide emulsion (silver iodide: 4 mol %, average particle size: 0.5 μm, coefficient of variation: 14%) | 0.8 g/m$^2$ |
| Gelatin | 1.0 g/m$^2$ |
| Second Layer: Stripping Layer | |
| Hydroxyethylcellulose | 0.2 g/m$^2$ |
| Third Layer: Coupler Containing Layer | |
| Monodispersed silver iodobromide emulsion (same as in the first layer) | 0.8 g/m$^2$ |
| Coupler A-1 | 1.0 g/m$^2$ |
| Gelatin | 1.0 g/m$^2$ |
| Fourth Layer: Protective Layer | |
| Gelatin | 0.8 g/m$^2$ |
| Polymethyl acrylate particle | 0.2 g/m$^2$ |
| Hardener H-1 | 0.4 g/m$^2$ |

Samples 102, 103, A-104 to 110, B-104 to 110, C-104 to 110, and D-104 to 112:

Samples were prepared in the same manner as described for Sample 101, except using the couplers shown in Table 1 below in an equimolar amount of the coupler moiety in place of Coupler A-1 in the third layer of Sample 101, respectively.

The polymer coupler used in the example was supplied to the coating solution 20 minutes before the coating thereof as a 5% by weight aqueous solution thereof.

The compounds used for comparison were as follows: (The amounts of monomer units in polymers used in Examples are shown in weight ratio in the formula thereof, and the mean molecular weight of polymeric couplers used in Examples was about 150 000.)

Coupler A-1:

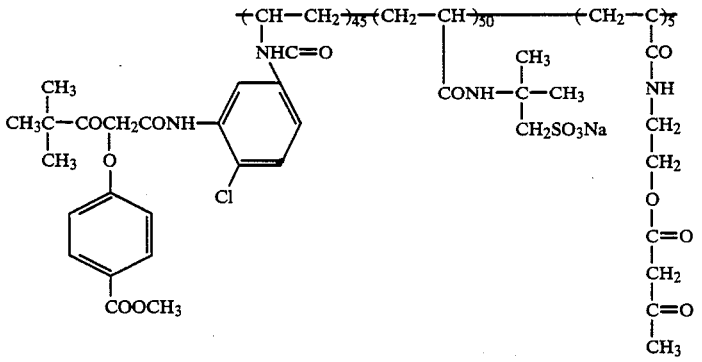

(Compound as described in U.S. Pat. No. 4,215,195)

Coupler A-2:

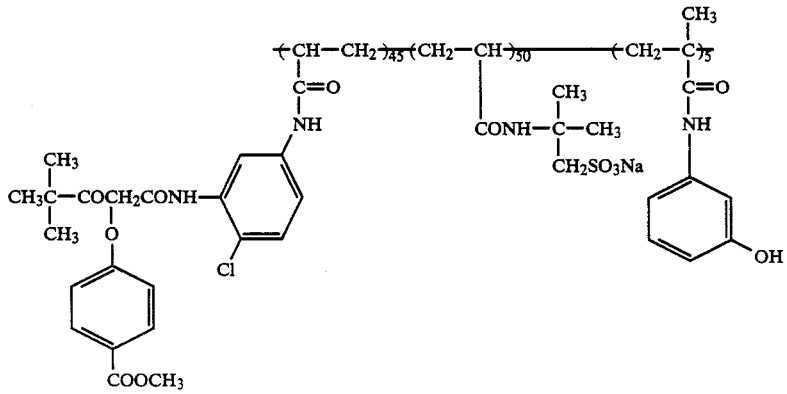

(Compound as described in U.S. Pat. No. 4,207,109)

-continued

Coupler A-3:

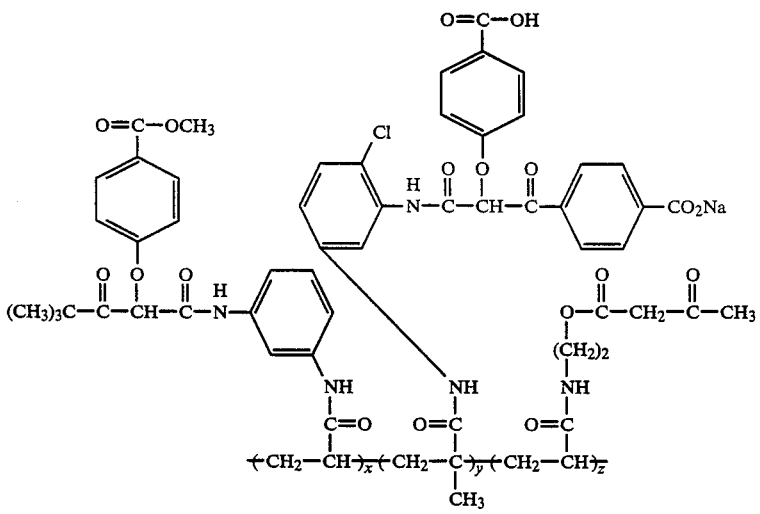

(x = 30% by weight) (y = 60% by weight) (z = 10% by weight)
(Compound as described in Japanese Patent Application (OPI) No. 28744/83)

Each of Samples thus-prepared was cut into two parts, and one part was directly and the other part was after peeling apart from the stripping layer subjected to development processing at 38° C. according to the processing steps shown below With each sample thus-processed, yellow density ($D_1$) of the part not-peeled off and yellow density ($D_2$) of the part peeled off were measured and the ratio of these densities was determined for measuring the degree of diffusion of the coupler into the other layer The results thus-obtained are shown in Table 1 below It can be seen from the results shown in Table 1 that the couplers according to the present invention are less diffusible to other layers

TABLE 1

| Sample No. | Coupler No. | $D_1/D_2$ |
|---|---|---|
| 101 (Cmparison) | A-1 | 0.23 |
| 102 (") | A-2 | 0.25 |
| 103 (") | A-3 | 0.28 |
| A-104 (Present Invention) | $Y_1$-2 | 0.09 |
| A-105 (") | $Y_1$-3 | 0.11 |
| A-106 (") | $Y_1$-4 | 0.08 |
| A-107 (") | $Y_1$-6 | 0.10 |
| A-108 (") | $Y_1$-7 | 0.07 |
| A-109 (") | $Y_1$-11 | 0.07 |
| A-110 (") | $Y_1$-12 | 0.08 |
| B-104 | $Y_2$-1 | 0.12 |
| B-105 | $Y_2$-2 | 0.08 |
| B-106 | $Y_2$-3 | 0.09 |
| B-107 | $Y_2$-4 | 0.10 |
| B-108 | $Y_2$-7 | 0.11 |
| B-109 | $Y_2$-11 | 0.09 |
| B-110 | $Y_2$-12 | 0.08 |
| C-104 | $Y_3$-3 | 0.11 |
| C-105 | $Y_3$-4 | 0.13 |
| C-106 | $Y_3$-6 | 0.09 |
| C-107 | $Y_3$-7 | 0.09 |
| C-108 | $Y_3$-9 | 0.10 |
| C-109 | $Y_3$-11 | 0.08 |
| C-110 | $Y_3$-12 | 0.08 |
| D-104 | $Y_4$-1 | 0.08 |
| D-105 | $Y_4$-2 | 0.07 |
| D-106 | $Y_4$-3 | 0.07 |
| D-107 | $Y_4$-4 | 0.09 |
| D-108 | $Y_4$-7 | 0.08 |
| D-109 | $Y_4$-11 | 0.07 |
| D-110 | $Y_4$-12 | 0.06 |
| D-111 | $Y_4$-13 | 0.07 |

TABLE 1-continued

| Sample No. | Coupler No. | $D_1/D_2$ |
|---|---|---|
| D-112 | $Y_4$-14 | 0.08 |

| Processing Step | Time |
|---|---|
| Color Development | 3 min. 15 sec. |
| Bleaching | 6 min. 30 sec. |
| Washing with Water | 2 min. 10 sec. |
| Fixing | 4 min. 20 sec. |
| Washing with Water | 3 min. 15 sec. |
| Stabilizing | 1 min. 05 sec. |

The composition of the processing solution used in each step is illustrated below.

| Color Developing Solution: | |
|---|---|
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-Ethyl-N-β-hydroxyethylamino)-2-methylaniline sulfate | 4.5 g |
| Water to make | 1.0 liter |
| pH | 10.0 |

| Bleaching Solution: | |
|---|---|
| Iron (III) ammonium ethylenediaminetetraacetate | 100.0 g |
| Disodium ethylenediaminetetraacetate | 10.0 g |
| Ammonium bromide | 150.0 g |
| Ammonium nitrate | 10.0 g |
| Water to make | 1.0 liter |
| pH | 6.0 |

| Fixing Solution: | |
|---|---|
| Disodium ethylenediaminetetraacetate | 1.0 g |

-continued

| | |
|---|---|
| Sodium sulfite | 4.0 g |
| Ammonium thiosulfate (70% aq. soln.) | 175.0 ml |
| Sodium bisulfite | 4.6 g |
| Water to make | 1.0 liter |
| pH | 6.6 |

| Stabilizing Solution: | |
|---|---|
| Polyoxyethylene-p-monononylphenylether (average degree of polymerization: 10) | 0.3 g |
| Disodium ethylenediaminetetraacetate | 0.05 g |
| 5-Chloro-2-methyl-4-isothiazolin-3-one | 0.03 g |
| Water to make | 1.0 liter |

Washing Water

City water which was passed through a column filled with a mixture of an H type strong acidic cation exchange resin (Amberlite IR-120B manufactured by Rohm & Haas Co.) and an OH type strong basic anion exchange resin (Amberlite IRA-400 manufactured by Rohm & Haas Co.) in a volume ratio of 1:1 to reduce both calcium ions and magnesium ions at concentrations of not more than 1 mg per liter respectively, and then to which was added sodium dichloroisocyanulate in an amount of 0.02 g per liter was used.

EXAMPLE 2

Samples 201, 202, 208 to 210, A-203 to 207, 211 to 215, B-203 to 207, 211 to 215, C-203 to 207, 211 to 215 and D-203 to 207, 211 to 215, D-203 to D-215:

Samples were prepared in the same manner as described for Sample 101 used in Example 1, except substituting Coupler A-1 used in the third layer of Sample 101 with each of the couplers shown in Tables 2 and 3.

The samples thus-prepared were subjected to the same processing and evaluation as described in Example 1. The results thus-obtained are shown in Tables 2 and 3.

It can be seen from the results shown in Tables 2 and 3 that the water-soluble polymer couplers according to the present invention are less diffusible to other layers similar to the results obtained in Example 1, irrespective of a kind of coupler moiety.

Comparative Coupler B-1:

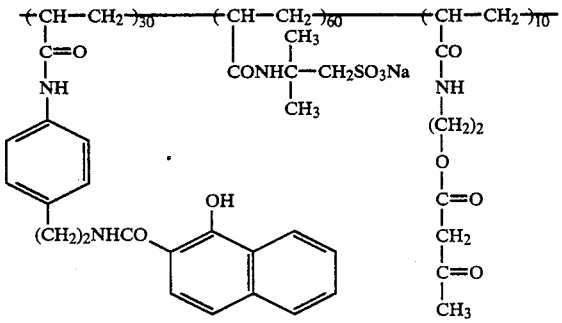

(compound as described in U.S. Pat. No. 4,215,195)

Comparative Coupler B-2

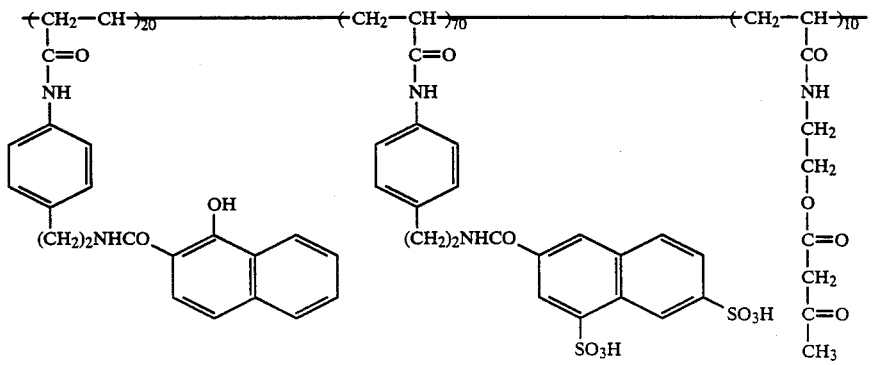

(compound as described in Japanese Application (OPI) No. 28744/83)

-continued

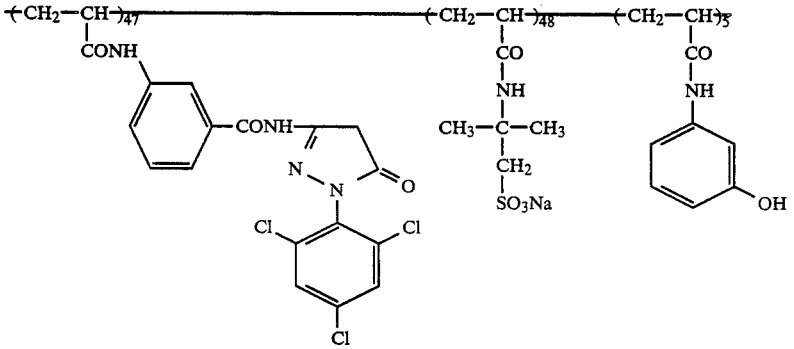

(compound as described in U.S. Pat. No. 4,207,109)

Comparative Coupler D-2:

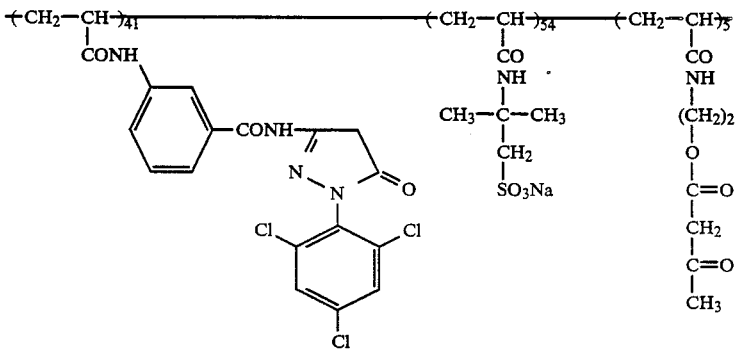

Comparative Coupler D-3:

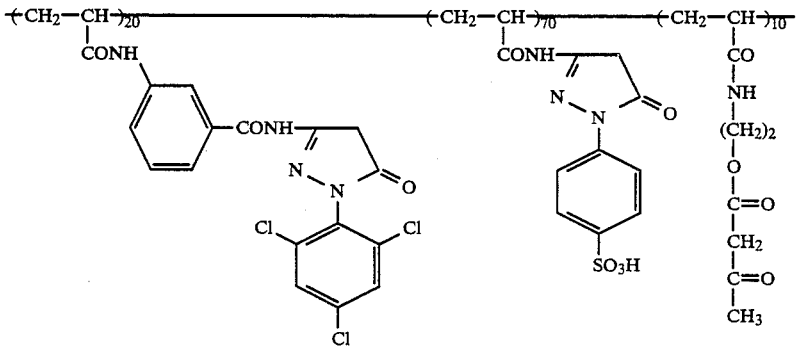

(compound as described in Japanese Patent Application (OPI) No. 28744/83)

TABLE 2

| Sample No. | | Coupler No. | $D_1/D_2$ |
|---|---|---|---|
| 201 | (Comparison) | B-1 | 0.19 |
| 202 | (") | B-2 | 0.30 |
| A-203 | (Present Invention) | $C_1$-6 | 0.12 |
| A-204 | (") | $C_1$-8 | 0.10 |
| A-205 | (") | $C_1$-10 | 0.08 |
| A-206 | (") | $C_1$-12 | 0.08 |
| A-207 | (") | $C_1$-15 | 0.11 |
| B-203 | (Present Invention) | $C_2$-6 | 0.07 |
| B-204 | (") | $C_2$-7 | 0.09 |
| B-205 | (") | $C_2$-8 | 0.08 |
| B-206 | (") | $C_2$-12 | 0.10 |
| B-207 | (") | $C_2$-15 | 0.09 |
| C-203 | (Present Invention) | $C_3$-2 | 0.13 |
| C-204 | (") | $C_3$-4 | 0.13 |
| C-205 | (") | $C_3$-10 | 0.11 |
| C-206 | (") | $C_3$-12 | 0.10 |
| C-207 | (") | $C_3$-15 | 0.09 |
| D-203 | (Present Invention) | $C_4$-6 | 0.08 |
| D-204 | (") | $C_4$-7 | 0.07 |
| D-205 | (") | $C_4$-8 | 0.07 |
| D-206 | (") | $C_4$-12 | 0.06 |

TABLE 2-continued

| Sample No. | | Coupler No. | $D_1/D_2$ |
|---|---|---|---|
| D-207 | (") | $C_4$-15 | 0.09 |

TABLE 3

| Sample No. | | Coupler No. | $D_1/D_2$ |
|---|---|---|---|
| 208 | (Comparison) | D-1 | 0.28 |
| 209 | (") | D-2 | 0.31 |
| 210 | (") | D-3 | 0.36 |
| A-211 | (Present Invention) | $M_1$-3 | 0.11 |
| A-212 | (") | $M_1$-4 | 0.14 |
| A-213 | (") | $M_1$-5 | 0.12 |
| A-214 | (") | $M_1$-11 | 0.15 |
| A-215 | (") | $M_1$-15 | 0.10 |
| B-211 | (Present Invention) | $M_2$-1 | 0.09 |
| B-212 | (") | $M_2$-2 | 0.13 |
| B-213 | (") | $M_2$-5 | 0.11 |
| B-214 | (") | $M_2$-10 | 0.14 |
| B-215 | (") | $M_2$-11 | 0.10 |
| C-211 | (Present Invention) | $M_3$-1 | 0.13 |
| C-212 | (") | $M_3$-4 | 0.12 |

TABLE 3-continued

| Sample No. | | Coupler No. | $D_1/D_2$ |
|---|---|---|---|
| C-213 | (") | $M_3$-7 | 0.10 |
| C-214 | (") | $M_3$-13 | 0.09 |
| C-215 | (") | $M_3$-15 | 0.11 |
| D-211 | (Present Invention) | $M_4$-1 | 0.08 |
| D-212 | (") | $M_4$-2 | 0.09 |
| D-213 | (") | $M_4$-5 | 0.09 |
| D-214 | (") | $M_4$-10 | 0.10 |
| D-215 | (") | $M_4$-11 | 0.09 |

EXAMPLE 3

Sample 301

On a cellulose triacetate film support provided with a subbing layer was coated each layer having the composition set forth below to prepare a multilayer color photographic light-sensitive material which was designated as Sample 301.

With respect to the compositions of the layers, coated amounts of silver halide and colloidal silver are shown by g/m$^2$ units of silver, the coated amounts of a coupler, additive and gelatin are shown by g/m$^2$ units, and the coated amount of a sensitizing dye is shown by mol number per mol of silver halide present in the same layer.

| First Layer: Antihalation Layer | |
|---|---|
| Black colloidal silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |

| Second Layer: Intermediate Layer | |
|---|---|
| Gelatin | 1.0 |
| UV-1 | 0.03 |
| ExC-4 | 0.02 |
| ExF-1 | 0.004 |
| Solv-1 | 0.1 |
| Solv-2 | 0.1 |

| Third Layer: Low-Sensitive Red-Sensitive Emulsion Layer | |
|---|---|
| Silver iodobromide emulsion (AgI: 4 mol %, uniform AgI type, diameter corresponding to sphere: 0.5 μm, coefficient of variation of diameter corresponding to sphere: 20%, tabular grain, diameter/thickness ratio: 3.0) | 1.2 g (as silver) |
| Silver iodobromide emulsion (AgI: 3 mol %, uniform AgI type, diameter corresponding to sphere: 0.3 μm, coefficient of variation of diameter corresponding to sphere: 15%, spherical grain, diameter/thickness ratio: 1.0) | 0.6 (as silver) |
| Gelatin | 1.0 |
| ExS-1 | $4 \times 10^{-4}$ |
| ExS-2 | $5 \times 10^{-4}$ |
| ExC-1 | 0.05 |
| ExC-2 | 0.50 |
| ExC-3 | 0.03 |
| ExC-4 | 0.12 |
| ExC-5 | 0.01 |

| Fourth Layer: High-Sensitive Red-sensitive Emulsion Layer | |
|---|---|
| Silver iodobromide emulsion (AgI: 6 mol %, internal high AgI type with core/shell ratio of 1:1, diameter corresponding to sphere: 0.7 μm, coefficient of variation of diameter corresponding to sphere: 15%, tabular grain, diameter/thickness ratio: 5.0) | 0.7 (as silver) |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |

| Fifth Layer: Intermediate Layer | |
|---|---|
| Gelatin | 0.5 |
| Cpd-1 | 0.1 |
| Solv-1 | 0.05 |

| Sixth Layer: Low-Sensitive Green-Sensitive Emulsion Layer | |
|---|---|
| Silver iodobromide emulsion (AgI: 4 mol %, surface high AgI type with core/shell ratio of 1:1, diameter corresponding to sphere: 0.5 μm, coefficient of variation of diameter corresponding to sphere: 15%, tabular grain, diameter/thickness ratio: 4.0) | 0.35 (as silver) |
| Silver iodobromide emulsion (AgI: 3 mol %, uniform AgI type, diameter corresponding to sphere: 0.3 μm, coefficient of variation of diameter corresponding to sphere: 25%, spherical grain, diameter/thickness ratio: 1.0) | 0.20 (as silver) |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |

| Seventh Layer: High-Sensitive Green-sensitive Emulsion Layer | |
|---|---|
| Silver iodobromide emulsion (AgI: 4 mol %, internal high AgI type with core/shell ratio of 1:3, diameter corresponding to sphere: 0.7 μm, coefficient of variation of diameter corresponding to sphere: 20%, tabular grain, diameter/thickness ratio: 5.0) | 0.8 (as silver) |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.01 |
| Solv-1 | 0.2 |
| Solv-4 | 0.01 |

| Eighth Layer: Intermediate Layer | |
|---|---|
| Gelatin | 0.5 |

-continued

| | |
|---|---|
| Cpd-1 | 0.05 |
| Solv-1 | 0.02 |

| Ninth Layer: Donor Layer of Interimage Effect to Red-Sensitive Layer | |
|---|---|
| Silver iodobromide emulsion (AgI: 2 mol %, internal high AgI type with core/shell ratio of 2:1, diameter corresponding to sphere: 1.0 μm, coefficient of variation of diameter corresponding to sphere: 15%, tabular grain, diameter/thickness ratio: 6.0) | 0.35 (as silver) |
| Silver iodobromide emulsion (AgI: 2 mol %, internal high AgI type with core/shell ratio of 1:1, diameter corresponding to sphere: 0.4 μm, coefficient of variation of diameter corresponding to sphere: 20%, tabular grain, diameter/thickness ratio: 6.0) | 0.20 (as silver) |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |

| Tenth Layer: Yellow Filter Layer | |
|---|---|
| Yellow colloidal silver | 0.05 |
| Gelatin | 0.5 |
| Cpd-2 | 0.13 |
| Cpd-1 | 0.10 |

| Eleventh Layer: Low-Sensitive Blue-Sensitive Emulsion Layer | |
|---|---|
| Silver iodobromide emulsion (AgI: 4.5 mol %, uniform AgI type, diameter corresponding to sphere: 0.7 μm, coefficient of variation of diameter corresponding to sphere: 15%, tabular grain, diameter/thickness ratio: 7.0) | 0.3 (as silver) |
| Silver iodobromide emulsion (AgI: 3 mol %, uniform AgI type, diameter corresponding to sphere: 0.3 μm, coefficient of variation of diameter corresponding to sphere: 25%, tabular grain, diameter/thickness ratio: 7.0) | 0.15 (as silver) |
| Gelatin | 1.6 |

-continued

| | |
|---|---|
| ExS-6 | $2 \times 10^{-4}$ |
| ExC-16 | 0.05 |
| ExY-13 | 0.07 |
| ExY-15 | 1.5 |
| Solv-1 | 0.20 |

| Twelfth Layer: Low-Sensitive Blue-Sensitive Emulsion Layer | |
|---|---|
| Silver iodobromide emulsion (AgI: 10 mol %, internal high AgI type, diameter corresponding to sphere: 1.0 μm, coefficient of variation of diameter corresponding to sphere: 25%, multiple twin tabular grain, diameter/thickness ratio: 2.0) | 0.5 (as silver) |
| Gelatin | 0.5 |
| ExS-6 | $1 \times 10^{-4}$ |
| ExY-15 | 0.20 |
| ExY-13 | 0.01 |
| Solv-1 | 0.10 |

| Thirteenth Layer: First Protective Layer | |
|---|---|
| Gelatin | 0.8 |
| UV-4 | 0.1 |
| UV-5 | 0.15 |
| Solv-1 | 0.01 |
| Solv-2 | 0.01 |

| Fourteenth Layer: Second Protective Layer | |
|---|---|
| Fine grain silver iodobromide emulsion AgI: 2 mol %, uniform AgI type, diameter corresponding to sphere: 0.07 μm) | 0.5 (as silver) |
| Gelatin | 0.45 |
| Polymethyl methacrylate particle (diameter: 1.5 μm) | 0.2 |
| H-1 | 0.4 |

Each layer described above further contained a stabilizer for emulsion (Cpd-3: 0.04 g/m$^2$) and a surface active agent (Cpd-4: 0.02 g/m$^2$) as a coating aid in addition to the above described compounds. Further, compounds (Cpd-5: 0.5 g/m$^2$, Cpd-6: 0.5 g/m$^2$) were added to each emulsion layer.

The compounds used for the preparation of Sample 301 are set forth below.

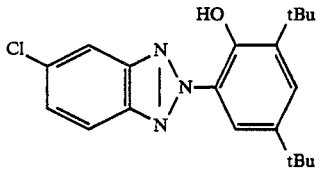

UV-1

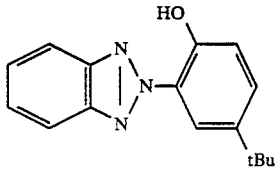

UV-2

-continued
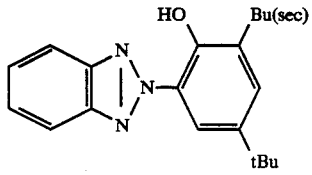
UV-3
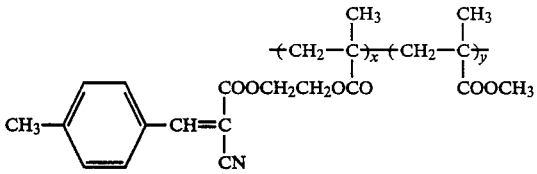
x:y = 7:3 (by weight ratio) M.W. = 40,000
UV-4
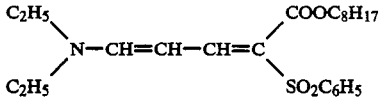
UV-5
Tricresyl phosphate — Solv-1
Dibutyl phthalate — Solv-2
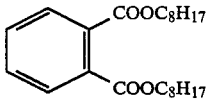
Solv-3
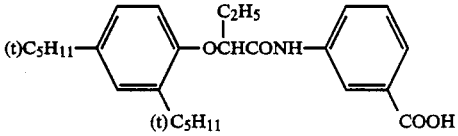
Solv-4
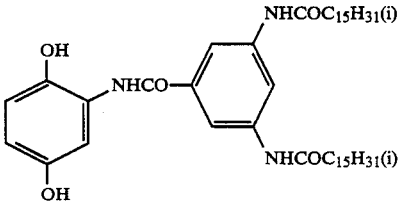
Cpd-1
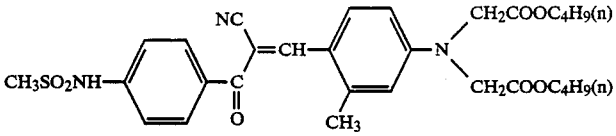
Cpd-2
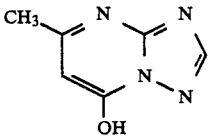
Cpd-3
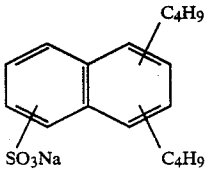
Cpd-4

-continued
Cpd-5
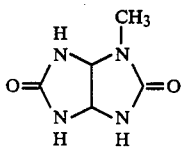
Cpd-6
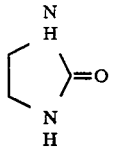
ExC-1
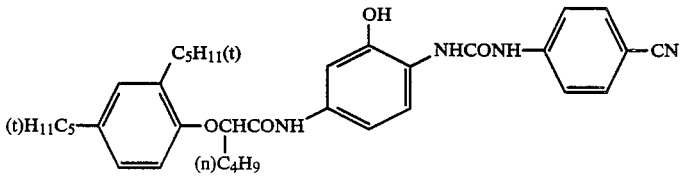
ExC-2
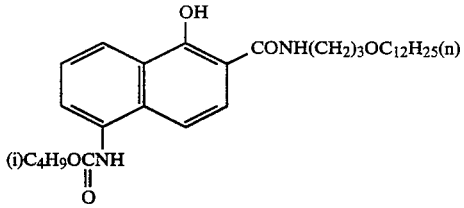
ExC-3
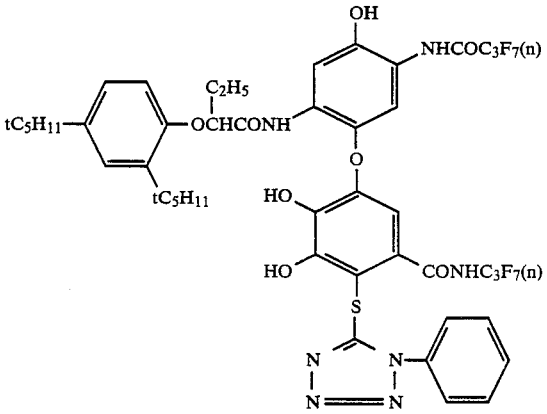
ExC-4
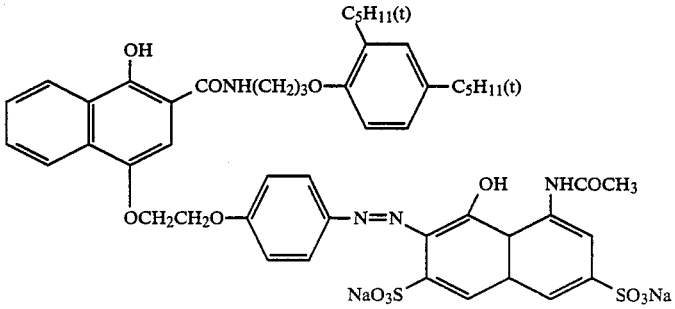

-continued
ExC-5
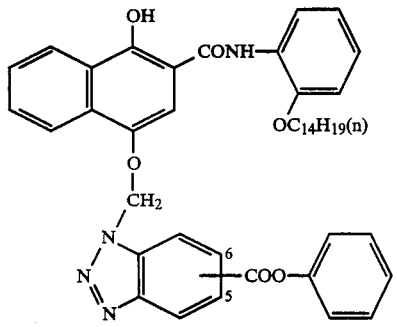
(a mixture of compounds substituted at 5- and 6-position)
ExC-6
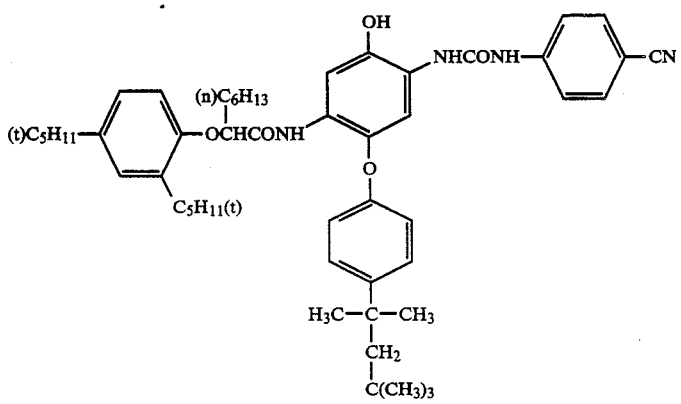
ExC-7
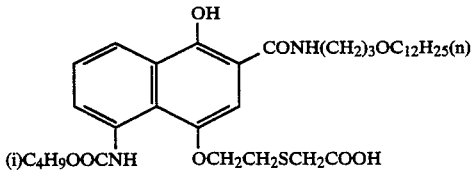
ExM-8
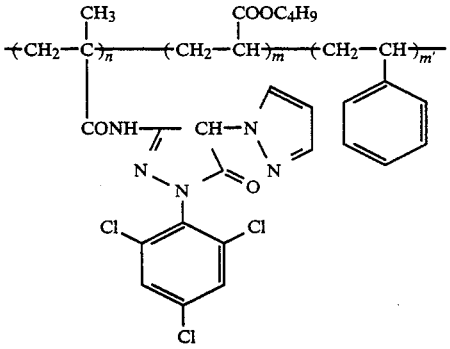
[n = 50, m = 25, m' = 25, molecular weight: about 20,000]
ExM-9
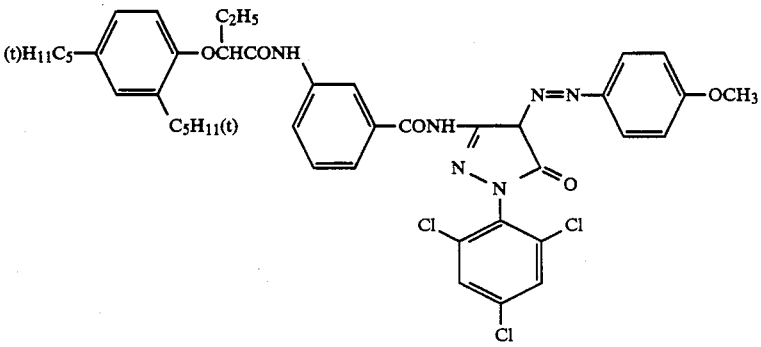

-continued
ExM-10
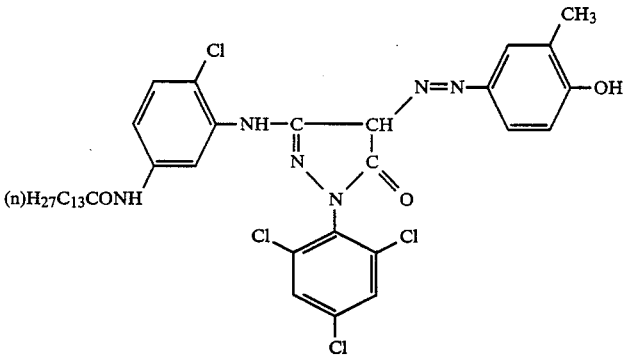
ExY-11
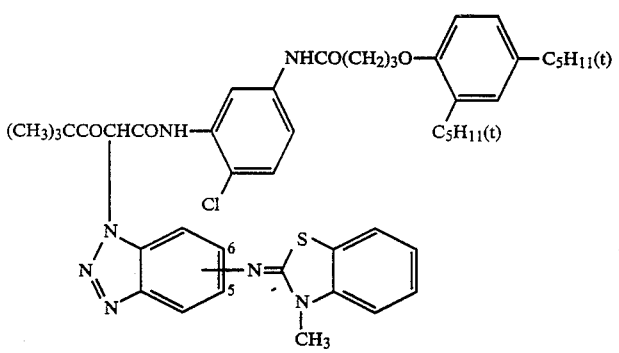
(a mixture of compounds having substituted at 5- and 6-position)
ExM-12
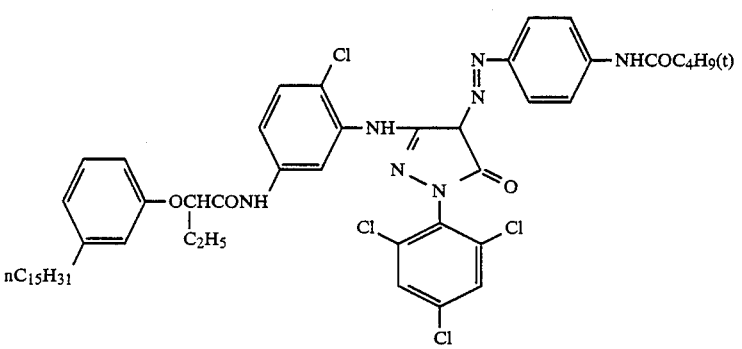
ExY-13
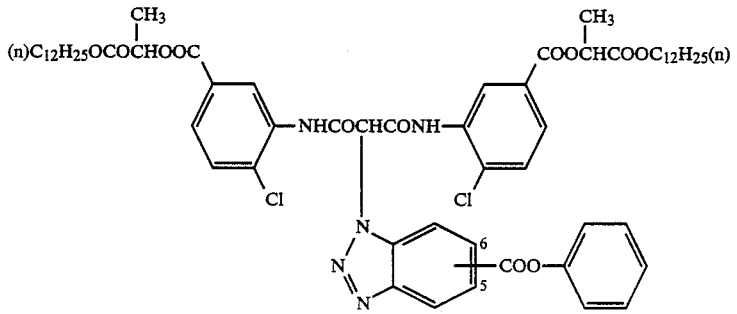
(a mixture of compounds having substituted at 5- and 6-position)

-continued
ExM-14
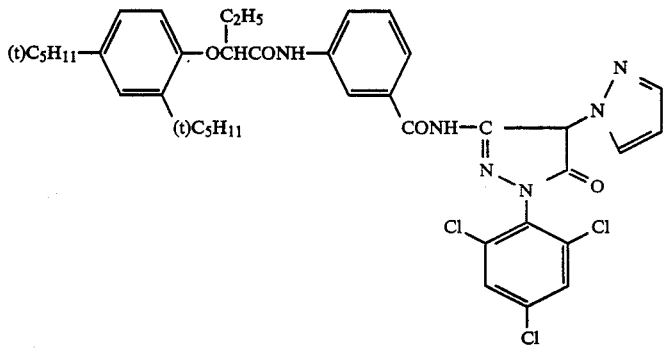
ExY-15
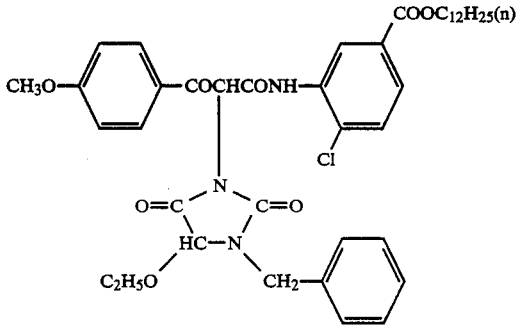
ExC-16
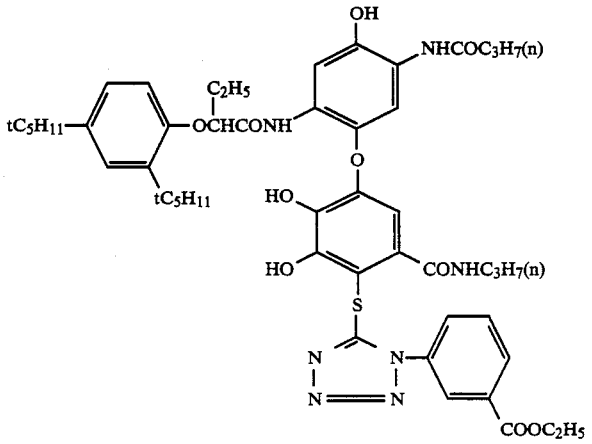
ExS-1
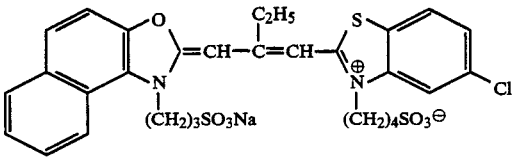
ExS-2
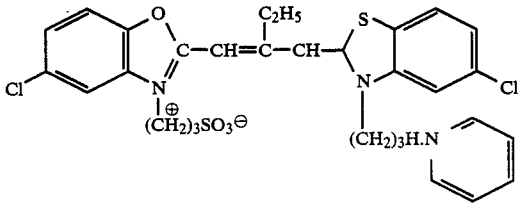

-continued

ExS-3

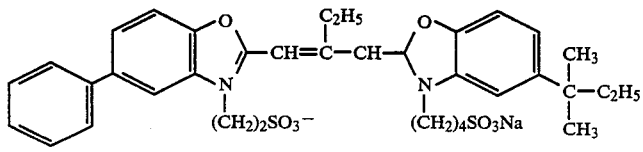

ExS-4

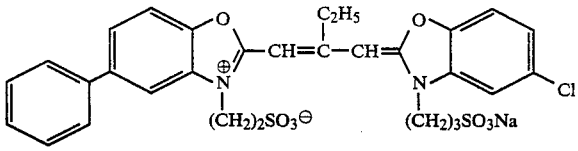

ExS-5

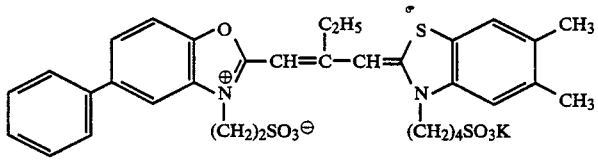

ExS-6

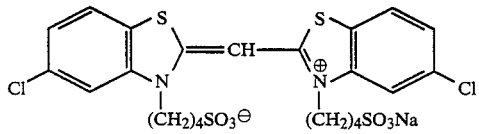

H-1

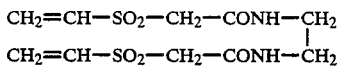

ExF-1

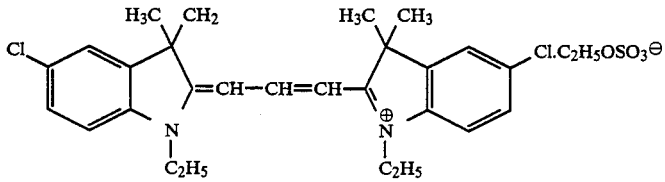

Samples 302 to 307, A-308 to 311, B-308 to 311, C-308 to 311, and D-308 to 316

Samples were prepared in the same manner as described for Sample 301, except that the organic solvent having a high boiling point used in the eleventh layer and the twelfth layer of Sample 301 was eliminated and that the couplers shown in Table 4 below were used by dispersing in place of the coupler ExY-15 used in the eleventh layer and the twelfth layer of Sample 301, respectively, in an equimolar amount of the coupler moiety.

The couplers ExY-16, ExY-17, and ExY-18 used in Samples 302 to 304 respectively are illustrated below. The water-soluble polymer coupler was added to the emulsion as a 5% by weight aqueous solution thereof.

Samples thus-prepared were subjected to wedge exposure to green light and then development processing shown below.

Each of the samples thus-prepared was subjected to density measurement, and by evaluating yellow density of the magenta color forming layer, the degree of diffusion of coupler from the blue-sensitive layer to the green-sensitive layer was determined.

Further, in order to determine strength of emulsion layer, Vickers hardness Samples was measured using a Terasawa type micro hardness tester (MM-2 Model) with a Knoop pressure plate. With respect to the Vickers hardness, reference can be made to the description in D. Tabor, "The Physical Meaning of Indentation and Scratch Hardness", *British Journal of Applied Physics*, Vol. 7, page 260 (1956).

The results thus-obtained are shown in Table 4 below.

As is apparent from the results shown in Table 4, when the conventional oil-soluble couplers are employed, the problem in that layer strength is low occurs, although there is no problem regarding the diffusion of the coupler into other layers. Further, known water-soluble polymer couplers exhibit large diffusion into other layers and thus can not be practically utilized, although they show good layer strenth.

On the contrary, in the case of using the water-soluble polymer couplers according to the present invention, color mixing due to the diffusion of coupler into other layers is reduced and also layer strength is preferably maintained. It is unexpected and surprising that these two characteristics are fulfilled at the same time.

ExY-16

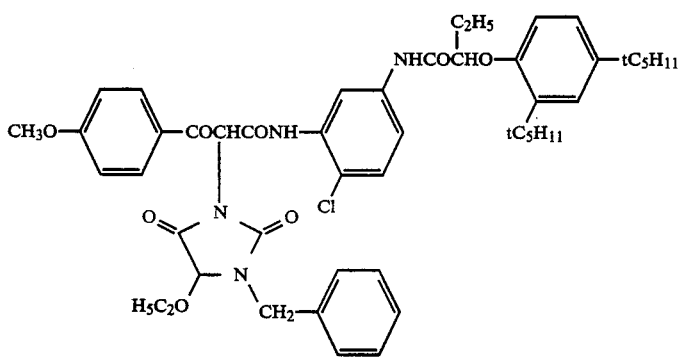

ExY-17

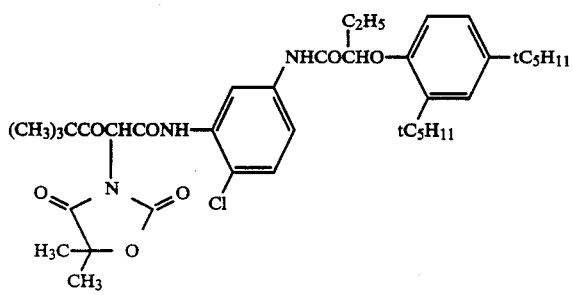

ExY-18

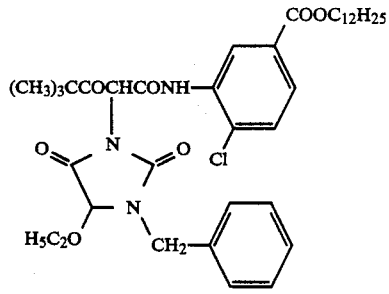

| Processing Step | Time | Temperature |
|---|---|---|
| Color Development | 3 min. 15 sec. | 38° C. |
| Bleaching | 30 sec. | " |
| Bleach-Fixing | 1 min. 30 sec. | " |
| Rinsing | 1 min. 40 sec. | " |
| Stabilizing | 40 sec. | " |

The processing compositions used in the respective steps were as follows.

| | |
|---|---|
| Color Developing Solution: | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-Ethyl-N-β-hydroxyethylamino)-2-methylaniline sulfate | 4.5 g |
| Water to make | 1.0 liter |
| pH | 10.0 |
| Bleaching Solution: | |
| Ammonium bromide | 100 g |
| Ammonium Fe(III) ethylenediaminetetraacetate | 120 g |
| Disodium ethylenediaminetetraacetate | 10.0 g |
| Ammonium nitrate | 10.0 g |
| Bleach accelerating agent | 2.0 g |

-continued

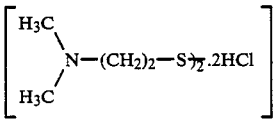

| | |
|---|---|
| Aqueous ammonia | 17.0 ml |
| Water to make | 1.0 liter |
| pH | 6.5 |
| Bleach-Fixing Solution: | |
| Ammonium bromide | 50.0 g |
| Ammonium Fe(III) ethylenediaminetetraacetate | 50.0 g |
| Disodium ethylenediaminetetraacetate | 5.0 g |
| Ammonium nitrate | 5.0 g |
| Sodium sulfite | 12.0 g |
| Ammonium thiosulfate (70% aq. soln.) | 240 ml |
| Aqueous ammonia | 10.0 ml |
| Water to make | 1.0 liter |
| pH | 7.3 |
| Rinsing Solution: | |
| Disodium ethylenediaminetetraacetate | 0.4 g |
| Water to make | 1.0 liter |
| pH | 7.0 |
| pH adjustment was carried out using sodium hydroxide. | |
| Stabilizing Solution: | |
| Polyoxyethylene-p-monononylphenylether (average degree of polymerization: 10) | 0.3 g |

-continued

| | |
|---|---|
| Water to make | 1.0 liter |

TABLE 4

| Sample No. | Coupler No. | Yellow Density** at Magenta Density* of 1.0 | Layer Strength*** (kg/mm²) |
|---|---|---|---|
| 301 (Comparison) | ExY-15 | ±0 | 12 |
| 302 (") | ExY-16 | ±0 | 11 |
| 303 (") | ExY-17 | ±0 | 1 |
| 304 (") | ExY-18 | +0.02 | 13 |
| 305 (") | A-1 | +0.12 | 19 |
| 306 (") | A-2 | +0.10 | 21 |
| 307 (") | A-3 | +0.20 | 21 |
| A-308 (Present Invention) | $Y_1$-3 | +0.05 | 23 |
| A-309 (Present Invention) | $Y_1$-5 | +0.03 | 22 |
| A-310 (Present Invention) | $Y_1$-11 | +0.03 | 21 |
| A-311 (Present Invention) | $Y_1$-12 | +0.03 | 22 |
| B-308 (Present Invention) | $Y_2$-2 | +0.04 | 22 |
| B-309 (Present Invention) | $Y_2$-3 | +0.02 | 21 |
| B-310 (Present Invention) | $Y_2$-11 | +0.02 | 20 |
| B-311 (Present Invention) | $Y_2$-12 | +0.03 | 22 |
| C-308 (Present Invention) | $Y_3$-3 | +0.05 | 21 |
| C-309 (Present Invention) | $Y_3$-5 | +0.02 | 22 |
| C-310 (Present Invention) | $Y_3$-11 | +0.03 | 23 |
| C-311 (Present Invention) | $Y_3$-12 | +0.02 | 22 |
| D-308 (Present Invention | $Y_4$-2 | +0.04 | 23 |
| D-309 (Present Invention) | $Y_4$-3 | +0.03 | 21 |
| D-310 (Present Invention) | $Y_4$-5 | +0.03 | 22 |
| D-311 (Present Invention | $Y_4$-6 | +0.04 | 23 |
| D-312 (Present Invention) | $Y_4$-7 | +0.04 | 22 |
| D-313 (Present Invention) | $Y_4$-11 | +0.02 | 21 |
| D-314 (Present Invention) | $Y_4$-12 | +0.03 | 23 |
| D-315 (Present Invention) | $Y_4$-13 | +0.02 | 24 |
| D-316 (Present Invention) | $Y_4$-14 | +0.02 | 23 |

*, **: Values taking the Dmin as 0
***: Vickers' hardness

EXAMPLE 4

The same evaluation as described in Example 3 was conducted using Samples except employing the processing steps shown below.

As the result, almost same results as described in Table 4 of Example 3 were obtained.

| Processing Step | Time | Temperature |
|---|---|---|
| Color Development | 3 min. 15 sec. | 38° C. |
| Bleach-Fixing | 2 min. 00 sec. | " |
| Washing with Water | 1 min. 40 sec. | " |
| Stabilizing | 40 sec. | " |

The processing compositions used in the respective steps were as follows.

| Color Developing Solution: | |
|---|---|
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-Ethyl-N-β-hydroxyethylamino)-2-methylaniline sulfate | 4.5 g |
| Water to make | 1 liter |
| pH | 10.0 |
| Bleach-Fixing Solution: | |
| Ammonium Fe(III) ethylenediaminetetraacetate | 80.0 g |
| Disodium ethylenediaminetetraacetate | 10.0 g |
| Bleach accelerating agent | 1.5 g |

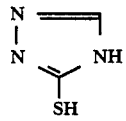

| | |
|---|---|
| Sodium sulfite | 12.0 g |
| Ammonium thiosulfate (70% aq. soln.) | 240 ml |
| Water to make | 1 liter |
| pH | 6.8 |

pH adjustment was carried out using aqueous ammonia (28% aq. soln.).

Washing Water

City water which was passed through a column filled with a mixture of a H type strong acidic cation exchange resin (Amberlite IR-120B manufactured by Rohm & Haas Co.) and an OH type strong basic anion exchange resin (Amberlite IRA-400 manufactured by Rohm & Haas Co.) in a volume ration of 1/1 to reduce both calcium ions and magnesium ions at concentrations of not more than 1 mg per liter respectively, and then to which was added sodium dichloroisocyanulate in an amount of 0.02 g per liter was used.

| Stabilizing Solution: | |
|---|---|
| Formalin (37% w/v) | 2.0 ml |
| Polyoxyethylene-p-monononylphenylether (average degree of polymerization: 10) | 0.3 g |
| Disodium ethylenediaminetetraacetate | 0.05 g |
| Water to make | 1 liter |
| pH | 6.0 |

EXAMPLE 5

Sample 401

On a cellulose triacetate film support provided with a subbing layer, each layer having the composition shown below was coated to prepare a multilayer color photographic light-sensitive material, which was designated as Sample 401.

| First Layer: Antihalation Layer<br>A gelatin layer (dry layer thickness of 2 μm) containing; | |
|---|---|
| Black colloidal silver | 0.25 g/m² |
| Ultraviolet ray absorbing agent U-1 | 0.04 g/m² |
| Ultraviolet ray absorbing agent U-2 | 0.1 g/m² |
| Ultraviolet ray absorbing agent U-3 | 0.1 g/m² |
| High boiling point organic solvent Solv-2 | 0.01 ml/m² |
| Second Layer: Intermediate Layer<br>A gelatin layer (dry layer thickness of 1 μm) containing; | |
| Compound Cpd C | 0.05 g/m² |

-continued

| | |
|---|---|
| Compound I-1 | 0.05 g/m$^2$ |
| High boiling point organic solvent Solv-1 | 0.05 ml/m$^2$ |

Third Layer: First Red-Sensitive Emulsion Layer

A gelatin layer (dry layer thickness of 1 μm) containing;

| | |
|---|---|
| Silver iodobromide emulsion (iodide content: 4 mol %, average particle size: 0.3 μm) spectrally sensitized with sensitizing dye S-1 and sensitizing dye S-2 | 0.5 g/m$^2$ (as silver) |
| Coupler F-1 | 0.2 g/m$^2$ |
| Coupler F-2 | 0.05 g/m$^2$ |
| Compound I-2 | $2 \times 10^{-3}$ g/m$^2$ |
| High boiling point organic solvent Solv-1 | 0.12 ml/m$^2$ |

Fourth Layer: Second Red-Sensitive Emulsion Layer

A gelatin layer (dry layer thickness of 2.5 μm) containing;

| | |
|---|---|
| Silver iodobromide emulsion (iodide content: 3 mol %, average particle size: 0.6 μm) spectrally sensitized with sensitizing dye S-1 and sensitizing dye S-2 | 0.8 g/m$^2$ (as silver) |
| Coupler F-1 | 0.55 g/m$^2$ |
| Coupler F-2 | 0.14 g/m$^2$ |
| Compound I-2 | $1 \times 10^{-3}$ g/m$^2$ |
| High boiling point organic solvent Solv-1 | 0.33 ml/m$^2$ |
| Dye D-1 | 0.02 g/m$^2$ |

Fifth Layer: Intermediate Layer

A gelatin layer (dry layer thickness of 1 μm) containing;

| | |
|---|---|
| Compound Cpd C | 0.1 g/m$^2$ |
| High boiling point organic solvent Solv-1 | 0.1 ml/m$^2$ |
| Dye D-2 | 0.02 g/m$^2$ |

Sixth Layer: First Green-Sensitive Emulsion Layer

A gelatin layer (dry layer thickness of 1 μm) containing;

| | |
|---|---|
| Silver iodobromide emulsion (iodide content: 4 mol %, average particle size: 0.3 μm) spectrally sensitized with sensitizing dye S-3 and sensitizing dye S-4 | 0.7 g/m$^2$ (as silver) |
| Coupler F-3 | 0.20 g/m$^2$ |
| Coupler F-5 | 0.10 g/m$^2$ |
| High boiling point organic solvent Solv-1 | 0.26 ml/m$^2$ |

Seventh Layer: Second Green-Sensitive Emulsion Layer

A gelatin layer (dry layer thickness of 2.5 μm) containing;

| | |
|---|---|
| Silver iodobromide emulsion (iodide content: 2.5 mol %, average particle size: 0.6 μm) spectrally sensitized with sensitizing dye S-3 and sensitizing dye S-4 | 0.7 g/m$^2$ (as silver) |
| Coupler F-4 | 0.10 g/m$^2$ |
| Coupler F-5 | 0.10 g/m$^2$ |
| High boiling point organic solvent Solv-2 | 0.05 ml/m$^2$ |
| Dye D-3 | 0.05 g/m$^2$ |

Eighth Layer: Intermediate Layer

A gelatin layer (dry layer thickness of 1 μm) containing;

| | |
|---|---|
| Compound Cpd C | 0.05 g/m$^2$ |
| High boiling point organic solvent Solv-2 | 0.1 ml/m$^2$ |
| Dye D-4 | 0.01 g/m$^2$ |

Ninth Layer: Yellow Filter Layer

A gelatin layer (dry layer thickness of 1 μm) containing;

| | |
|---|---|
| Yellow colloidal silver | 0.1 g/m$^2$ |
| Compound Cpd C | 0.02 g/m$^2$ |
| Compound Cpd B | 0.03 g/m$^2$ |

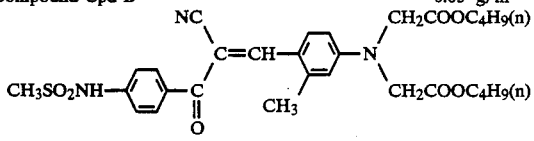

| | |
|---|---|
| High boiling point organic solvent Solv-1 | 0.04 ml/m$^2$ |

Tenth Layer: First Blue-Sensitive Emulsion Layer

A gelatin layer (dry layer thickness of 1.5 μm) containing;

| | |
|---|---|
| Tabular silver iodobromide emulsion (iodide content: 2 mol %, average particle size: 1.3 μm, average aspect ratio: 8) spectrally sensitized with sensitizing dye S-5 | 0.6 g/m$^2$ (as silver) |
| Coupler F-6 | 0.5 g/m$^2$ |
| High boiling point organic solvent Solv-1 | 0.1 ml/m$^2$ |

Eleventh Layer: Second Blue-Sensitive Emulsion Layer

A gelatin layer (dry layer thickness of 3 μm) containing;

| | |
|---|---|
| Tabular silver iodobromide emulsion (iodide content: 2 mol %, average particle size: 2.0 μm, average aspect ratio: 12) spectrally sensitized with sensitizing dye S-6 | 1.1 g/m$^2$ (as silver) |
| Coupler F-6 | 1.2 g/m$^2$ |
| High boiling point organic solvent Solv-1 | 0.23 ml/m$^2$ |
| Dye D-5 | 0.02 g/m$^2$ |

Twelfth Layer: First Protective Layer

A gelatin layer (dry layer thickness of 2 μm) containing;

| | |
|---|---|
| Ultraviolet ray absorbing agent U-1 | 0.02 g/m$^2$ |
| Ultraviolet ray absorbing agent U-2 | 0.32 g/m$^2$ |
| Ultraviolet ray absorbing agent U-3 | 0.03 g/m$^2$ |
| High boiling point organic solvent Solv-2 | 0.28 ml/m$^2$ |

Thirteenth Layer: Second Protective Layer

A gelatin layer (dry layer thickness of 2.5 μm) containing;

| | |
|---|---|
| Surface-fogged, fine grain silver iodobromide emulsion (iodide content: 1 mol %, average particle size: 0.06 μm) | 0.1 g/m$^2$ (as silver) |
| Polymethyl methacrylate Particles (average particle size: 1.5 μm) | 0.2 g/m$^2$ |

Gelatin hardener H-1 (same as described in Example (1) and a surface active agent were incorporated into each of the layers in addition to the above described components.

The compounds employed for the preparation of the sample are illustrated below.

F-1

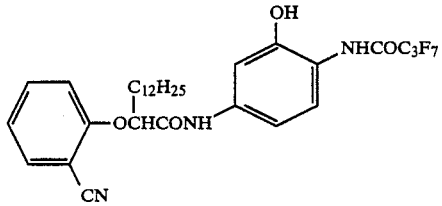

F-2

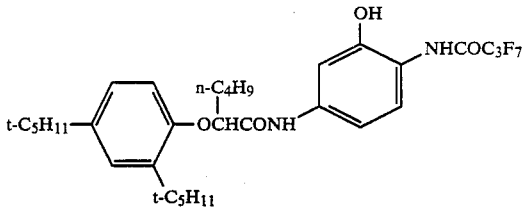

F-3

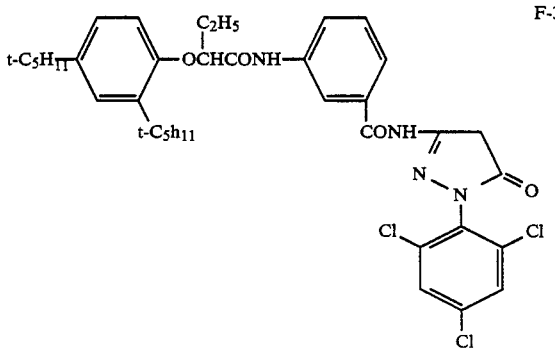

-continued
F-4
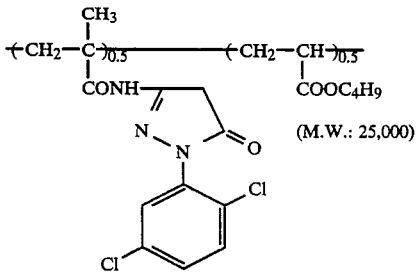
(M.W.: 25,000)
F-5
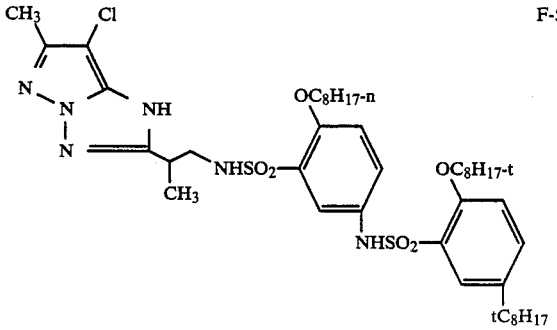
F-6
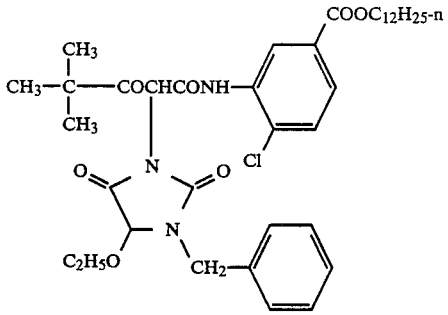
Compound I-1
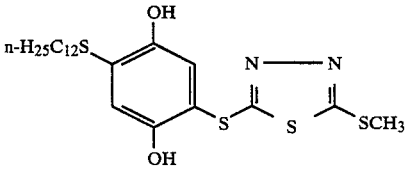
Compound I-2
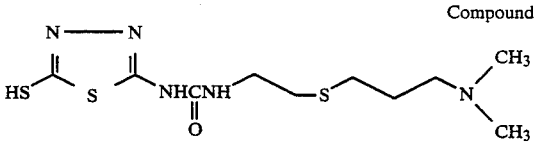
U-1
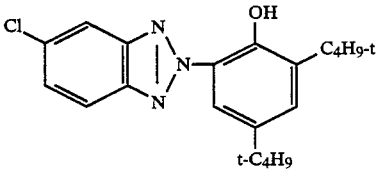
U-2
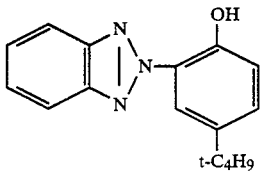
-continued
U-3
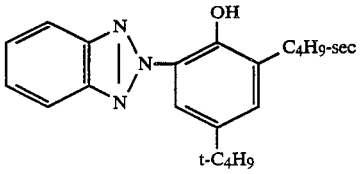
Cpd C
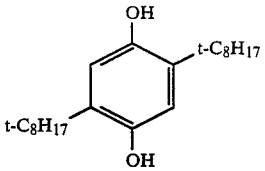
S-1
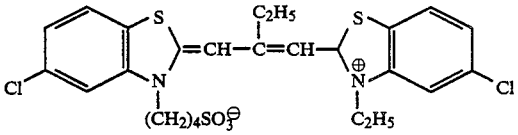
S-2
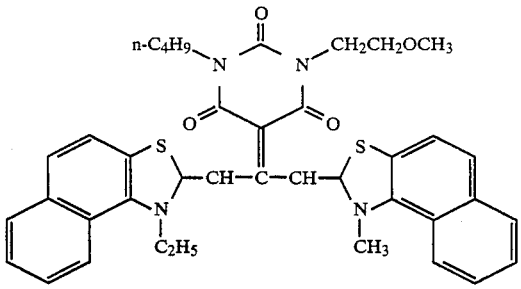
S-3
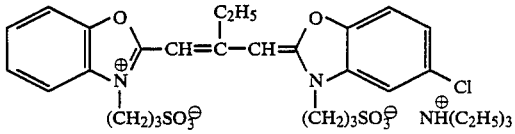
S-4
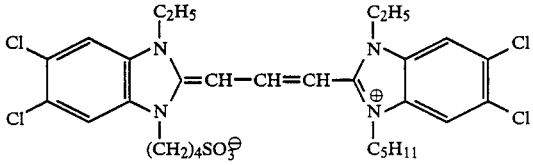
S-5
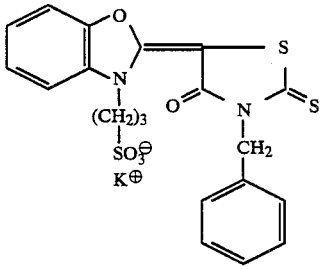
S-6
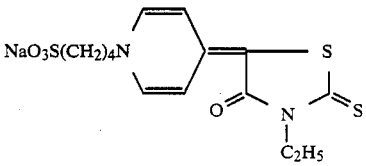

-continued

D-1

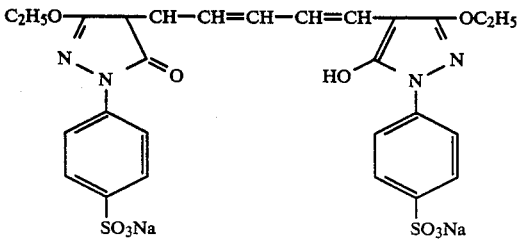

D-2

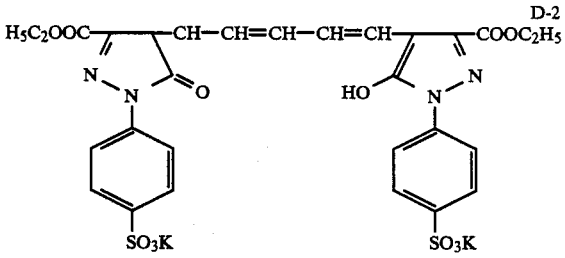

D-3

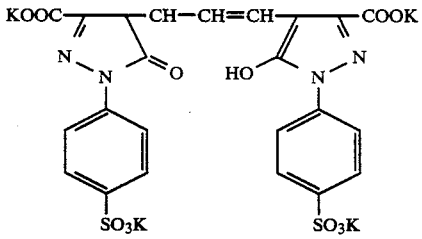

D-4

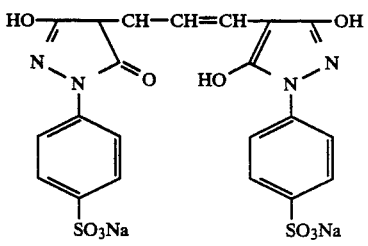

D-5

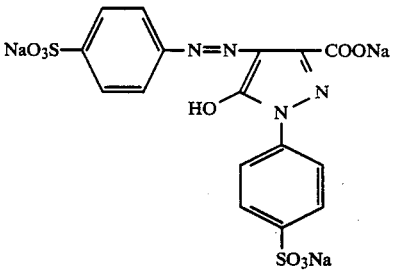

High boiling point organic solvents Solv-1 and Solv-2 are same as those used in Example 1.

Samples 402 to 404, A-405, 406, B-405,406, C-405, 406 and D-405 to 410:

Samples were prepared in the same manner as described for Sample 401 except eliminating the high boiling organic solvent used in the tenth layer and the eleventh layer and using the couplers as shown in Table 5 below in an equimolar amount of the coupler moiety of Coupler F-6 in place of Coupler F-6 used in Sample 401.

The water-soluble polymer couplers used was added to the emulsion as a 5% by weight aqueous solution thereof.

Samples thus-prepared were cut into a half-cabinet size and without exposure to light subjected to development processing according to the processing steps described below. The amount of the first developing solution was 100 ml per sheet of half-cabinet size.

| Processing Steps | Time | Temperature |
|---|---|---|
| First Development | 6 minutes | 38° C. |
| Washing with Water | 2 minutes | " |
| Reversal | 2 minutes | " |
| Color Development | 6 minutes | " |
| Controlling | 2 minutes | " |
| Bleaching | 6 minutes | " |
| Fixing | 4 minutes | " |
| Washing with Water | 4 minutes | " |
| Stabilizing | 1 minute | Normal temperature |
| Drying | | |

The compositions of the processing solutions used for the above-described steps were as follows:

| | |
|---|---|
| First Developing Solution: | |
| Water | 700 ml |
| Pentasodium nitrilo-N,N,N-trimethylene-phosphonate | 2 g |
| Sodium sulfite | 20 g |
| Hydroquinone monosulfonate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make | 1000 ml |
| Reversal Solution | |
| Water | 700 ml |
| Pentasodium nitrilo-N,N,N-trimethylene-phosphonate | 3 g |
| Stannous chloride (dihydrate) | 1 g |
| p-Aminophenol | 0.1 g |
| Sodium hydroxide | 8 g |
| Glacial acetic acid | 15 ml |
| Water to make | 1000 ml |
| Color Developing Solution | |
| Water | 700 ml |
| Pentasodium nitrilo-N,N,N-trimethylene-phosphonate | 3 g |
| Sodium sulfite | 7 g |
| Sodium tertiary phosphate (12 hydrate) | 36 g |
| Potassium bromide | 1 g |
| Potassium iodide (0.1% solution) | 90 ml |
| Sodium hydroxide | 3 g |
| Citrazinic acid | 1.5 g |
| N-Ethyl-N-(β-methanesulfonamidoethyl)-3-methyl-4-aminoaniline sulfate | 11 g |
| 3,6-Dithiaoctane-1,8-diol | 1 g |
| Water to make | 1000 ml (pH 12.0) |
| Controlling Solution | |
| Water | 700 ml |
| Sodium sulfite | 12 g |
| Sodium ethylenediaminetetraacetate (dihydrate) | 8 g |
| Thioglycerol | 0.4 ml |
| Glacial acetic acid | 3 ml |
| Water to make | 1000 ml |
| Bleaching Solution | |
| Water | 800 ml |
| Sodium ethylenediaminetetraacetate (dihydrate) | 2 g |
| Ammonium ethylenediaminetetraacetate iron (III) (dihydrate) | 120 g |
| Potassium bromide | 100 g |

-continued

| | |
|---|---|
| Water to make | 1000 ml |
| Fixing Solution | |
| Water | 800 ml |
| Sodium thiosulfate | 80.0 g |
| Sodium sulfite | 5.0 g |
| Sodium bisulfite | 5.0 g |
| Water to make | 1000 ml |
| Stabilizing Solution | |
| Water | 800 ml |
| Formalin (37 wt % formaldehyde) | 5.0 ml |
| Fuji Driwel (surface active agent, manufactured by Fuji Photo Film Co., Ltd.) | 5.0 ml |
| Water to make | 1000 ml |

The six kinds of the first developing selutions after the processing were concentrated and analyzed by liquid chromatography using a Symadzu LC-6A Type device (eluate: methanol/Water=88/12 (by volume), triethylamine 0.05%, PH: 7.0, detected wavelength: 290nm, column: TSK-gel ODS-80TM) to determine the amount of the polymer coupler discharged into the first developing solution. The results thus-obtained are shown in Table 5 below.

TABLE 5

| Sample No. | Coupler No. | Amount Discharged into First Developing Solution* (%) |
|---|---|---|
| 401 | (Comparison) F-6 | 0 |
| 402 | (") A-1 | 25 |
| 403 | (") A-2 | 28 |
| 404 | (") A-3 | 29 |
| A-405 | (Present Invention) $Y_1$-3 | 8 |
| A-406 | (") $Y_1$-7 | 9 |
| B-405 | (") $Y_2$-4 | 7 |
| B-406 | (") $Y_2$-7 | 5 |
| C-405 | (") $Y_3$-3 | 8 |
| C-406 | (") $Y_3$-4 | 9 |
| D-405 | (") $Y_4$-4 | 7 |
| D-406 | (") $Y_4$-7 | 5 |
| D-407 | (") $Y_4$-11 | 3 |
| D-408 | (") $Y_4$-12 | 3 |
| D-409 | (") $Y_4$-13 | 2 |
| D-410 | (") $Y_4$-14 | 3 |

*Ratio to the total amount of yellow coupler added.

From the results shown in Table 5 it is apparent that the water-soluble polymer couplers according to the present invention show small discharged amount into the first developing solution and are stable subjected to such processing.

Further, with these samples, Vickers hardness was measured in the same manner as described in Example 3 and almost same results as those in Example 3 were obtained.

As can been seen from the results, above, color photographic light-sensitive materials having sufficiently high layer strength and extremely small amount of coupler discharged into the processing solution are obtained by using the water-soluble polymer coupler according to the present invention.

While the invention has been described in detail and with reference to specific embodiments thereof, it will be apparent to one skilled in the art that various changes and modifications can be made therein without departing from the spirit and scope thereof.

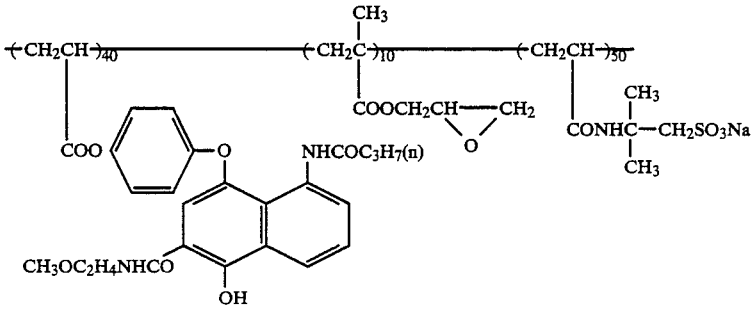

C4-13

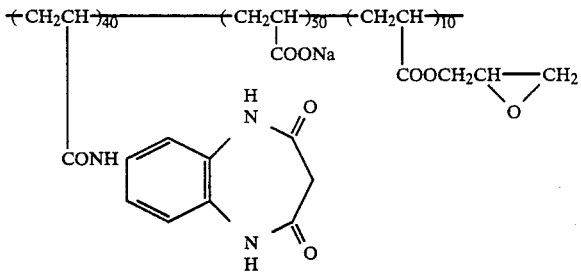

C4-14

What is claimed is:

1. A silver halide color photographic material comprising a support having thereon at least one silver halide emulsion layer, wherein the silver halide color photographic material contains a water-soluble polymer comprising at least one repeating unit represented by formula (I):

$$\text{(A)} \qquad \text{(I)}$$

wherein A represents a vinyl monomer repeating unit having a color coupler moiety which is capable of forming a dye upon coupling with an oxidation product of an aromatic primary amine developing agent;

and at least one repeating unit selected from the group consisting of units represented by following formulae (II-A), (II-B), (II-C), (II-D), (II-E), and (II-F);

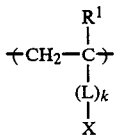

(II-A)

wherein $R^1$ represents a hydrogen atom, a lower alkyl group having from 1 to 6 carbon atoms or a chlorine atom; L represents a divalent group having from 1 to 20 carbon atoms, K represents 0 or 1; and X represents an active ester group;

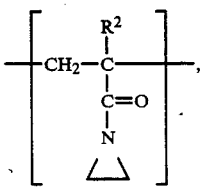

(II-B)

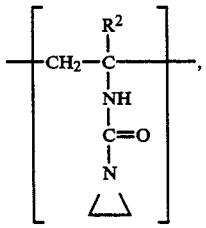

(II-C)

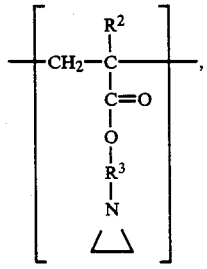

(II-D)

wherein $R^2$ represents a hydrogen atom, a chlorine atom or a lower alkyl group having from 1 to 6 carbon atoms, and $R^3$ represents an alkylene group;

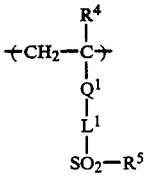

(II-E)

wherein $R^4$ represents a hydrogen atoms or a lower alkyl group having from 1 to 6 carbon atoms; $Q^1$ represents

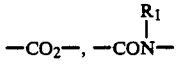

or an arylene group having from 6 to 10 carbon atoms; $L^1$ represents a divalent group having from 3 to 15 carbon atoms and containing at least one bond selected from

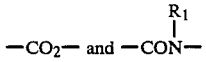

or a divalent group having from 1 to 12 carbon atoms and containing at least one bond selected from

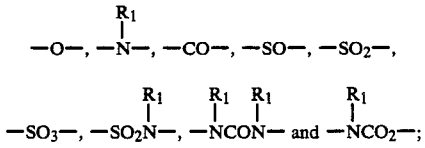

$R_1$ represents a hydrogen atom or a lower alkyl group having from 1 to 6 carbon atoms; $R^5$ represents $-CH{=}CH_2$ or $-CH_2CH_2X_1$; and $X_1$ represents a group capable of being substituted with a nucleophilic group or of being released by a base in the form of $HX_1$;

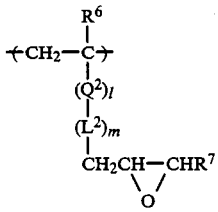

(II-F)

wherein $R^6$ represents a hydrogen atom, a chlorine atom or an alkyl group; $Q^2$ represents

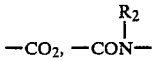

or an arylene group having from 6 to 10 carbon atoms; $L^2$ represents a divalent group having from 3 to 15 carbon atoms and containing at least one bond selected from

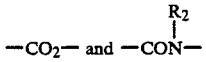

or a divalent group having from 1 to 12 carbon atoms and containing at least one bond selected from

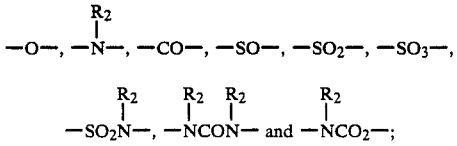

$R_1$ represents a hydrogen atom or a lower alkyl group having from 1 to 6 carbon atoms; $R^7$ represents a hydrogen atom or an alkyl group; l and m each represents 0 or 1, and l and m are not 0 at the same time.

2. A silver halide color photographic material as in claim 1, wherein the repeating unit represented by formula (I) is represented by formula (III)

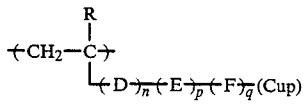

(III)

wherein R represents a hydrogen atom, an alkyl group having from 1 to 4 carbon atoms or a chlorine atom; D represents —COO—, —CONR$_3$— or a substituted or unsubstituted phenyl group; E represents a substituted or unsubstituted alkylene group preferably having from 1 to 10 carbon atoms, a substituted or unsubstituted phenylene group or a substituted or unsubstituted aralkylene group preferably having from 7 to 20 carbon atoms; F represents —COR$_3$—, —NR$_3$CONR3—, —R$_3$COO—, —NR$_3$CO—, —OCONR$_3$—, —NR$_3$—, —COO—, —OCO—, —CO—, —O—, —SO$_2$—, —NR$_3$SO$_2$— or —SO$_2$NR$_3$—; R$_3$ represents a hydrogen atom, a substituted or unsubstituted alkyl group or a substituted or unsubstituted aryl group, and when two or more R$^3$ groups are present in the same molecule, they may be the same or different; n, p and q each represents 0 or 1, provided that all of n, p and q are not 0 at the same time; and Cup represents a cyan, magenta or yellow dye forming coupler moiety capable of forming a dye upon coupling with an oxidation product of an aromatic primary amine developing agent.

3. A silver halide color photographic material as in claim 2, wherein a substituent for the substituted group represented by D, E or R$_3$ is selected from an alkyl group, an alkoxy group, an aryloxy group, an alkoxycarbonyl group, an acylamino group, a carbamoyl group, an alkylcarbamoyl group, a dialkylcarbamoyl group, an arylcarbamoyl group, an alkylsulfonyl group, an arylsulfonyl group, an alkylsulfonamido group, an arylsulfonamido group, a sulfamoyl group, an alkylsulfamoyl group, an dialkylsulfamoyl group, an alkylthio group, an arylthio group, a cyano group, a nitro group, and a halogen atom.

4. A silver halide color photographic material as in claim 2, wherein the cyan dye forming coupler moiety represented by Cup is a moiety derived from a phenol type compound represented by formula (IV) or (V) described below or a naphthol type compound represented by formula (VI).or (VII) below, wherein a moiety which is formed by eliminating a hydrogen atom other than that of the OH group at the 1-position and that at the coupling position from the compound is connected to F in formula (III)

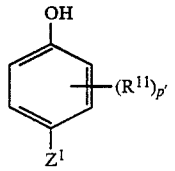

(IV)

-continued

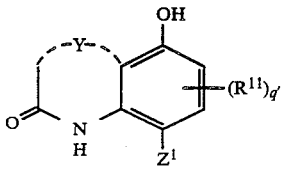

(V)

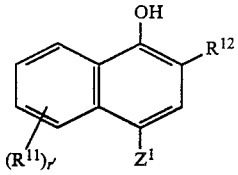

(VI)

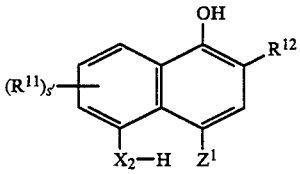

(VII)

wherein R$^{11}$ represents an atom or group capable of substitution on the phenol ring or the naphthol ring; R$^{12}$ represents —CONR$^{13}$R$^{14}$, —NHCOR$^{13}$, —NHCOOR$^{15}$, —NHSO$_2$R$_{15}$, —NHCONR$^{13}$R$^{14}$ or —NHSO$_2$NR$^{13}$R$^{14}$, wherein R$^{13}$ and R$^{14}$ each represents a hydrogen atom, an aliphatic group having from 1 to 30 carbon atoms, an aromatic group having from 6 to 30 carbon atoms, or a heterocyclic group having from 2 to 30 carbon atoms; or R$^{13}$ and R$^{14}$ may be connected to each other to form a heterocyclic ring; and RI5 represents an aliphatic group having from I to 30 carbon atoms, an aromatic group having from 6 to 30 carbon atoms or a heterocyclic group;

p' represents an integer from 0 to 4; q' represents an integer from 0 to 2; and r' and s' each represents an integer from 0 to 4;

X$_2$ represents an oxygen atom, a sulfur atom or

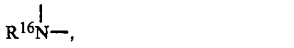

wherein R$^{16}$ represents a hydrogen atom or a monovalent group; and

Z$^1$ represents a hydrogen atom or an atom or group capable of being released upon a coupling reaction with an oxidation product of an aromatic primary amine developing agent.

5. A silver halide color photographic material as in claim 2, wherein the magenta dye forming coupler moiety represented by Cup is a coupler moiety derived from a coupler represented by formula (VII), (VIII), (IX), (X), (XI), (XII) or (XIII) below, wherein the coupler moiety is connected to the group F of formula (III) at any of Sub, Z$^2$, and R$^{20}$ to R$^{32}$.

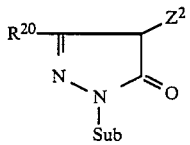

(VII)

-continued (VIII)

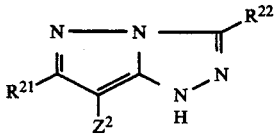

(IX)

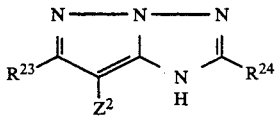

(X)

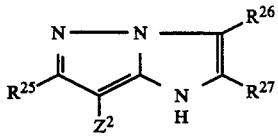

(XI)

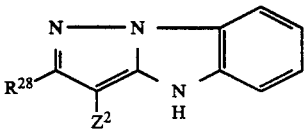

(XII)

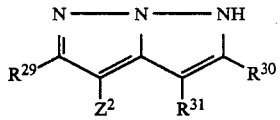

(XIII)

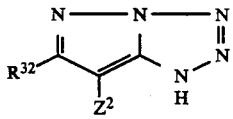

wherein Sub represents a substituent selected from an alkyl group, a substituted alkyl group, a heterocyclic group, a substituted hetetocyclic group, an aryl group or a substituted aryl group; $R^{20}$ represents an unsubstituted or substituted anilino group, an unsubstituted or substituted acylamino group, an unsubstituted or substituted ureido group; $R^{21}$, $R^{22}$, $R^{23}$, $R^{24}$, $R^{25}$, $R^{26}$, $R^{27}$, $R^{28}$, $R^{29}$, $R^{30}$, $R^{31}$and $R^{32}$ each represents a hydrogen atom, a hydroxy group, an unsubstituted or substituted alkyl group, a substituted or unsubstituted aryl group, a substituted or unsubstituted alkoxy group, a substituted or unsubstituted aryloxy group, a substituted or unsubstituted heterocyclic group, a substituted or unsubstituted alkylamino group, a substituted or unsubstituted acylamino group, a substituted or unsubstituted anilino group, a substituted or unsubstituted alkoxycarbonyl group, a substituted or unsubstituted alkylcarbonyl group, a substituted or unsubstituted arylcarbonyl group, a substituted or unsubstituted alkylthio group, a substituted or unsubstituted arylthio group, a substituted or unsubstituted carbamoyl group, a substituted or unsubstituted sulfamoyl group, or a substituted or unsubstituted sulfonamido group; $Z^2$ represents a hydrogen atom or a group capable of being released upon a coupling reaction with an oxidation product of an aromatic primary amine developing agent.

6. A silver halide color photographic material in claim 2, wherein the yellow dye forming coupler moiety represented by Cup is a pivaloyl acetanilide type moiety represented by formula (XIV) described below or a benzoyl acetanilide type moiety represented by formula (XV) or (XVI)

(XIV-a)

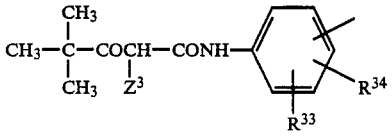

(XIV-b)

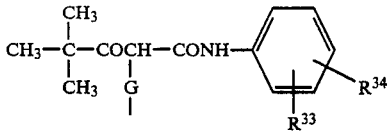

(XV)

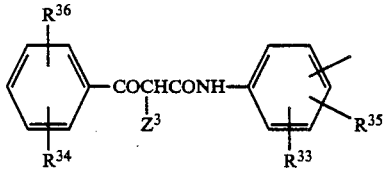

(XVI-a)

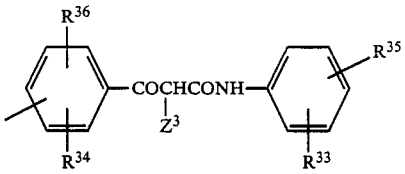

(XVI-b)

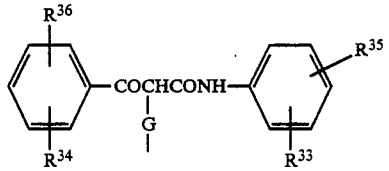

wherein $R^{33}$, $R^{34}$, and $R^{36}$ each represents a hydrogen atom or a substituent selected from an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, a sulfo group, a nitro group, a cyano group, a thiocyano group; the free bond is connected to the polymer chain through a linking group included in D, E or F; and $Z^3$ represents a hydrogen atom or a group represented by formula (XVII), (XVIII), (XIX), or (XX)

(XVII)

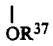

wherein $R^{37}$ represents an unsubstituted or substituted aryl group or heterocyclic group;

(XVIII)

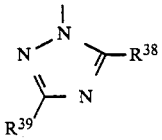

-continued (XIX)

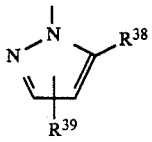

where each $R^{38}$ and $R^{39}$ each represents a hydrogen atom, a halogen atom, a carboxylic acid ester group, an amino group, an alkyl group, an alkylthio group, an alkoxy group, an alkylsulfonyl group, an alkylsulfinyl group, a carboxylic acid group, a sulfonic acid group, or an unsubstituted or substituted phenyl or heterocyclic group;

(XX)

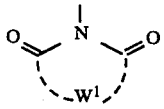

wherein $W^1$ represents non-metallic atoms forming a 4-membered or 5-membered ring together with

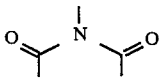

of formula(XX).

7. A silver halide color photographic material as in claim 1, wherein the divalent group represented by L is selected from a group represented by formula (IIa), (IIb), or (IIc)

—J— (IIa)

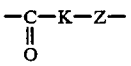

(IIb)

(IIc)

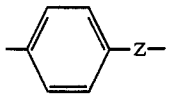

wherein J represents an alkylene group having from 1 to 10 carbon atoms or an arylene group having from 6 to 12 carbon atoms; K represents —O—, —NH— or

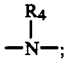

Z represents a group selected from the groups defined for J, or a divalent group containing at least one amido bond, ester bond, ether bond and thioether bond and J groups at both ends; and $R_4$ represents a hydrogen atom or an alkyl group having from 1 to 6 carbon atoms.

8. A silver halide color photographic material as in claim 1, wherein the active ester group is a carboxylic acid ester group of phe or alcohol having pKa of 5 to 13.

9. A silver halide color photographic material as in claim 1, wherein $R^2$ in formulae (II-B), (II-C), and (II-D) $R^2$ represents a lower alkyl group having from 1 to 4 carbon atoms.

10. A silver halide color photographic material as in claim 1, wherein $R^3$ in formulae (II-B), (II-C), and (II-D) represents an alkylene group having from 1 to 6 carbon atoms.

11. A silver halide color photographic material as in claim 1, wherein $R^5$ in formula (II-E) represents a group selected from the group consisting of $-CH{=}CH_2$, $-CH_2CH_2Cl$, $-CH_2CH_2Br$, $-CH_2CH_2O_3SCH_3$,

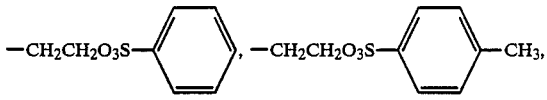

$-CH_2CH_2OH$, $-CH_2CH_2O_2CCH_3$, $-CH_2CH_2O_2CCF_3$, $-CH_2CH_2O_2CCHCl_2$.

12. A silver halide color photographic material as in claim 1, wherein the water soluble polymer further comprises at least one repeating unit other than that represented by formula (II-A)-(II-F), wherein said repeating unit is derived from a non-color forming ethylenic monomer which does not couple with the oxidation product of an aromatic primary amine developing agent.

13. A silver halide color photographic material as in claim 12, wherein the non-color forming monomer is selected from acrylic acid, an acrylic acid ester, methacrylic acid, a methacrylic acid ester, crotonic acid, a crotonic acid ester, a vinyl ester, maleic acid, a maleic acid diester, fumaric acid, a fumaric acid diester, itaconic acid, an itaconic acid diester, an acrylamide, a methacrylamide, a vinyl ester, a styrene.

14. A silver halide color photographic material as in claim 1, wherein the molar ratio of the coupler portion represented by formula (I) and the hardener portion represented by formulae (II-A), (II-B), (II-C), (II-D), (II-E) and (II-F) in the polymeric coupler is from 10% to 95% and from 5% to 50%, respectively.

15. A silver halide color photographic material as in claim 1, wherein the polymeric coupler is added in an amount of from $5\times10^{-4}$ equivalent to $5\times10^{-2}$ equivalent of the hardner portion per 100 g of dry gelatin.

16. A silver halide color photographic material as in claim 1, wherein the molar ratio of a coating amount of silver in a silver halide emulsion to the coupler portion represented by formula (I) is from 1 to 200.

17. A silver halide color photographic material as in claim 1, wherien the coating amount of the polymeric coupler in the photographic material is from 0.1 to 100 parts by weight per part by weight of gelatin contained in the same layer.

18. A silver halide color photographic material as in claim 1, wherein the photographic material contains gelatin.

19. A silver halide color photographic material as in claim 1, wherein the emulsion layer contains gelatin.

20. A silver halide color photographic material as in claim 1, wherein X represents an ester group which is active to gelatin and is selected from the group consisting of:

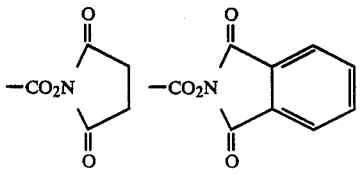

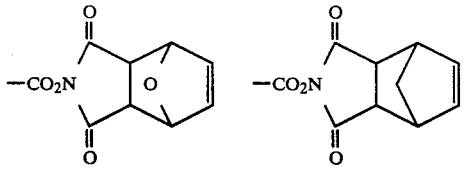

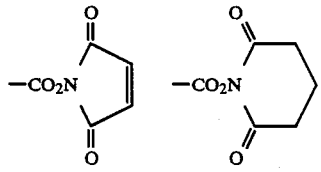

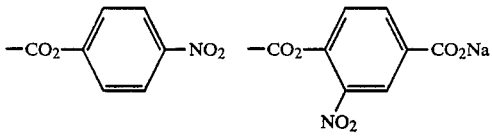

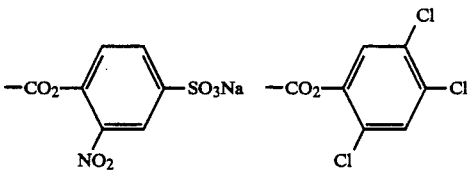

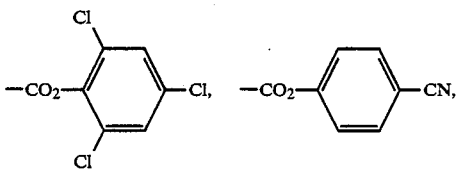

$-CO_2CH_2CN$, $-CO_2CH_2CO_2C_2H_5$, $-CO_2CH_2CONH_2$, $-CO_2CH_2COCH_3$, $-CO_2CH_2CO-$ 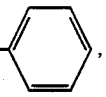 , $-CO_2CH_2CO_2CH{=}CH_2$, $-CO_2N{=}CHCH_3$, $-CO_2N{=}C(CH_3)_2$, $-CO_2\underset{\underset{CH_3}{|}}{C}{=}CHCOCH_3$, $-CO_2CH_2\overset{\oplus}{N}$ 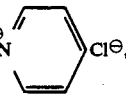 $Cl^{\ominus}$, $-CO_2CH_2CH_2Br$, $-CO_2CH_2CH_2CN$, and $-CO_2CH_2CH_2\overset{\overset{CH_3}{|}}{\underset{\underset{CH_3}{|}}{\overset{\oplus}{N}}}-CH_3Cl^{\ominus}$.

21. A silver halide color photographic material as in claim 1, wherein the repeating unit represented by the formula (II-A) is derived from a compound selected from the group consisting of:

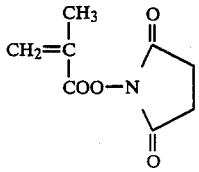

(H-1)

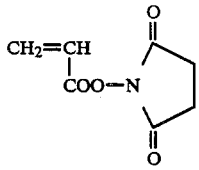

(H-2)

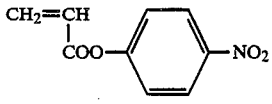

(H-3)

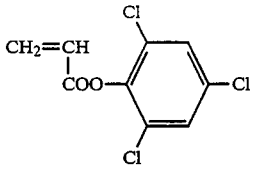

(H-4)

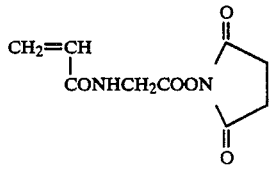

(H-5)

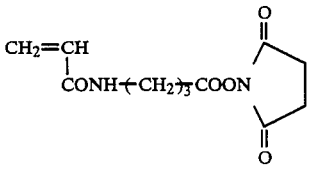

(H-6)

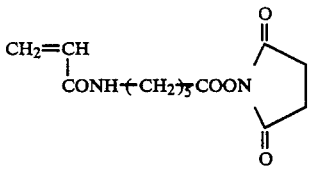

(H-7)

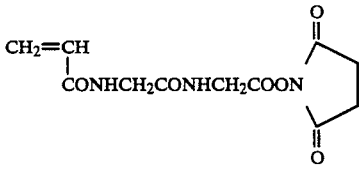

(H-8)

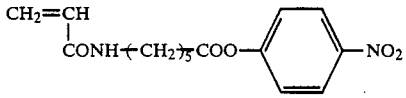

(H-9)

-continued
(H-10)
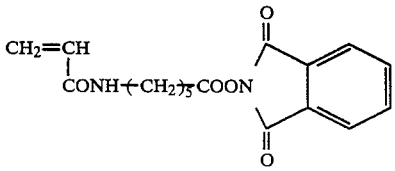
(H-11)
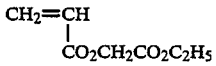
(H-12)
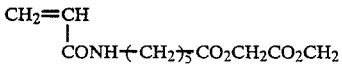
-continued
(H-13)
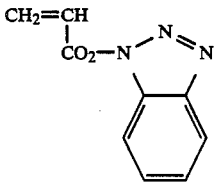
(H-14)
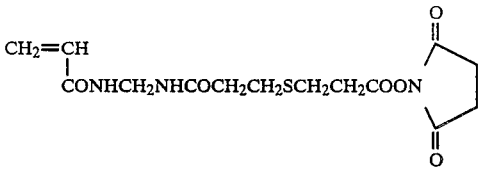
(H-15)
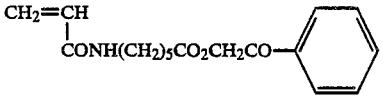
and
(H-16)
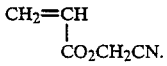
* * * * *